US007097952B2

(12) United States Patent
Nozawa et al.

(10) Patent No.: US 7,097,952 B2
(45) Date of Patent: Aug. 29, 2006

(54) TONER, PROCESS FOR PRODUCING A TONER, IMAGE FORMING METHOD AND IMAGE FORMING APPARATUS

(75) Inventors: Keita Nozawa, Shizuoka-ken (JP); Atsushi Kubo, Ibaraki-ken (JP); Masanori Ito, Numazu (JP); Tomoaki Igarashi, Abiko (JP); Kiyokazu Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 11/125,373

(22) Filed: May 10, 2005

(65) Prior Publication Data

US 2005/0208406 A1 Sep. 22, 2005

Related U.S. Application Data

(62) Division of application No. 10/742,990, filed on Dec. 23, 2003, which is a division of application No. 10/279,126, filed on Oct. 24, 2002, now Pat. No. 6,706,458, which is a division of application No. 09/631,119, filed on Aug. 2, 2000, now Pat. No. 6,555,281.

(30) Foreign Application Priority Data

| | | |
|---|---|---|
| Aug. 2, 1999 | (JP) | 1999/218643 |
| Aug. 2, 1999 | (JP) | 1999/218644 |
| Aug. 2, 1999 | (JP) | 1999/218659 |
| Feb. 29, 2000 | (JP) | 2000/052719 |

(51) Int. Cl.
*G03G 13/08* (2006.01)
*G03G 9/08* (2006.01)

(52) U.S. Cl. ..... 430/124; 430/108.4; 430/108.6; 430/108.7; 430/110.3; 430/111.41

(58) Field of Classification Search ..... 430/108.6, 430/108.7, 108.8, 108.3, 111.4, 109.3, 108.4, 430/111.41, 120, 124, 126, 110.3; 399/279, 399/285, 286, 284
See application file for complete search history.

(56) References Cited

U.S. PATENT DOCUMENTS

| | | | | |
|---|---|---|---|---|
| 2,297,691 | A | 10/1942 | Carlson | |
| 3,666,363 | A | 5/1972 | Tanaka et al. | |
| 4,071,361 | A | 1/1978 | Marushima | |
| 4,839,255 | A | 6/1989 | Hyosu et al. | 430/137.8 |
| 5,437,949 | A | 8/1995 | Kanbayashi et al. | 430/45 |
| 5,659,857 | A | 8/1997 | Yamazaki et al. | 430/45 |
| 5,679,490 | A | 10/1997 | Yachi et al. | 430/108.4 |
| 5,701,568 | A | 12/1997 | Hiroshima et al. | 399/302 |
| 5,753,399 | A * | 5/1998 | Hayase et al. | 430/109.3 |
| 5,776,646 | A | 7/1998 | Hagi et al. | 430/108.6 |
| 5,797,070 | A * | 8/1998 | Waki et al. | 399/149 |
| 5,893,013 | A * | 4/1999 | Kinoshita et al. | 399/284 |
| 5,974,278 | A | 10/1999 | Nakazawa | 399/55 |
| 5,981,132 | A | 11/1999 | Kurose et al. | 430/111.4 |
| 6,026,266 | A * | 2/2000 | Sakai et al. | 399/281 |
| 6,077,638 | A | 6/2000 | Tanikawa et al. | 430/108.11 |
| 6,183,927 | B1 | 2/2001 | Magome et al. | 430/108.3 |

FOREIGN PATENT DOCUMENTS

| | | |
|---|---|---|
| EP | 0 780734 | 6/1997 |
| EP | 0 834775 | 4/1998 |
| JP | 58-116559 | 7/1983 |
| JP | 60-120368 | 6/1985 |
| JP | 63-271371 | 11/1988 |
| JP | 9-114126 | 5/1997 |
| JP | 10-48872 | 2/1998 |
| JP | 11-143188 | 5/1999 |

OTHER PUBLICATIONS

Diamond, A.S., ed., *Handbook of Imaging Materials*, Marcel Dekker, Inc., NY (1991), pp. 379-380.*
Database WPI, Section Ch, Week 199324, Derwent Publ., AN 1993-192360, XP002149119, for JP05-119518.
Diamond, A.S. ed; Handbook of Imaging Materials, Marcel Dekker, NY, (1991), pp. 168-169.

* cited by examiner

*Primary Examiner*—Janis L. Dote
(74) *Attorney, Agent, or Firm*—Fitzpatrick, Cella, Harper & Scinto

(57) ABSTRACT

An electrophotographic toner is formed as a blend of toner particles and external additives. The external additives include (1) first inorganic fine particles having an average primary particle size of 80-800 nm of oxide of a metal selected from the group consisting of titanium, aluminum, zinc and zirconium, (2) second inorganic fine particles other than silica having an average primary particle size of below 80 nm and (3) silica fine particles having an average primary particle size of below 30 nm. As a result, the toner can be made free from difficulties, such as melt-sticking onto an image-bearing member in a low humidity environment, roughening of halftone images in a low humidity environment, toner blot-down after storage at high temperatures or in continuous image formation on a large number of sheets, fog in continuous formations of images of low color area percentage in a low humidity environment, and re-transfer in multi-color image formation. Thus, the toner is suitably used in a multi-color image forming system.

35 Claims, 8 Drawing Sheets

TONER, PROCESS FOR PRODUCING A TONER, IMAGE FORMING METHOD AND IMAGE FORMING APPARATUS

CROSS-REFERENCE TO RELATED APPLICATIONS

This is a division of application Ser. No. 10/742,990, filed Dec. 23, 2003, which, in turn, is a division of application Ser. No. 10/279,126, filed Oct. 24, 2002, now U.S. patent application Ser. No. 6,706,458 B1, which in turn, is a division of application Ser. No. 09/631,119, filed Aug. 2, 2000, now U.S. Pat. No. 6,555,281 B1.

FIELD OF THE INVENTION AND RELATED ART

The present invention relates to a toner for use in a recording method utilizing electro-photography, electrostatic recording, magnetic recording, etc. More specifically, the present invention relates to a toner for use in an image forming apparatus, such as a copying machine, a printer or a facsimile apparatus wherein a toner image once formed on an electrostatic latent image-bearing member is transferred onto a transfer(-receiving) material for image formation.

Hitherto, various electrophotographic processes have been known, e.g., as disclosed in U.S. Pat. Nos. 2,297,691; 3,666,363; and 4,071,361. Generally, an electrical latent image is formed on a photosensitive member using a photoconductor material, and the latent image is developed with a toner to form a toner image, which is then transferred as desired onto a transfer(-receiving) material, such as paper, and fixed, e.g., by heating, pressing, heating and pressing, or with solvent vapor, to obtain a final image. Residual toner remaining on the photosensitive member without being transferred is cleaned by various methods, and the above-mentioned steps are repeated for a subsequent image forming cycle.

In recent years, such an image forming apparatus is frequently used not only as an office copying machine for simply reproducing ordinary originals but also as a printer as an output means for computers and also as a personal copier.

Accordingly, an image forming apparatus is required to further pursue a smaller size, a lighter weight, a higher speed and a lower power consumption, and correspondingly, the apparatus is becoming to be composed of simpler elements in various respects.

On the other hand, as methods for developing electrostatic latent images, there have been generally known the two-component developing method of using a developer comprising a toner and a carrier in mixture, and the magnetic mono-component developing method using only a magnetic toner.

The two-component developing method is rather contradictory to the requirements of smaller size and lighter weight in view of the use of the carrier and the necessity of a so-called ATR (automatic toner replenishing) mechanism for adjusting a ratio between the toner and the carrier.

The magnetic mono-component method is accompanied with a difficulty in providing a color toner.

In contrast thereto, a non-magnetic mono-component developing method as disclosed in Japanese Laid-Open Patent Application (JP-A) 58-116559, JP-A60-120368 and JP-A 63-271371 is noted as a developing method for solving the above-mentioned problems. In the nonmagnetic mono-component developing method, a toner is applied onto a toner-carrying member by a layer thickness regulation means, such as a blade. The toner is triboelectrically charged through friction with the blade and the toner-carrying member surface, and the toner has to be applied as a thin coating layer since a larger coating thickness is liable to result in an insufficiently charged toner fraction, which causes fog or scattering. Accordingly, the blade has to be pressed against the toner-carrying member under a sufficient pressure, and the force applied to the toner at this time is larger than the one applied to the toner in the two component developing method or in the magnetic mono-component developing method. As a result, the toner is liable to be degraded, thus causing image defects such as fog and density lowering.

As a trouble accompanying the toner deterioration, toner blot-down is known, that is spotty image defects on images caused by toner agglomeration within a developing device during continuous image formation on a large number of sheets. As the image forming process speed becomes higher, the toner deterioration is liable to be promoted so that the above trouble becomes more noticeable.

As for image forming apparatus according to electrophotography, substantial development is being achieved so as to be adapted for higher functionality or multi-functional use or color image formation. On the other hand, the toner is becoming used in various severe environments in increasing cases, and accordingly, some problems are caused as follows in such severe environments.

One such problem is caused by wide spreading of electrophotographic image forming machines, inclusive of copying machines, printers and facsimile apparatus, over many countries in the world, and there have been increasing demands for achievement of high-quality images in the respective environments and similarly high-quality images on various grades of recording materials used in the respective companies.

Another problem is caused by toner melt-sticking onto the (latent) image-bearing member liable to be caused in a low temperature/low humidity environment, resulting in spotty image defects (lacks) on the images.

Another problem is roughening of halftone images in a low humidity environment, which is a phenomenon of resulting in images with a rough appearance causing an image quality lowering in a halftone image, such as a photographic image, that is liable to be caused by a lowering in developing performance of the toner.

Another problem is toner blot-down caused when the toner is exposed to high temperature. The toner blot-down is a spotty image defect on images caused by agglomerated toner liable to be caused at the time of early state of image forming after storage of the toner at a high temperature. As the popularization of color printers, the toner is becoming used and stored various environments, and a toner free from the above-mentioned problems is desired even in a severer high temperature environment than ever.

The above problems are liable to be more noticeable at a higher image forming process speed where it becomes difficult for the toner to be sufficiently charged.

In recent years, even higher image qualities than ever are demanded for images outputted from electrophotographic image forming apparatus, especially color copying machines and printers. Further, extensive popularization due to the development of network use and lower price machines thereof, the demands of such color copying machines and printers have been diversified from the professional use principally directed to a higher proportion of color images, such as (photo)graphic images to office use for which images with a lower proportion of color images are also frequently outputted. Examples of higher performances than ever required of such color copying machines and printers may include the following.

One is freeness from fog. A color image is generally formed by superposing plural colors of toner images, and if some color image is accompanied with fog, the fog is mixed with other color images to lower the resultant image quality. The difficulty of the fog is liable to be problematic especially in the office use where images of very low percentage of color image are frequently outputted in a low humidity environment.

On the other hand, in the case of formation of images with a high percentage of color image, the above-mentioned toner melt-sticking in a low temperature/low humidity environment is liable to be problematic.

Another problem is a re-transfer phenomenon. A color image is generally formed by superposition of plural colors of toner images sequentially transferred onto a transfer material, such as an intermediate transfer member and/or paper, the previous color image transferred onto such a transfer material can be transferred back to the image-bearing member at the time of transfer of a subsequent color toner image. This is the re-transfer problem. If the re-transfer problem occurs, the color of the previously transferred color is faded to result in a color change in the final image, thus causing an image quality deterioration. This problem is liable to be more noticeable at a higher image forming process speed.

Various proposals have been made so as to provide improvements to the above-mentioned problems. For example, JP-A 11-143188 has proposed a method of preventing retransfer and fog by adopting different developing conditions for plural times of color formation. JP-A 9-114126 has proposed to prevent the fog and retransfer by improvement of toner.

In spite of these proposals, however, it has been difficult to solve many of the above-mentioned problems and comply with all of high degree of requirements to high image quality in recent years.

As a further problem to be considered, there is image deterioration caused by soiling of a charging member for charging the latent image-bearing member. This is a problem of resulting in streak image irregularities in halftone images caused by obstruction of uniform charging of the latent image-bearing member due to attachment of toner particles and/or high-resistivity silica fine particles externally added to the toner.

JP-A 10-48872 has proposed a toner containing externally added inorganic fine particles having a specific average particle size and a DSC (differential scanning calorimetry) heat-absorption peak in a specific temperature range. This is effective for preventing the re-transfer problem in a process including a single transfer step, but is not sufficient to solve the other problems including the re-transfer problem encountered in process including a plurality of transfer steps and to comply with high degree of requirements in recent years.

SUMMARY OF THE INVENTION

A generic object of the present invention is to provide a toner having solved the above-mentioned problems of the prior art.

A more specific object of the present invention is to provide a toner free from toner melt-sticking onto the latent image-bearing member in a low humidity environment.

Another object of the present invention is to provide a toner free from "roughening" of halftone images in a low humidity environment.

Another object of the present invention is to provide a toner free from toner blot-down even after storage in a high temperature environment or during continuous image formation on a large number of sheets.

Another object of the present invention is to provide a toner free from fog even in continuous formation of images with a low percentage of color image on a large number of sheets in a low humidity environment.

Another object of the present invention is to provide a toner free from toner melt-sticking onto the latent image-bearing member even in continuous formation of images with a high percentage of color image in a low humidity environment.

A further object of the present invention is to provide a toner free from re-transfer of toner images.

A further object of the present invention is to provide a toner free from image quality lowering depending on the quality and state of the recording material.

A still further object of the present invention is to provide a process for producing such a toner, and an image forming method and an image forming apparatus using such a toner as described above.

According to the present invention, there is provided a toner, comprising: toner particles, and external additives blended with the toner particles and including (1) first inorganic fine particles having an average primary particle size of 80–800 nm of oxide of a metal selected from the group consisting of titanium, aluminum, zinc and zirconium, (2) second inorganic fine particles other than silica having an average primary particle size of below 80 nm and (3) silica fine particles having an average primary particle size of below 30 nm.

According to another aspect of the present invention, there is provided a process for producing a toner, comprising:

a first blending step of blending and dispersing toner particles containing at least a binder resin and a colorant, and first inorganic fine particles to form a toner precursor, and a second blending step of blending and dispersing the toner precursor, and second inorganic fine particles and silica fine particles; wherein the first inorganic fine particles have an average primary particle size of 80–800 nm and comprise an oxide of a metal selected from the group consisting of titanium, aluminum, zinc and zirconium, the second inorganic fine particles are other than silica and have an average primary particle size of below 80 nm, and the silica fine particles have an average primary particle size of below 30 nm.

The present invention further provides an image forming method, comprising:

(I) a step of supplying a nonmagnetic toner as described above onto a toner-carrying member from a supply roller and pressing and triboelectrically charging the nonmagnetic toner on the toner-carrying member with a toner application blade to form a charged layer of the nonmagnetic toner on the toner-carrying member, (II) a step of developing an electrostatic latent image formed on a latent image-bearing member with the nonmagnetic toner on the toner-carrying member to form a developed toner image on the image-bearing member, (III) a step of transferring the toner image onto a transfer material, and (IV) a step of fixing the transferred toner image.

The present invention further provides an image forming apparatus, comprising:

(I) a plurality of image forming units each comprising:

a latent image-bearing member for bearing an electrostatic latent image thereon, a charging device for primarily charging the image-bearing member, an exposure means for exposing the primarily charged image-bearing member to form an electrostatic latent image thereon, and a developing device for developing the latent image with a nonmagnetic toner as described above of a color to form a toner image of one of plural colors, and (II) a transfer device for sequentially transferring the toner images of plural colors formed by the plurality of image forming units onto a transfer-receiving material to form superposed toner images of plural colors on the transfer-receiving material.

The present invention further provides an image forming apparatus, comprising:

(I) a latent image-bearing member for bearing an electrostatic latent image thereon, (II) a charging device for primarily charging the image-bearing member, (III) an exposure means for exposing the primarily charged image-bearing member to form an electrostatic latent image thereon, (IV) a plurality of developing devices for sequentially developing the latent image with plural colors of nonmagnetic toner as described above to successively form plural colors of toner images on the image-bearing member, (V) an intermediate transfer member for successively receiving the plural colors of toner images successively formed on and transferred from the image-bearing member to form thereon superposed toner images, and (VI) a transfer device for simultaneously transferring the superposed toner images from the intermediate transfer member onto a transfer-receiving material.

The present invention further provides an image forming apparatus, comprising:

(I) a latent image-bearing member for bearing an electrostatic latent image thereon, (II) a charging device for primarily charging the image-bearing member, (III) an exposure means for exposing the primarily charged image-bearing member to form an electrostatic latent image thereon, (IV) a plurality of developing devices for sequentially developing the latent image with plural colors of nonmagnetic toner as described above to successively form plural colors of toner images on the image-bearing member, and (V) a transfer device for successively transferring the plural colors of toner images onto a transfer-receiving material to form superposed toner images on the transfer-receiving material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
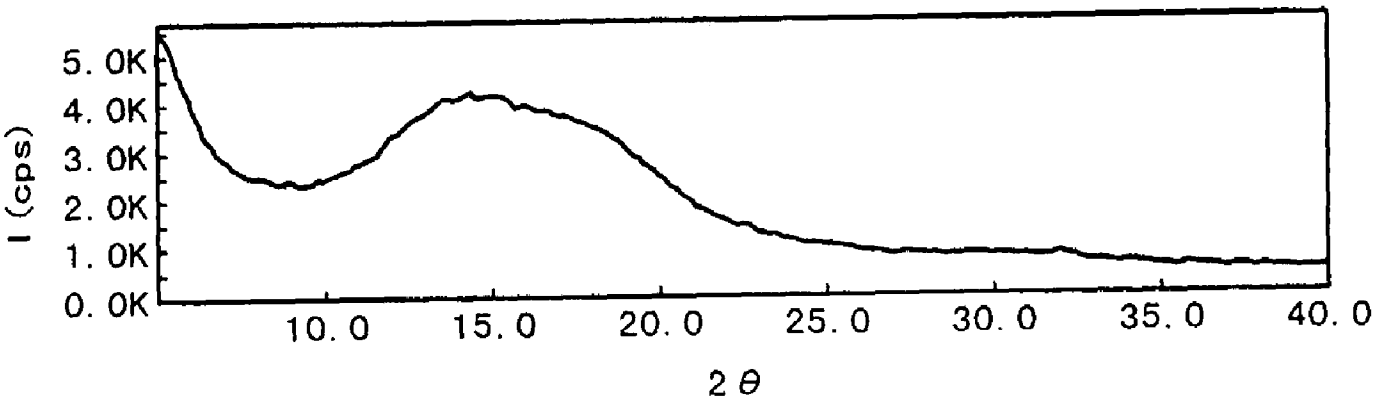
FIG. 1 is an X-ray diffraction chart of an amorphous aromatic compound metal complex.

The phenomenon of toner melt-sticking onto a latent image-bearing member in a low humidity environment is presumably attributable to strong electrostatic attachment of toner particles excessively charged in the low humidity environment onto the image-bearing member. In the toner according to the present invention, first inorganic fine particles comprising oxide of a metal selected from titanium, aluminum, zinc and zirconium and having an average primary particle size of 80–800 nm are blended with toner particles, so that the first inorganic fine particles may control the toner charge and prevent the excessive charge of the toner, thereby preventing the strong attachment of the toner particles onto the image-bearing member. Further, the toner charge control effect of the first inorganic fine particles may be promoted to a level not achieved heretofore by the co-presence of second inorganic fine particles other than silica having an average primary particle size of below 80 nm and silica fine particles having an average primary particle size of below 30 nm. Presumably because of the combination of the above effects the occurrence of excessively charged toner in a low humidity environment can be effectively prevented, thereby obviating the toner melt-sticking onto the image-bearing member in a low humidity-environment.

Further, the roughening of halftone images in a low humidity environment may presumably be attributable to occupation of a developing potential on the latent image-bearing member with a small amount of toner particles excessively charged in the low humidity environment, thus preventing the participation of toner particles having an appropriate level of charge. Accordingly, the roughening of halftone images in a low humidity environment can be alleviated by suppressing the occurrence of excessively charged toner for the same reason as the alleviation of the toner melt-sticking.

Fog is caused by attachment of insufficiently charged toner onto a non-image part on the latent image-bearing member, and such fog is assumed to be caused in a low humidity environment due to strong attachment of a portion of toner particles excessively charged toner particles onto a charge-imparting member, such as a developing sleeve, a developer carried or a toner-regulating member, to obstruct the newly supplied toner from being adequately charged. The toner of the present invention is believed to be also effective for alleviating fog by suppressing the occurrence of such a portion of excessively charged toner for the same reason as described above.

Fog occurring in a high humidity environment may be attributable to obstruction of toner charging due to moisture adsorbed onto the toner surface. The toner of the present invention is believed effective for alleviating the fog by promoting the charging of toner particles due to the co-presence of the first inorganic fine particles, the second inorganic fine particles and the silica toner particles having an average primary particle size of below 30 nm.

The re-transfer is assumed to be a phenomenon caused by a succession of phenomena that an insufficiently charged portion of toner of a color once transferred onto a transfer material is supplied with a transfer current through the transfer material at the time of transfer of a toner of a subsequent color to be charged to an opposite polarity and returned from the transfer material to the image-bearing member. In the toner of the present invention, the occurrence of such an insufficiently charged portion of toner is suppressed for the reason expressed above with reference to the fog, whereby the re-transfer is also effectively prevented.

The blot-down of toner after exposure to a high temperature is assumed to be a phenomenon that a flowability improving agent, such as silica fine particles, is embedded at the toner particle surface during storage in a high temperature environment to provide a toner particle surface state not readily chargeable, the toner is agglomerated as a result and a portion of the agglomerated toner is transferred for development onto the latent image-bearing member without being sufficiently disintegrated by a regulating member in the developing device. In the toner of the present invention, the toner charging is promoted for the same reason as explained with reference to the fog- and the toner agglomeration is well prevented, thereby also alleviating the toner blot-down.

Image defects due to soiling of the charging member is principally caused by attachment of silica fine particles onto the charging member, which is alleviated by selective attachment of the first inorganic fine particles comprising oxide of any one metal of titanium, aluminum, zinc and zirconium and having an average primary particle size of 80–800 nm and the second inorganic fine particles other than silica having an average primary particle size of below 80 nm in the toner of the present invention, whereby the image defects due to soiling of the charging member can be alleviated in the present invention.

The fog occurring in continuous formation of low image percentage images on a large number of sheets is assumed to be a phenomenon that a portion of insufficiently charged toner is attached onto a non-image part on the latent image-bearing member. Especially, in the case of continuous formation of low image percentage images on a large number of sheets, a large proportion of toner is repetitively circulated within the developing device without being consumed for development, the toner receives a very large mechanical stress. Accordingly, among fine particles added as external additive attached onto the toner particles, a relatively large particle size fraction is liable to be gradually liberated from the toner particles due to the mechanical impact. The thus-liberated particles have particle properties, such as chargeability, particle size, specific gravity and attacheability, different from the toner particles, so that they behave differently from the toner particles in various steps during image formation. As a result, in the course of continuous image formation on a large number of sheets, the proportion of the fine particles within the toner is gradually changed to result in a lower toner chargeability. Further, a relatively small particle size fraction of the fine particles is gradually embedded at the toner particle surface to gradually result in a lower flowability. The fog is presumably caused by such a gradual lowering in toner chargeability and flowability due to the liberation and embedding of the fine particles. The fog is liable to be severer in a low humidity environment wherein the toner is liable to be excessively charged. In the toner of the present invention, the toner charge control effect of the first inorganic fine particles is enhanced by the co-presence of the second inorganic fine particles and the silica fine particles, and by strong mixing of the first inorganic fine particles with the toner particles, the toner charge control effect is synergistically improved to a level not realized heretofore, so that the toner can be imparted with an adequate level of charge and the occurrence of excessively charged toner fraction can be suppressed even in an environment of being continuously supplied with a mechanical impact, thereby preventing the fog.

Based on the above knowledge, in the toner production process according to the present invention, the external additive fine particles are selectively and sequentially blended with the toner particles in the first and second mixing dispersion steps.

The respective features of the present invention will be described more specifically.

In the present invention, first inorganic fine particles having an average primary particle size (Dp.av.) of 80–800 nm and comprising oxide of a metal selected from titanium, aluminum, zinc and zirconium are blended with toner particles. If Dp.av. of the first inorganic fine particles is below 80 nm, it becomes difficult to attain the effect of toner charge control and the effect of preventing image defect due to soiling of the charging member. If Dp.av. of the first inorganic fine particles exceeds 800 nm, the latent image-bearing member surface is liable to be damaged with minute scars, thus being liable to promote toner melt-sticking and fail in achieving the charge control effect. The oxides of titanium, aluminum, zinc and zirconium are all in white and can be suitably included in a color toner. Moreover, these oxide particles exhibit a high toner charge control effect, are little liable to damage the image-bearing member surface and exhibit a high effect of preventing image defects due to soiling of the charging member. Fine particles of oxides other than titanium, aluminum, zinc and zirconium are inadequate for solving the problems of the present invention in view of color hue, charge control performance and liability of damaging the image-bearing member surface. In view of the charge control performance, little liability of damaging the image-bearing member surface and prevention of image defects due to soiling of the charging member, it is particularly preferred to use an oxide of titanium or aluminum.

It is preferred that the first inorganic fine particles have an average primary particle size of 100–500 nm so as to enhance the above-mentioned effects.

It is preferred that the first inorganic fine particles have a chargeability of at most 10 mC/kg in terms of an absolute value so as to exhibit a higher toner charge control performance. The first inorganic fine particles are particularly characterized by their toner charge control effect and effect of preventing image defects due to soiling of the charging member.

The first inorganic fine particles can be hydrophobized by treatment with an organic compound, such as a coupling agent or an oil, but may preferably be untreated hydrophilic inorganic fine particles so as to provide a lower absolute value of chargeability.

The first inorganic fine particles can be used in mixture of two or more species.

The first inorganic fine particles may preferably be added in a proportion of 0.05–5 wt. %, more preferably 0.06–3 wt. %, based on the toner particles. Below 0.05 wt. %, it becomes difficult to attain the addition effect thereof, and above 5 wt. %, the fixability of the resultant toner can be lowered.

In the present invention, second inorganic fine particles (other than silica) having an average primary particle size of below 80 nm are also blended with the toner particles. If the average primary particle size is, 80 nm or larger, the effect thereof of enhancing the addition effects of the first inorganic fine particles cannot be sufficiently attained, i.e., the toner charge control effect and the effect of preventing image defect due to soiling of the charging member.

The second inorganic fine particles may preferably have an average primary particle size of at most 70 nm, more preferably 25–70 nm, so as to enhance the above-mentioned effect.

Examples of the second inorganic fine particles may include fine particles of: oxides of, e.g., magnesium, zinc, aluminum, titanium, cobalt, zirconium, manganese, cerium and strontium; complex metal oxides, such as calcium titanate, magnesium titanate, strontium titanate, and barium titanate; carbides of, e.g., boron, silicon, titanium, vanadium, zirconium, molybdenum, and tungsten; and inorganic metal salts, such as carbonates, sulfates and phosphates of, e.g., magnesium, calcium, strontium and barium.

Among these, the second inorganic fine particles may preferably comprise an oxide of either titanium or aluminum, because of particularly higher effect thereof than the other species in enhancing the toner charge control effect and effect of preventing image defects due to soiling of the charging member of the first inorganic fine particles.

It is preferred that the second inorganic fine particles have been hydrophobized by surface treatment with an organic compound, such as a coupling agent or an oil.

It is also preferred to use hydrophobized second inorganic fine particles and unhydrophobized second inorganic fine particles in combination, so as to enhance the effect of suppressing the occurrence of excessively charged toner particles in a low humidity environment.

The second inorganic fine particles can be used in mixture of two or more species.

The second inorganic fine particles may preferably be added in a proportion of 0.01–1.0 wt. %, further preferably 0.02–0.7 wt. %, of the toner particles. Below 0.01 wt. %, it is difficult to attain the addition effect thereof, and above 1.0 wt. %, the fixability of the resultant toner is lowered.

In the present invention, silica fine particles having an average primary particle size of below 30 nm are further blended with the toner particles. If the average primary particle size is 30 nm or larger, it becomes difficult to attain the charge control effect of the first inorganic fine particles, thus failing to solve all of the problems to be solved by the present invention. It is assumed that a high negative chargeability of the silica fine particles enhances the charge control effect of the first inorganic fine particles.

The silica fine particles may preferably have an average primary particle size of at most 20 nm, more preferably 8–20 nm, so as to enhance the above-mentioned effect and attain a higher level of charge control effect of the first inorganic fine particles.

The silica fine particles may preferably be added in a proportion of 0.2–5.0 wt. %, more preferably 0.4–3.0 wt. %, of the toner particles. Below 0.2 wt. %, it becomes difficult to attain the addition effect thereof, and above 5.0 wt. %, the fixability of the resultant toner is lowered.

The silica fine particles used in the present invention may comprise either the dry-process silica or so-called fumed silica formed by vapor-phase oxidation of silicon halides, or the wet-process silica as produced from water glass. It is however preferred to use the dry-process silica with less surface or internal silanol groups and with less production residue such as $Na_2O$ or $SO_3^{2-}$. In the dry-process silica production process, it is also possible to use another metal halide together with a silicon-halide to obtain complex oxide particles of silicon and another metal, which can also be used as the silica fine particles in the present invention.

It is preferred that the silica fine particles have been surface-treated with a silane coupling agent and/or a silicone oil.

The silane coupling agent may include those represented by the following formula:

$$R_mSiY_n,$$

wherein R denotes an alkoxy group or a chlorine atom; m denotes an integer of 1–3; Y denotes an alkyl group, a vinyl group, or a hydrocarbon group including a glycidoxy group or a methacryl group; and n denotes an integer of 3–1. Representative examples thereof may include: dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinyldichlorosilane, and dimethylvinylchlorosilane.

The treatment of the silica fine particles with a silane coupling agent may be performed through a known process, such as a dry process wherein, silica fine particles in the form of cloud under stirring are reacted with a vaporized silane coupling agent, or a wet process wherein silica fine particles are dispersed in a solvent and a silane coupling agent is added dropwise thereto.

The silicone oil may include those represented by the following formula:

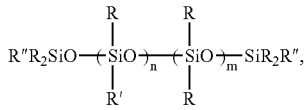

wherein R denotes a $C_1$–$C_3$ alkyl group; R', a modifier group selected from alkyl, halogen-modified alkyl, phenyl and modified phenyl; and R", a $C_1$–$C_3$ alkyl group or a $C_1$–$C_3$ alkoxy group.

Examples of the silicone oil may include: dimethylsilicone oil, alkyl-modified silicone oil, α-methylstyrene-modified silicone oil, chlorophenyl-silicone oil, and fluorine-modified silicone oil.

The silicone oil treatment may be performed according to a known manner, e.g., by directly blending silica fine particles with a silicone oil by using a blender, such as a HENSCHEL MIXER, by spraying a silicone oil onto base silica fine particles, or by dissolving or dispersing a silicone oil in an appropriate solvent and mixing base silica fine particles therewith, followed by removal of the solvent.

In the toner of the present invention, it is preferred that the first inorganic fine particles, the second inorganic fine particles and the silica fine particles are contained in weight ratios of 1:0.01–1:0.1–6, more preferably 1:0.02–0.9:0.2–5.6.

If the ratio of second inorganic fine particles/first inorganic fine particles is below 0.01 or the ratio of silica fine particles/first inorganic fine particles is below 0.1, it becomes difficult to attain the effects of the present invention. On the other hand, if the ratio of second inorganic fine particles/first inorganic fine particles exceeds 1 or the ratio of silica fine particles/first inorganic fine particles exceeds 6, it becomes difficult to sufficiently attain the charge control effect of the first inorganic fine particles, so that it becomes difficult to solve all of the problems to be solved by the present invention.

It is preferred the toner according to the present invention has a weight-average particle size (based on particles of at least 2 μm) of 4–8 μm and contains 3–20% by number of toner particles of 4 μm or smaller.

If the toner has a weight-average particle size (D4) of below 4 μm, the toner is liable to be excessively charged in a low humidity environment, thus leading to difficulties, such as toner melt-sticking onto the latent image-bearing member, roughening of halftone images and toner blot-down after storage at a high temperature. In case where the toner has a weight-average particle size exceeding 8 μm, image defects due to re-transfer, fog or soiling of the charging member, are liable to occur.

If the content of toner particles of 4 μm or smaller is below 3% by number, the reproducibility of minute dots is liable to be lowered in a high humidity environment. If the content of toner particles of 4 μm or smaller exceeds 20% by number, the toner is liable to be excessively charged in a low humidity environment, thus being liable to cause difficulties, such as toner melt-sticking onto the image-bearing member, roughening of halftone images, and image defects due to soiling of the charging member.

The first inorganic fine particles, the second inorganic fine particles and the silica fine particles may be blended with the toner particles under stirring in a blender, such as a HENSCHEL MIXER.

In a preferred process, i.e., in the toner production process according to the present invention, the first inorganic fine particles having an average primary particle size of 80–800 nm of oxide of a metal selected from titanium, aluminum, zinc and zirconium are mixed for dispersion with toner particles to obtain a toner precursor, and mixing the toner precursor for dispersion with the second inorganic fine particles (other than silica) having an average primary particle size of below 80 nm and the silica fine particles having an average primary particle size of below 30 nm. As a result, the resultant toner is provided with a high level of charge control effect that has not been achieved heretofore.

The toner according to the present invention may preferably exhibit at least one heat-absorption peak in a temperature range of 60–90° C. in the course of temperature increase according to differential scanning calorimetry (DSC). Such a toner having a heat-absorption peak in the range of 60–90° C. can more effectively exhibit the toner charge control effect attained by the characteristic external additive composition of the present invention, and can provide a better result also regarding the effect of preventing image defects due to soiling of the charging member.

If a heat-absorption peak is not in the range of 60–90° C. but below 60° C., the toner is liable to cause a difficulty, such as blocking. If a heat-absorption peak is not in the range of 60–90° C. but at a temperature exceeding 90° C., any further improvement in toner charge control effect cannot be expected. If a heat-absorption peak is present in the range of 60–90° C., an additional heat-absorption peak can be present in a temperature region exceeding 90° C. without a substantial problem.

In the present invention, the DSC heat-absorption peak (Tp) in the temperature range of 60–90° C. may preferably exhibit a half-value width ($W_{1/2}$) of at most 10° C., more preferably at most 6° C. If the half-value width exceeds 10° C., any further improvement in effect of preventing the toner melt-sticking onto the image-bearing member, fog, toner blot-down after storage at a high temperature and image defects due to soiling of the charging member, cannot be expected.

In order to provide a DSC heat-absorption peak in the range of 60–90° C., it is preferred to internally add a substance exhibiting a DSC heat-absorption peak at a temperature of 60–90° C. in the toner.

As such a substance exhibiting a DSC heat-absorption peak at 60–90° C., a wax may preferably be used.

Examples of the wax may include: petroleum waxes, such as paraffin wax, microcrystalline wax and petroleum, and derivatives thereof, montan wax and derivatives thereof, hydrocarbon wax obtained through the Fischer-Tropsche process and derivatives thereof; polyolefin waxes as represented by polyethylene wax and derivatives thereof; natural waxes, such as carnauba wax and candellila wax and derivatives thereof; alcohol waxes, such as higher fatty alcohols; fatty acids, such as stearic acid and palmitic acid, and derivatives thereof; acid amides and derivatives thereof; esters and derivatives thereof; ketones and derivatives thereof; vegetable waxes and animal waxes and derivatives thereof. The derivatives herium may include: oxides, block copolymers and graft-modified products. As mentioned above, the wax may preferably have a DSC heat-absorption peak in the range of 60–90° C.

The wax may preferably be contained in a proportion of 0.3–30 wt. %, more preferably 0.5–20 wt. %, in the toner particles.

The toner particles may principally comprise a binder resin, examples of which may include: homopolymers of styrene and its substitution derivatives such as polystyrene, poly-p-chlorostyrene and polyvinyltoluene; styrene-based copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, phenolic resin, natural resin-modified maleic resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin, and petroleum resin.

Among the above-mentioned binder resin, it is particularly preferred to use a styrene polymer (i.e., styrene homopolymer or copolymer) in the present invention. A styrene polymer has a low-polarity main chain, so that the toner charge control effect of the characteristic external additive composition of the present invention can be more effectively exhibited in combination therewith, and a higher effect of preventing image defects due to soiling of the charging member can be exhibited thereby.

It is also preferred to use a copolymer of styrene with another comonomer, examples of which may include: monocarboxylic acids having a double bond and substitution derivatives thereof, such as acrylic acid, methyl acrylate, ethyl acrylate, butyl acrylate, dodecyl acrylate, octyl acylate, 2-ethylhexylacrylate, phenyl acrylate, methacrylic acid, methyl methacrylate, ethyl methacrylate, butyl methacrylate, octyl methacrylate, acrylonitrile, methacrylonitrile; acrylic acids and α- or β-alkyl derivatives, such as acrylic acid, methacrylic acid, α-ethylcrylic acid and crotonic acid; unsaturated dicarboxylic acids, such as fumaric acid, maleic acid and citraconic acid, and monoester derivatives and anhydrides of these dicarboxylic acids. These comonomers may be used singly or in combination of two or more species together with a styrene monomer and another optional comonomer, as desired, to provide a desired styrene copolymer.

It is also possible to provide a crosslinked binder resin by using a crosslinking agent, which may principally be a compound having two or more polymerizable double bonds, and examples of which may include: aromatic divinyl compounds, such as divinylbenzene and divinylnaphthalene; carboxylic acid esters having two double bonds, such as ethylene glycol diacrylate, ethylene glycol dimethacrylate, and 1,3-butanediol dimethacrylate; divinyl compounds, such as divinylaniline, divinyl ether, divinyl sulfide, and divinyl sulfone; and compounds having three or more vinyl groups. These compounds may be used singly or in mixture of two or more species.

The toner according to the present invention may preferably contain a THF (tetrahydrofuran)-soluble content exhibiting a peak molecular weight (Mp) in a range of $1.5\times10^4$ to $3.0\times10^4$. If this condition is satisfied, the toner charge control effect given by the external additive composition of the present invention can be more effectively exhibited, thus providing further preferred results. If the peak molecular weight is below $1.5\times10^4$, it becomes difficult to attain further improvements in the toner charge control effect and the effect of preventing the image defects due to soling of the charging member. If the peak molecular weight exceeds $3\times10^4$, the fixability of the toner is liable to be impaired.

The toner according to the present invention may preferably have an acid value of at most 10 mgKOH/g, more preferably 1–9 mgKOH/g.

If the acid value is within the range of at most 10 mgKOH/g, it is possible to suppress the occurrence of excessively charged toner in a low humidity environment, and the toner charge control effect given by the external additive composition of the present invention can be better exhibited. Further, the effect of preventing the image defects due to soiling of the charging member can be exhibited at a high level.

In the present invention, the toner may preferably exhibit a chargeability of 40–80 mC/kg, more preferably 42–75 mC/kg, in terms of an absolute value. If the chargeability is below 40 mC/kg, difficulties, such as re-transfer, fog and image defects due to soiling of the charging member, are liable to be caused. If the chargeability exceeds 80 mC/kg, difficulties, such as toner melt-sticking onto the image-bearing member, roughening of halftone images and toner blot-down after storage at a high temperature, are liable to be caused.

The effects of the present invention are particularly pronounced in the case where the toner of the present invention is formed as a nonmagnetic toner.

A nonmagnetic toner is liable to cause an excessively charged toner fraction in a low humidity environment compared with a magnetic toner containing magnetic powder having a relatively low electrical resistivity. For this reason, the effects of the external additive composition of the present invention are more remarkably attained in the case of a nonmagnetic toner than in the case of a magnetic toner. Because of a higher resistivity, a nonmagnetic toner is also liable to cause image defects due to soiling of the charging member. Also for this reason, the effect of the present invention is more noticeably attained in the case of a nonmagnetic toner than in the case of a magnetic toner. A nonmagnetic toner is preferred in adaptability to a color toner.

The toner according to the present invention may preferably have a shape factor SF-1 in the range of 100–0170, more preferably 100–120, and a shape factor SF-2 to 100–140, more preferably 100–115, based on toner particles of 2 μm or larger. The satisfaction of the above shape factor conditions means that the toner particles have a relatively smooth surface state, whereby the toner charge control effect given by the external additive composition of the present invention can be more directly imparted and also a high level of effect of suppressing the image defects due to soiling of the charging member can be attained.

In case of SF-1 exceeding 170 or SF-2 exceeding 140, it becomes difficult to obtain further improvements in toner charge controllability and effect of preventing image defects due to soiling of the charging member.

In the present invention, it is particularly preferred that a low-crystallinity or amorphous aromatic compound metal complex compound, metal salt or mixture thereof is co-present for mixing dispersion in the step of mixing the first inorganic fine particles with the toner particles (which may be referred to as a step A), so as to provide a better toner charge control effect.

Such a low-crystallinity metal complex compound, a metal salt or a mixture thereof of aromatic compound (which may be inclusively referred to as an aromatic metal compound) may preferably be added in a proportion of 0.005–1.0 wt. part per 100 wt. parts of the toner particles. Below 0.005 wt. part, the effect thereof is scarce, and even above 1.0 wt. part, a further improvement cannot be expected.

The metal complex compound may include a metal complex and a metal complex salt.

As the metal complex compound or metal salt of aromatic compound, all of known ones may be used. Examples thereof may include: metal compounds of aromatic hydrocarboxylic acids and aromatic mono- and poly-carboxylic acids, and mono-azo metal compounds.

In the step A of the present invention, it is further preferred that a metal complex compound, a metal salt or a mixture of these of an oxycarboxylic acid compound is co-present for mixing dispersion together with the toner particles and the first inorganic fine particles for providing further improved toner chargeability. It is particularly Preferred that the central atom is aluminum or zirconium.

Figure 2:
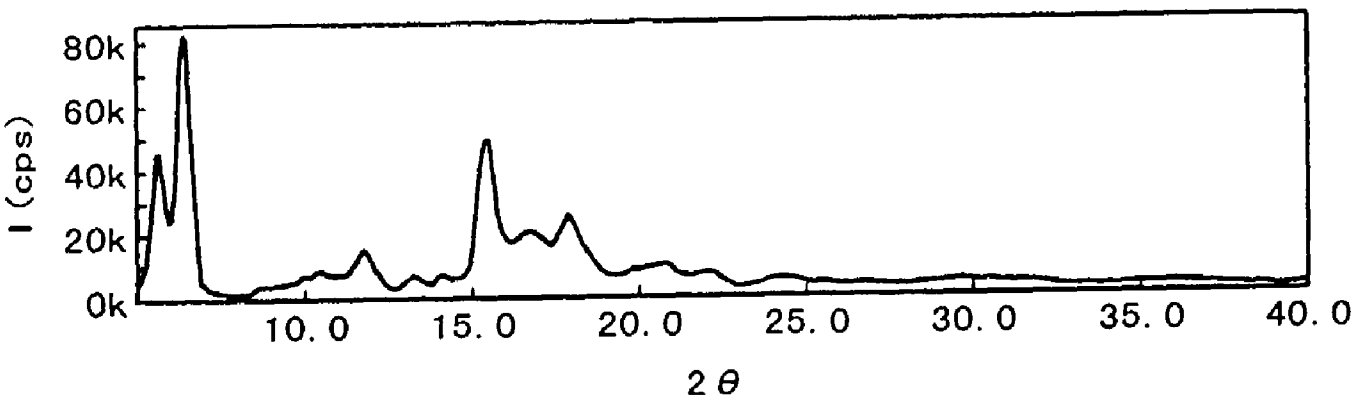
FIG. 2 is an X-ray diffraction chart of a crystalline aromatic compound metal complex.

The low-crystallinity (in a sense of also covering amorphousness as mentioned above) of such an aromatic metal compound is confirmed by an X-ray diffraction pattern of the aromatic metal compound as shown, e.g., in FIG. 1, free from peaks exhibiting a measurement intensity of at least 10,000 cps (counts per second) and a half-value half-width of at most 0.3 deg., which is clearly distinguishable from a diffraction pattern as shown in FIG. 2 of a crystalline aromatic metal compound as represented by a maximum peak at a 2θ-angle of ca. 6.6 deg. showing a measurement intensity of 80,000 cps and a half-value half-width of 0.21 deg. In an ordinary X-ray diffraction analysis, a crystalline substance exhibits an inherent diffraction peak corresponding to its crystal plane spacing based on the Bragg's diffraction condition, and the diffraction intensity depends on the crystal state and crystallinity. Based on this, a substance exhibiting an X-ray diffraction pattern free from peaks exhibiting a measurement intensity of at least 10,000 cps and a half-value half-width of at least 0.3 deg. is regarded as a low-crystallinity or amorphous substance. The low-crystallinity examination is performed in a measurement angle 2θ range of 6 deg. to 40 deg., because the measurement result in the 2θ range of below 6 deg. is remarkably affected by the direct beam and the 2θ-range exceeding 40 deg. provides only a small measurement intensity. Herein, the term "half-value half-width" (also known as "half-width at half-maximum") refers to a half of the width of a peak at a half value of the peaktop measurement intensity (cps) of the peak.

The X-ray diffraction data described herein for determining the low-crystallinity of an aromatic metal compound are based on data obtained by using an X-ray diffraction apparatus ("MXP18", available from K.K. Mac Science) with CuKα rays under the following conditions:

X-ray tube ball: Cu
Tube voltage: 50 kilo-volts
Tube current: 300 mA
Scanning mode: 2θ/θ-scan
Scanning speed: 2 deg./min.
Sampling interval: 0.02 deg.
Divergence slit: 0.50 deg.
Scattering slit: 0.50 deg.
Receiving slit: 0.3 mm For the measurement, a sample aromatic metal compound in powder form is placed without surface unevenness on a glass plate at a rate of ca. 12 mg/cm$^2$.

The toner particles for constituting the toner according to the present invention may contain an internally added charge control agent, as desired.

Examples of negative charge control agents for controlling the toner to a negative chargeability may include: organometallic compounds, such as organometallic complexes and chelate compounds, examples of which may include: monoazo metal complexes, acetylacetone metal complexes, aromatic hydroxycarboxylic acid metal complexes and aromatic dicarboxylic acid metal complexes. In addition, it is also possible to use an aromatic hydroxycarboxylic acid, an aromatic mono- or poly-carboxylic acid, or a metal salt, anhydride, ester of these, or a phenol derivative, such as a bisphenol compound.

Examples of positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungstic-molybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate. These may be used singly or in mixture of two or more species.

The charge control agent may preferably be used in a fine particulate form, having a number-average particle size of at most 4 μm, particularly at most 3 μm. In the case of the internal addition to the toner particles, the charge control agent may preferably be used in an amount of 0.1–20 wt. parts, particularly 0.2–10 wt. parts, per 100 wt. parts of the binder resin.

In the case of directly producing the toner particles through polymerization in an aqueous dispersion medium, it is particularly preferred to use a charge control agent which is free from polymerization inhibiting function and free from dissolution into the aqueous system. More specifically, examples of such negative charge control agents may include: salicylic acid metal compounds, naphthoric acid metal compounds, dicarboxylic acid metal compounds, polymeric compounds having a sulfonic acid group or a carboxylic acid group in their side chains, boron compounds, urea compounds, silicon compounds and calix arenes. Examples of such positive charge control agents may include: quaternary ammonium compounds, polymeric compounds having such quaternary ammonium compounds in their side chains, guanidine compounds, and imidazole compounds. The charge control agent may preferably be added in 0.5–10 wt. parts per 100 wt. parts of the resin.

As for the colorants used in the toner according to the present invention, it is possible to use a black colorant, such as carbon black or magnetite, and also a non-magnetic black mixture of yellow, magenta and cyan colorants as described below.

Examples of the yellow colorant may include: condensed azo compounds, isoindolinone compounds, anthraquinone compounds, azo metal complexes, methine compounds and acrylamide compounds as representatives. Preferable specific examples thereof may include: C.I. Pigment Yellow 12, 13, 14, 15, 17, 62, 74, 83, 93, 94, 95, 109, 110, 111, 128, 129, 147, 168, and 180.

Examples of the magenta colorant may include: condensed azo compounds, diketopyrolopyrrole compounds, anthraquinone compounds, quinacridone compounds, basic dye lake compounds, naphthol compounds, benzimidazolone compounds, thioindigo compounds and perylene compounds. Preferred specific examples thereof may include: C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254.

Examples of the cyan colorant may include: copper phthalocyanine compounds and derivatives thereof, anthraquinone compounds. Preferred specific examples thereof may include: C.I. Pigment Blue 1, 7, 15, 15:1, 15:2, 15:3, 15:4, 60, 62 and 66.

These colorants may be used singly, in the mixture or in a state of solid solution. The colorant can be a dye and/or pigment. The colorant may be selected in view of the hue angle, saturation, brightness, weatherability, transparency when used in an OHP sheet and dispersability in the toner. The colorant may be added in 1–20 wt. parts per 100 wt. parts of the binder resin.

In the case of using magnetite, unlike the other colorants, as a black colorant, it is adequate to add an amount of 40–150 wt. parts per 100 wt. parts of the binder resin.

The toner particles may for example be produced through a process including a blend step of blending toner ingredients by means of a blender, such as a HENSCHEL MIXER, a ball mill or a V-shaped mixer; a kneading step of kneading the blend of toner ingredients by hot kneading means, such as a hot roller kneader or an extruder; a pulverization step of pulverizing the kneaded product after cooling for solidification by a pulverizer, such as a jet mill, and a step of classifying the pulverizate.

As another and preferable process, the toner particles may be produced by subjecting a composition including a monomer, a colorant, a polymerization initiator, etc., to particle (droplet) formation and polymerization. The toner particles prepared through this process may be provided with a spherical and smooth surface state, to which the toner charge control effect of the external additive composition of the present invention can be more effectively applied, and which exhibits a higher effect of preventing the image defects due to soiling of the charging member.

The toner production process by direct polymerization will be described in further detail.

As the polymerizable monomer, it is possible to use one or more species of α,β-ethylenically unsaturated monomers giving the above-mentioned binder resins.

Examples of the polymerization initiator may include: azo- or disazo-type polymerization initiators, such as 2,2'-azobis(2,4-dimethylvaleronitrile), 2,2'-azobisisobutyronitrile, 1,1'-azobis-4-methoxy-2,4-dimethylvaleronitrile, and azobisisobutyronitrile; and peroxide-type polymerization initiators, such as benzoyl peroxide, methyl ethyl ketone peroxide, diisopropyl peroxycarbonate, cumene hydroperoxide, 2,4-dichlorobenzoyl peroxide, and lauroyl peroxide.

The addition amount of the polymerization initiator can vary depending on the objective polymerization degree but may generally be used at 0.5–20 wt. %. The polymerization initiators may be selected depending on the polymerization method and used singly or in mixture with reference to their 10-hour halflife temperature.

For controlling the polymerization degree, it is also possible to add a crosslinking agent, chain transfer agent, a polymerization inhibitor, etc., which per se have been known, as desired.

The crosslinking agent may principally be a compound having two or more polymerizable double bonds, and examples of which may include: aromatic divinyl compounds, such as divinylbenzene and divinylnaphthalene; carboxylic acid esters having two double bonds, such as ethylene glycol diacrylate, ethylene glycol dimethadrylate, and 1,3-butanediol dimethacrylate; divinyl compounds, such as divinylaniline, divinyl ether, divinyl sulfide, and divinyl sulfone; and compounds having three or more vinyl groups. These compounds may be used singly or in mixture of two or more species.

In production of toner particles by the polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–2.0 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The production of toner particles according to a direct polymerization process may be performed in the following manner. Into a polymerizable monomer, a release agent comprises a low-softening point substance, a colorant, a charge control agent, a polymerization initiator, and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In direct polymerization of toner particles, it is possible to use a polar resin, such as a polyester resin, in mixture with the polymerizable monomer.

Such a polar resin is effective for constituting a polar surface layer of toner particles, particularly when produced through the direct polymerization process, and may preferably be used in an amount of 1–25 wt. parts, more preferably 2–15 wt. parts, per 100 wt. parts of the polymerizable monomer. Below 1 wt. part, the state of presence of the polar resin in the toner particles becomes ununiform, and above 25 wt. parts, the surface layer of the polar resin becomes too thick, so than in either case, it becomes difficult to attain a uniform chargeability.

Polyester resins used as a representative polar resin may have a composition as described below.

Examples of the alcohol components constituting the polyester resins may include: ethylene glycol, propylene glycol, 1,3-butane diol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (a) and diols represented by the following formula (b):

(a)

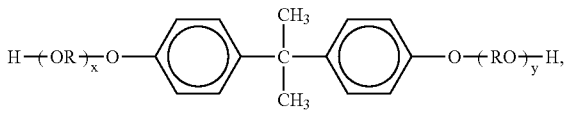

wherein R denotes ethylene or propylene group, x and y independently denote an integer of at least one providing an average of x+y in a range of 2–10, and (b)

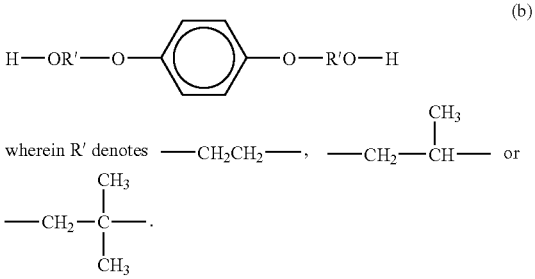

In addition to the polyester resin, it is also possible to include another resin in the polymerizable monomer composition, such as epoxy resin, polycarbonate resin, polyolefin, polyvinyl acetate, polyvinyl chloride, polyalkyl vinyl ether, polyalkyl vinyl ketone, polystyrene, poly(meth)-acrylate ester, melamine formaldehyde resin, polyethylene terephthalate, nylon, or polyurethane.

In the step A, the toner particles and the first inorganic fine particles may be blended under stirring with each other to form a toner precursor by using an apparatus such as a HENSCHEL MIXER or a Hybridizer.

In a subsequent step B, the toner precursor may be blended under stirring with the second inorganic fine particles and the silica fine particles by using a similar blending means.

Some toner properties described herein are based on values measured in the following manner.

<Molecular Weight Distribution>

A molecular weight distribution of a toner resin is measured according to GPC (gel permeation chromatography). More specifically, in advance of a GPC measurement, a sample toner is subjected to 20 hours of extraction with toluene by using a Soxhlet's extractor, and the extract liquid is subjected to distilling-off of the toluene by means of a rotary evaporator. Then, the remaining resin is sufficiently washed with a solvent (e.g., chloroform) not dissolving the resin but dissolving a low-softening point substance contained therein and then dissolved in THF (tetrahydrofuran) to form a solution, which is then filtrated through a solvent-resistant membrane filter having a pore diameter of 0.3 μm. A GPC sample solution thus obtained is subjected to a molecular weight distribution measurement by using a GPC apparatus ("Model 150C", mfd. by Waters Co.) equipped with 7 columns (A-801, 802, 803, 804, 805, 806 and 807, all available from Showa Denko K.K.) connected in series with reference to a calibration curve prepared based on standard polystyrene samples.

<Acid Value>

Measured as follows basically according to JIS-K0070.

(1) Reagent (a) Solvent: ethyl ether/ethyl alcohol mixture liquid (1/1 or 2/1), or benzene/ethyl alcohol mixture liquid (1/1 or 2/1). Such a mixture solvent is neutralized immediately before the use with a N/10-potassium hydroxide ethyl alcohol solution with phenolphthalein as indicator.

(b) Phenolphthalein solution: Formed by dissolving 1 g of phenolphthalein in 100 ml of ethyl alcohol (95 V/V %).

(c) N/10-potassium hydroxide-ethyl alcohol solution: Formed by dissolving 7.0 g of potassium hydroxide in a smallest possible amount of water and adding ethyl alcohol (95 V/V %) up to a total volume of 1 liter, followed by standing for 2–3 days and filtration. Standardized according to JIS-K8006 (Basic matters regarding titration among tests of reagent contents).

(2) Operation 1 to 20 g of a sample is accurately weighed, and 100 ml of a solvent and several drops of the phenolphthalein solution (as indicator) are added thereto, followed by sufficient shaking of the mixture until the sample is completely dissolved. In the case of a solid sample, the mixture is warmed on a water bath. After being cooled, the sample solution is titrated with the N/10-potassium hydroxide-ethyl alcohol solution until an end point of titration which is judged by continuation for 30 sec. of slight pink color of the indicator.

(3) Calculation

The acid value is calculated according to the following equation:

$$A=B\times f\times 5.611/S,$$

A: acid value (mgKOH/g),

B: amount (ml) of the N/10-potassium hydroxide-ethylalcohol solution used, f: factor of the N/10-potassium hydroxide-ethyl alcohol solution used, S: sample weight (g).

<Particle Size Distribution>

A weight-average particle size and a particle size distribution of a toner can be measured according to various method by using, e.g., COULTER COUNTER Model TA-II or COULTER MULTICIZER (respectively available from Coulter Electronics Inc.). The values described herein are based on values measured by a COULTER MULTICIZER (available from Coulter Electronics Inc.) connected with a personal computer ("PC9801", mfd. by NEC K.K.) for outputting data for 16 channels. As an electrolytic solution, a 1% NaCl aqueous solution may be prepared by using a reagent-grade sodium chloride. Alternatively, it is possible to use a commercially available electrolytic solution (e.g., "ISOTON R-II", available from Coulter Scientific Japan K.K.).

For measurement, into 100 to 150 ml of the electrolytic solution, 0.1 to 5 ml of a surfactant, preferably an alkylbenzenesulfonic acid salt, is added as a dispersant, and 2 to 20 mg of a sample is added thereto. (A toner including external additives, such as the first and second inorganic fine particles and the silica fine particles, in addition to toner particles, may conveniently be used as the sample without substantially adversely affecting the measurement of the toner particle sizes in view of a size difference.) The resultant dispersion of the sample in the electrolytic liquid is subjected to a dispersion treatment for about 1–3 minutes by means of an ultrasonic disperser, and then subjected to measurement of particle size distribution in the range of 2 μm or larger by using the above-mentioned apparatus with a 100 μm-aperture to obtain a volume-basis distribution and a number-basis distribution. The weight-basis average particle size D4 may be obtained from the volume-basis distribution while a central value in each channel is taken as a representative value for each channel.

<Chargeability (Triboelectric Charge) of Fine Particles>

Figure 3:
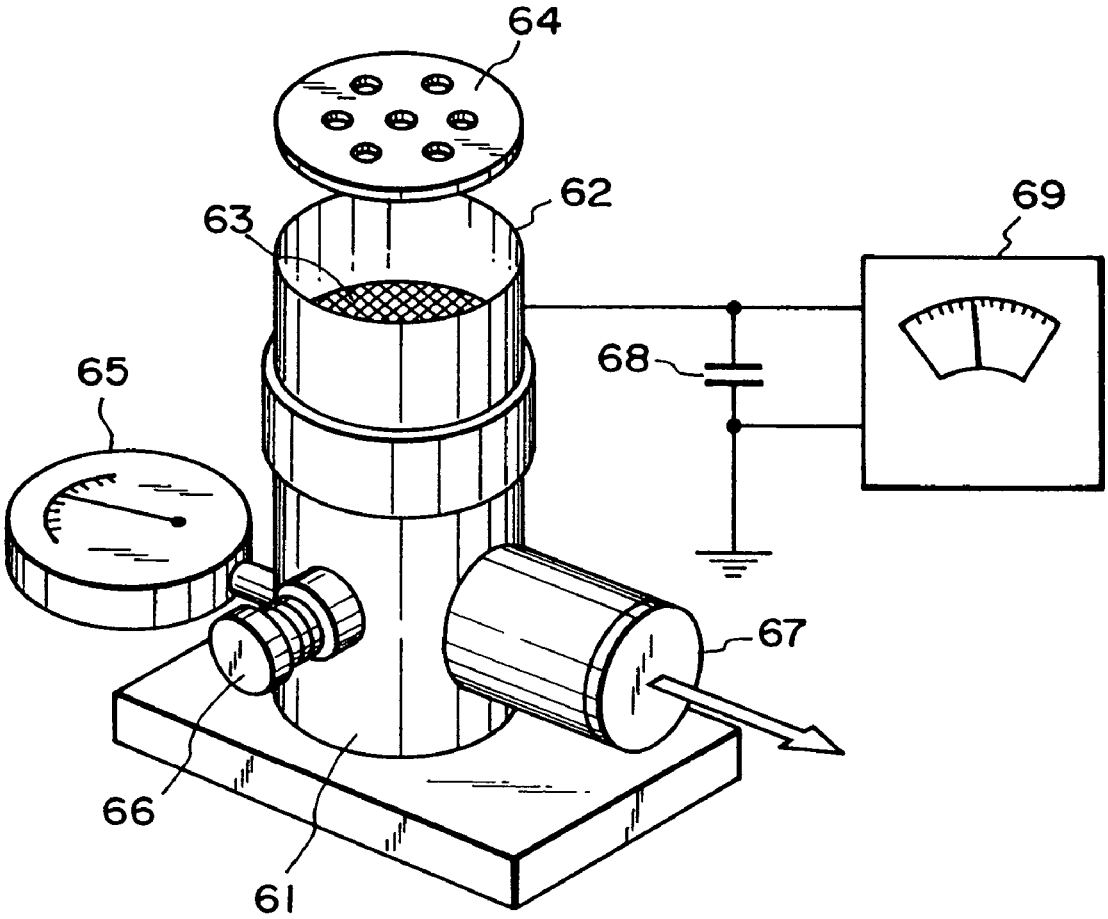
FIG. 3 is an illustration of an apparatus for measuring a chargeability of inorganic fine particles or a toner.

In an environment of temperature 23° C. and relative humidity 60%, 10 g of iron powder having particle sizes between 200 mesh and 300 mesh ("EFV200/300", available from POWDERTEC K.K.) is blended with 0.2 g of sample fine particles, and the resultant mixture is placed in a polyethylene bottle in a volume of 50 ml, followed by 90 times of shaking by hands. Then, ca. 1.0 g of the shaken mixture is charged in a metal container 62 for measurement provided with a 500-mesh screen 63 at its bottom as shown in FIG. 3 and covered with a metal lid 64. The total weight of the container 62 is weighed and denoted by $W_1$ (g). Then an aspirator 61 composed of an insulating material at least with respect to a part contacting the container 62 is operated, and the fine particles in the container is removed by suction through a suction port 67 for 1 min. while controlling the pressure at a pressure gauge 65 at 2450 Pa (250 mmAq) by adjusting an aspiration control valve 66. The reading at this time of a potentiometer 69 connected to the container via a capacitor 68 having a capacitance C (μF) is denoted by V (volts). The total weight of the container after the aspiration is measured and denoted by $W_2$ (g). Then, the triboelectric charge T (mC/kg) is calculated as: $T\ (mC/kg)=C\times V/(W_1-W_2)$.

<Chargeability of Toner>

The chargeability (triboelectric charge) of a toner is measured in the same manner as above except for changing the sample (toner) weight to 0.5 g.

<Shape Factors>

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 1000, and 100 images of toner particles having a particle size (diameter) of at least 2 μm are sampled at random. The image data are inputted into an image analyzer ("Luzex III", available from Nireco K.K.) to obtain averages of shape factors SF-1 and SF-2 based on the following equations:

$$SF\text{-}1=[(MXLNG)^2/AREA]\times(\pi/4)\times 100,$$

$$SF\text{-}2=[(PERI)^2/AREA]\times(1/4\pi)\times 100,$$

wherein MXLNG denotes the maximum length of a sample particle, PERI denotes the perimeter of a sample particle, and AREA denotes the projection area of the sample particle.

The shape factor SF-1 represents the roundness of toner particles, and the shape factor SF-2 represents the roughness of toner particles.

<DSC Heat-Absorption peaks>

DSC heat-absorption peaks are measured by using a high-accuracy internal heat input compensation-type differential scanning calorimeter (e.g., "DSC-7", available from Perkin Elmer Corp.) according to ASTM D3418-82.

Before a DSC curve is taken, a sample is once heated for removing its thermal history and then subjected to cooling and heating at a temperature changing rate of 10° C./min in a temperature range of 0–200 for taking DSC curves.

A heat-absorption peak temperature (Tmp) refers to a temperature of a peaktop in a positive direction, at which the differential of a DSC peak curve assumes 0 in the course of change from positive to negative, and a half-value width ($W_{1/2}$) refers to a width at a half maximum of a heat absorption peak.

<Average Primary Particle Size (Dp.av.) of First, Second and Silica Fine Particles>

An average primary particle size (Dp.av.) of first, second or silica fine particles referred to herein is determined based on photographs at a magnification of $1\times10^5$ of at least 500 particles selected at random for each sample taken through a scanning electron microscope FE-SEM ("S-4700", available from Hitachi K.K.). For each particle, the FERE diameter (i.e., a maximum length among lengths of parallel lines traversing the particle drawn on the photograph in one (e.g., horizontal) direction) measured by using a scale or a caliper, while further enlarging the photograph, as desired.

Based on the measured values, an average primary particle size (Dp.av.) is determined as a number-average value of the measured FERE diameters of the measured at least 500 particles for each sample.

If the first inorganic fine particles and the second inorganic fine particles are of the same composition, a number-basis distribution curve of primary particle sizes is prepared for both types of inorganic fine particles, and a minimum between two peaks on the distribution curve is taken for differentiation of the two types, whereby the number-average particle sizes are determined for the respective regions.

The composition of each fine particle can be determined by detecting a designated element (e.g., Ti, Al, Si, etc.) through an X-ray microanalyzer attached to the FE-SEM.

<Molecular Weight Distribution of a Wax>

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The image forming method according to the present invention includes the steps of:

(I) a step of supplying a nonmagnetic toner onto a toner-carrying member from a supply roller and pressing and triboelectrically charging the nonmagnetic toner on the toner-carrying member with a toner application blade to form a charged layer of the nonmagnetic toner on the toner-carrying member, (II) a step of developing an electrostatic latent image formed on a latent image-bearing member with the nonmagnetic toner on the toner-carrying member to form a developed toner image on the image-bearing member, (III) a step of transferring the toner image onto a transfer material, and (IV) a step of fixing the transferred toner image.

In the image forming method according to the present invention, the toner-carrying member may preferably be rotated at a circumferential speed of 100–800 mm/sec, more preferably 200–700 mm/sec, so as to provide a larger toner charge control effect.

If the rotation circumferential speed of the toner-carrying member is slower than 100 mm/sec, it becomes difficult to attain the toner charge control effect. On the other hand, above 800 mm/sec, too large a mechanical stress is liable to be applied to the toner so that it becomes difficult to attain the toner charge control effect in the case of continuous image formation on a large number of sheets.

An embodiment of the image forming method according to the present invention will now be described with reference to drawings.

Figure 4:
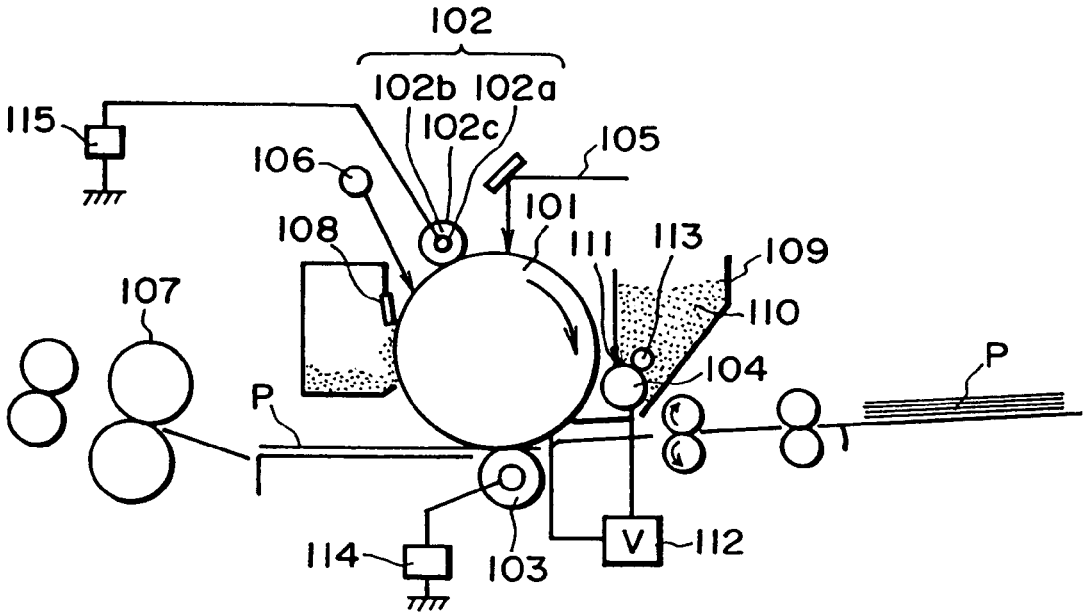
FIG. 4 illustrates an image forming method according to the invention.
Figure 5:
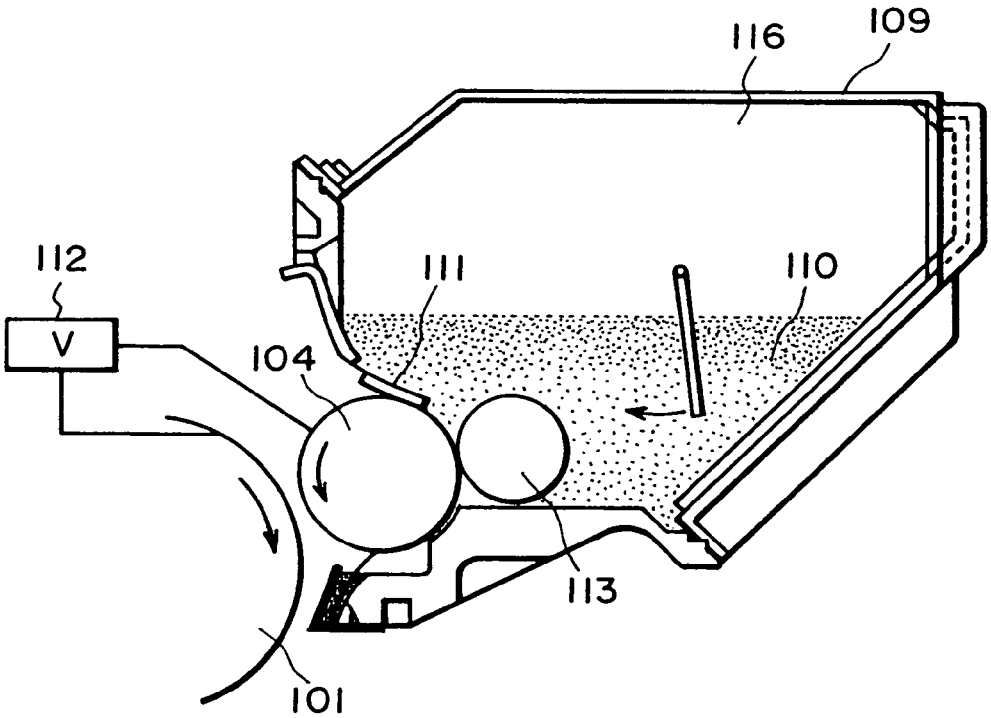
FIG. 5 is an enlarged illustration of a developing device in an image forming apparatus used in the method illustrated in FIG. 4.

FIG. 4 illustrates an outline of system for practicing the image forming method, and FIG. 5 illustrates an outline of developing means used therein.

Referring to these figures, the image forming system includes a latent image-bearing member 101, and a charging roller 102 as a charging means in contact with the image-bearing member at a prescribed pressure which comprises a core metal 102*a*, an electroconductive rubber roller 102*b* and a surface layer 102*c* as a release film covering the conductive rubber layer 102*b*. The conductive rubber layer 103 may preferably have a thickness of 0.5–10 mm, more preferably 1–5 mm. The surface layer 102*c* comprises a release film, by which a softening agent is prevented from bleeding out of the conductive rubber layer 102*b* onto a contacting portion of the image-bearing member (photosensitive member) 101 as a member to be charged. As a result, it becomes possible to obviate difficulties attributable to attachment of the softening agent onto the photosensitive member, such as image flow due to lowering in resistivity of the photosensitive member, filming of residual toner onto the photosensitive member and a lowering in charging efficiency.

The inclusion of a conductive rubber layer in the charging roller is effective for ensuring a sufficient contact between the charging roller 102 and the photosensitive member 101, thus obviating charging failure.

The release film 102*c* may preferably have a thickness of at most 30 μm, more preferably 10–30 μm. The lower limit in thickness of the release film is assumed to be around 5 μm so as to obviate the peeling and turnover of the film. The release film 102*c* may for example comprise polyamide (nylon) resin, PVDF (polyvinylidene fluoride) or PVDC (polyvinylidene chloride).

The latent image-bearing member (photosensitive member) 101 may have a photosensitive layer comprising OPC (organic photoconductor), amorphous silicon (a-Si), selenium or ZnO. Especially in the case of using amorphous silicon in the photosensitive member, serious image flow is liable to be caused when even a slight amount of softening agent from the conductive rubber roller 102*b* is attached onto the photosensitive layer, so that the effect of provision of an insulating release film becomes remarkable.

As a preferable form, it is possible to insert a high-resistivity layer, e.g., a layer of hydrin rubber little liable to be affected by an environmental change, between the conductive rubber layer 102*b* and the release film 102*c*, for the purpose of leakage prevention.

The system further includes a voltage supply 115 for supplying a prescribed voltage to the core metal 102*a* of the charging roller 102.

A transfer charger 103 is further provided as a transfer means and is supplied with a prescribed bias voltage from a constant voltage supply 114. The bias voltage may preferably have a voltage (absolute value) of 500–4000 volts at a current of 0.1–50 μA.

The surface of the image-bearing member (e.g., OPC photosensitive member) 101 is charged by the charging roller 102 (as a charging means) connected to the voltage supply (voltage application means) 115 and then exposed to image light 105 as a latent image-forming means to form an electrostatic latent image thereon. The electrostatic latent image is developed by means of a developing device 109 including a toner-carrying member 104 which comprises a nonmagnetic sleeve of aluminum, stainless steel, etc. The toner-carrying member can be formed of a crude tube of such a metal as it is but may preferably be surface-treated, e.g., by blasting with glass beads for providing a uniformly roughened surface, mirror-finishing or resin coating. A toner 110 is stored in a hopper 116 of the developing device 109 and is supplied onto the toner-carrying member 104 by means of a supply roller 113. The supply roller 113 may comprise polyurethane rubber and may be pressed against and rotated at a non-zero relative speed in a forward or a reverse direction with respect to the toner-carrying member 104, thereby supplying the toner and peeling off the toner (non-used for development) from the toner-carrying member 104. The toner 110 thus-supplied onto the toner-carrying member 104 is applied uniformly and in a thin layer by means of a toner application blade 111 to be triboelectrically charged to have a prescribed charge. The thus-formed thin charged toner layer is brought to a close proximity (50–500 μm) to the image-bearing member 101, thereby developing the latent image thereon.

The toner application blade 111 is affixed to the toner vessel at its upper root portion and a lower free length portion thereof is extended in a counter direction with respect to the rotation direction of the toner-carrying member 104 and abutted with its outer surface at an appropriate resilient pressure against the toner-carrying member.

The toner application blade 111 may preferably comprise a material having an appropriate chargeability position in ia triboelectric chargeability series so as to charge the toner to an appropriate polarity and may for example comprise a positively chargeable material, such as urethane rubber, urethane resin, polyamide or nylon, for a negatively chargeable toner; or a negatively chargeable material, such as urethane rubber, urethane resin, silicone rubber, silicone resin, polyester resin, fluorine resin (such as polytetrafluoroethylene resin) or polyimide resin. The blade 111 can also comprise an electroconductive rubber or resin. Further, the portion thereof abutted against the toner-carrying member 104 may comprise a formed member of a resin or rubber containing therein metal oxides, such as silica, alumina, titania, tin oxide, zirconia, and zinc oxide; carbon black; or a charge control agent generally contained in a toner, for adjusting its toner charge controllability.

In the case of providing a durable blade 111, it is preferred to use a laminate of an elastic metal coated with a resin or rubber at a portion abutted against the toner-carrying member 104.

In the image forming method according to the present invention, a large toner charge control effect may be attained if the toner is applied onto the toner-carrying member by means of a toner application blade comprising a surface layer of polyamide-containing rubber which may preferably show a Shore D hardness of 25–65 deg. If the Shore D hardness of the rubber surface layer is below 25 deg. or above 65 deg., it becomes difficult to attain a sufficient toner charge, thus being liable to result in an increased proportion of insufficiently charged toner leading to fog.

At a developing zone for developing an electrostatic latent image on the image-bearing member 101, an appropriate bias voltage, such as an AC bias voltage on a pulsed bias voltage, may be applied between the toner-carrying member 104 and the image-bearing member from a bias voltage supply 112. The bias voltage may for example comprise a AC voltage Vpp of 1000 to 3000 volts at a frequency f of 1000 to 4500 Hz in superposition with a DC voltage of 200 to 500 volts in terms of an absolute value, so as to provide |Vback|=150 to 300 volts, wherein |Vback| is an absolute value of a difference between |Vd| (absolute value of primary charge potential of the photo-sensitive member) and $|V_{DC}|$ (absolute value of the DC bias voltage). At the developing zone formed at the closest point and the proximity between the toner-carrying member 104 and the image-bearing member 101, the toner 110 on the toner-carrying member 104 is transferred onto the image-bearing member 101 while reciprocating therebetween under the action of an electrostatic force exerted by an electrostatic latent image on the image-bearing member 101 surface, and the AC bias or pulse bias voltage applied therebetween, to form a toner image on the image-bearing member 101.

When the toner image on the image-bearing member 101 is moved to a transfer position where a transfer roller charger 103 is disposed opposite to the image-bearing member 101, a transfer paper P is synchronously moved to the transfer position, and the rear surface of the paper P is charged by the roller charger 103 which receives a transfer voltage from a voltage supply 114, whereby the toner image on the image-bearing member 101 is electrostatically transferred onto the transfer paper P. The transfer paper P carrying the thus-transferred toner image is then separated from the image-bearing member 101 and then moved to a fixing means, such as a heat-and-pressure roller fixing device 107, where the toner image is fixed onto the transfer paper P.

A residual portion of the toner remaining on the image-bearing member 101 after the transfer step is removed from the image bearing member 101 by means of a cleaning device 108 having a cleaning blade. The image-bearing member 101 after the cleaning step is charge-removed by exposure to erase-exposure light 106 and again subjected to a subsequent image forming cycle starting from the charging step by the charger 102.

Instead of the OPC layer as used in the above-described embodiment, the photosensitive layer of the latent image-bearing member 101 may also comprise an insulating layer for electrostatic recording or a layer of another photoconductive insulating material, such as amorphous-Se, CdS, $ZnO_2$ or a-Si, appropriately selected depending on the developing conditions.

Figure 6:
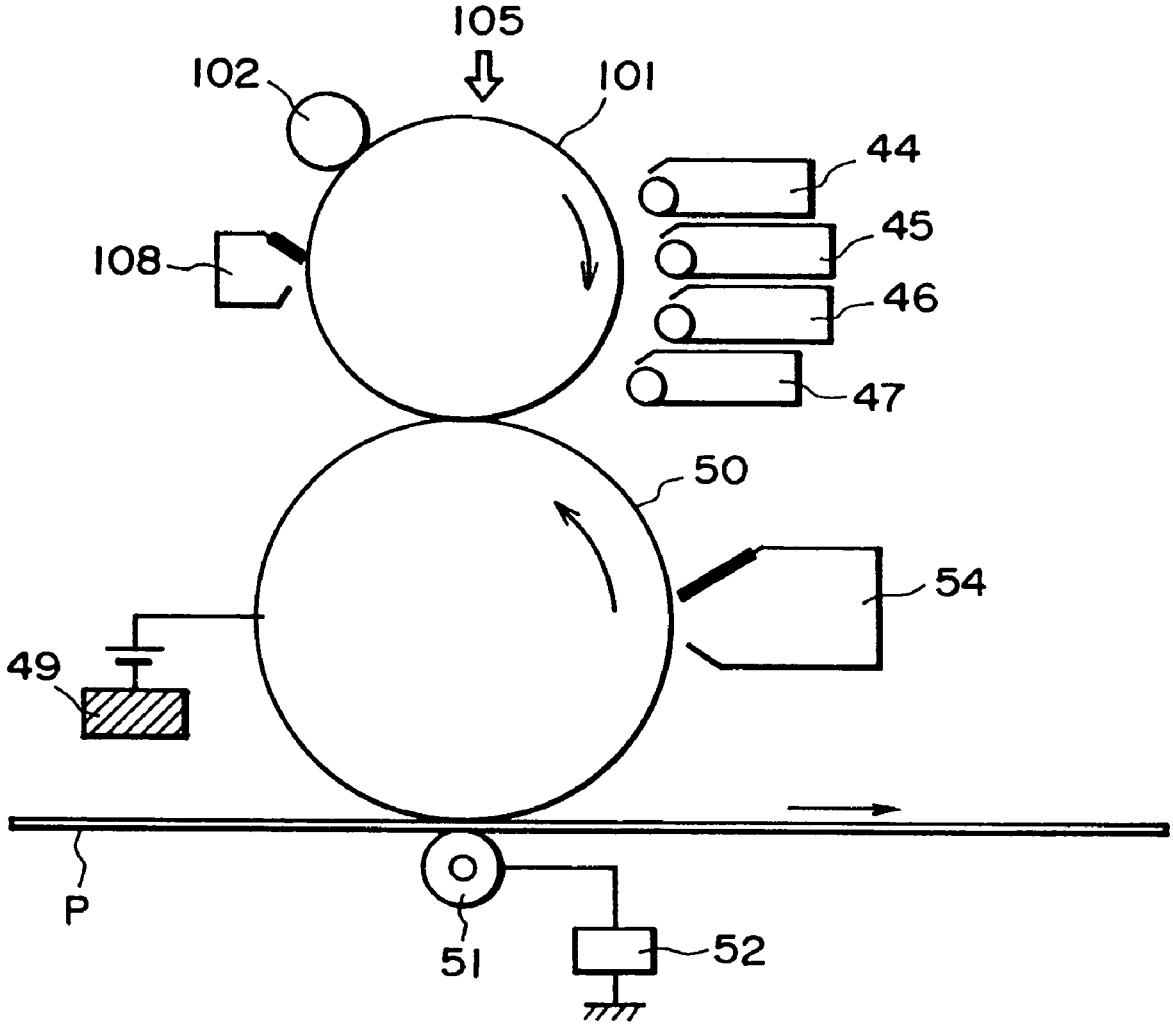
FIGS. 6 and 7 respectively illustrate a full-color image forming method.
Figure 7:
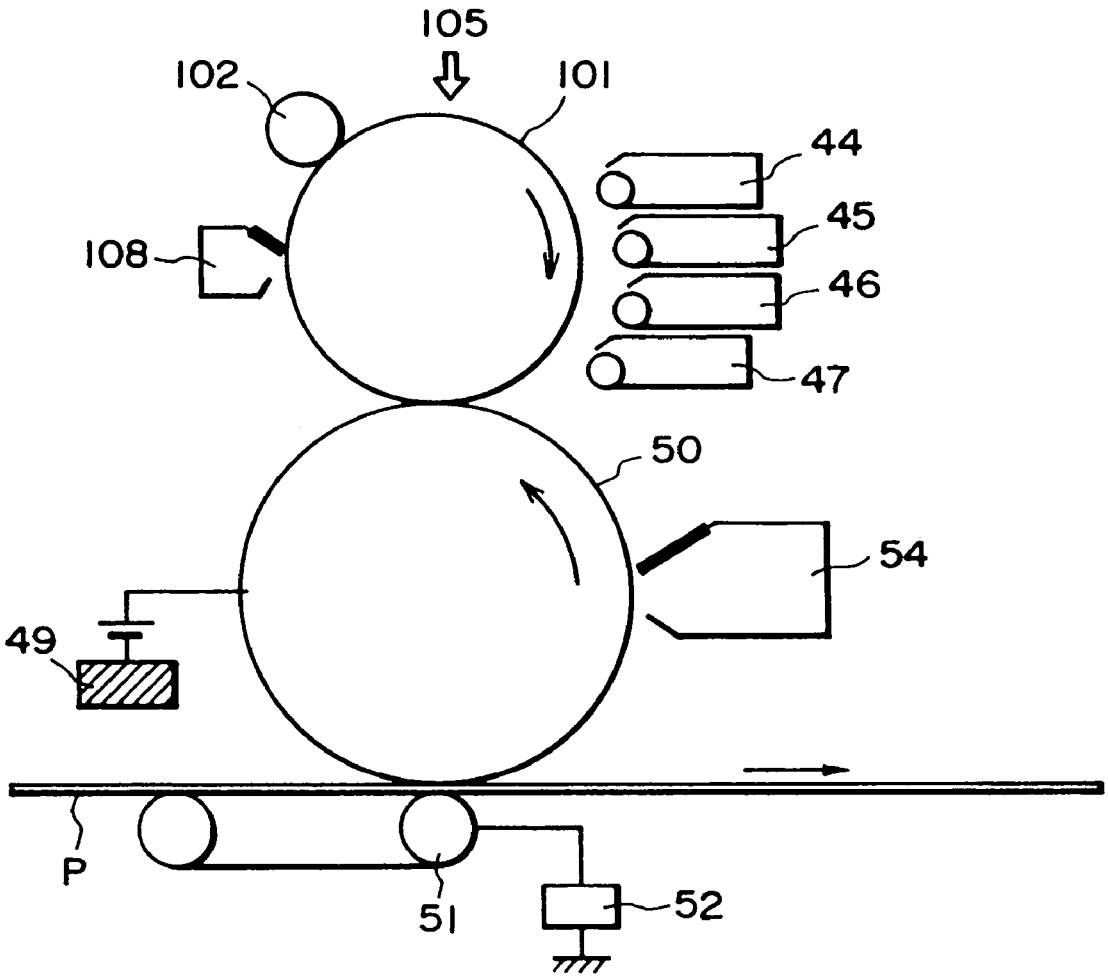

FIGS. 6 and 7 respectively illustrate a system of full-color image formation according to an embodiment of the image forming method of the present invention.

Referring to these figures, each system includes a latent image-bearing member 101, and a charging roller 102 disposed opposite to and rotated in contact with the image-bearing member 101 so as to primarily charge the image-bearing member to a prescribed surface potential, and the charged image-bearing member 101 is exposed to image light 105 to form an electrostatic latent image thereon. The electrostatic latent image is developed by any one of developing devices 44, 45, 46 and 47 to form a toner image of one color. By preparing the above steps, toner images of mono-colors (three colors or four colors) are successively formed on the image-bearing member 101 and then transferred in superposition onto an intermediate transfer member 50 to form a superposed toner image thereon. The transfer of respective mono-color toner images is performed by supplying a transfer current to the core metal of the intermediate transfer member 50 by applying a bias voltage thereto from a bias voltage application means 49. Instead thereof, it is also possible to utilize corona discharge or roller charging from a rear surface of a belt-form intermediate transfer member. The superposed toner images on the intermediate transfer member 50 are simultaneously transferred onto a transfer material P of which the rear surface is charged by a transfer member 51 receiving a bias voltage from a transfer bias voltage supply 52. 54 is a cleaning device to remove residual toner. The transfer charging member 51 may comprise a roller charger (as shown in FIG. 6), a belt charger (as shown in FIG. 7) or a corona charger (not shown).

According to a first embodiment, the image forming apparatus of the present invention comprises:

(I) a latent image-bearing member for bearing an electrostatic latent image thereon, (II) a charging device for primarily charging the image-bearing member, (III) an exposure means for exposing the primarily charged image-bearing member to form an electrostatic latent image thereon, (IV) a plurality of developing devices for sequentially developing the latent image with plural colors of nonmagnetic toner described above of the present invention to successively form plural colors of toner images on the image-bearing member, (V) an intermediate transfer member for successively receiving the plural colors of toner images successively formed on and transferred from the image-bearing member to form thereon superposed toner images, and (VI) a transfer device for simultaneously transferring the superposed toner images from the intermediate transfer member onto a transfer-receiving material.

The first embodiment apparatus (i.e., the image forming apparatus wherein superposed toner images formed on an intermediate transfer member are simultaneously transferred onto a transfer-receiving material) may assume an organization as illustrated in FIG. 6 or FIG. 7 as described above or as illustrated in FIG. 8.

Figure 8:
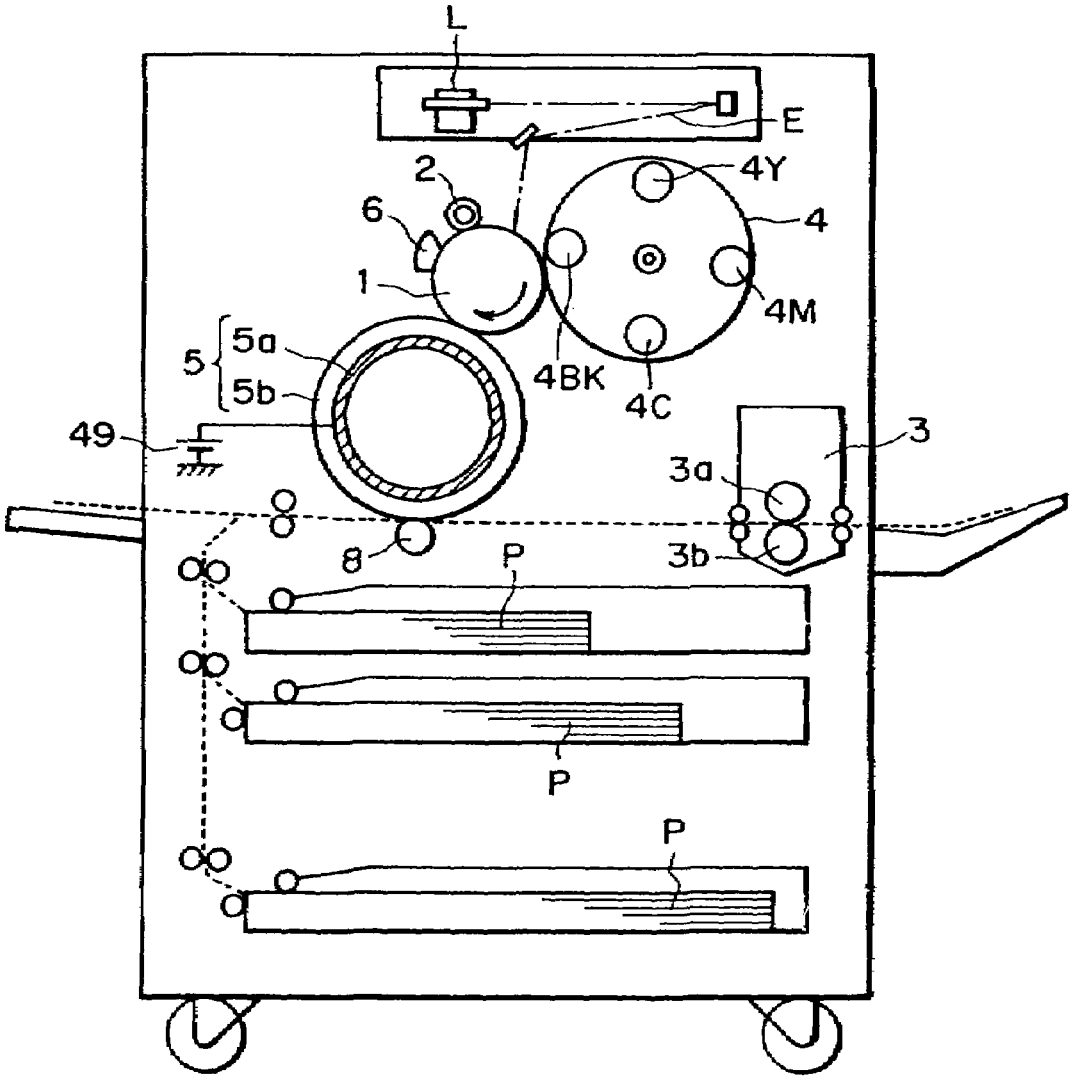
FIGS. 8 to 10 respectively illustrate an embodiment of image forming apparatus according to the invention.

Referring to FIG. 8, the surface of a photosensitive drum 1 is uniformly primarily charged while being rotated in contact with a rotating charging roller 2 (charging member) supplied with a charging bias voltage and exposed to laser light E emitted from a light source L (exposure means) to form a first electrostatic latent image on the photosensitive drum 1. The first electrostatic latent image is developed with a black toner contained in a black developing device 4Bk (a first developing device) installed within a rotary unit 4 to form a black toner image on the photosensitive drum 1. The black toner image formed on the photosensitive drum 1 is electrostatically primarily transferred onto an intermediate transfer drum 5 under the action of a transfer bias voltage applied to an electroconductive support of the intermediate transfer drum 5. Then, similarly as the above, a second electrostatic latent image is formed on the photosensitive drum 1 and developed with a yellow toner in a yellow developing device 4Y (a second developing device) shifted to a position opposite to the photosensitive drum 1 by partial rotation of the rotary unit 4 to form a yellow toner image, which is then electrostatically primarily transferred onto the intermediate transfer drum which carries the black toner image already transferred thereto. Similarly as above, a third electrostatic latent image and a fourth electrostatic latent image are successively formed on the photosensitive drum 1 and developed with a magenta toner in a magenta developing device 4M (a third developing device) and a cyan toner in a cyan developing device 4C (a fourth developing device), respectively, by partial rotation of the rotary unit 4 and primarily transferred onto the intermediate transfer drum 5, thereby forming superposed toner images of four colors on the intermediate transfer drum 5. The superposed toner images of four colors formed on the intermediate transfer drum 5 are then simultaneously secondarily transferred onto a recording paper P under the action of a transfer bias voltage supplied from a second transfer device 8 disposed opposite to the drum 5 via the paper P. The transfer paper P carrying the superposed toner images simultaneously transferred thereto is then supplied to a fixing device 3 comprising a heating roller 3*a* and a pressure roller 3*b*, where the toner images are heat-fixed onto the recording paper P. The transfer residual toner remaining on the photosensitive drum 1 after each transfer step is recovered by a cleaner 6 having a cleaning blade abutted against the photosensitive drum 1 to clean the photosensitive drum 1.

The primary transfer of color toner images from the photosensitive drum 1 to the intermediate transfer drum 5 is effected under the action of a transfer current by applying a transfer bias voltage to the electroconductive support 5*a* of the intermediate transfer drum from a bias voltage supply 49.

The intermediate transfer drum 5 comprises a rigid and electroconductive support 5*a* and a surface-coating elastic layer 5*b*.

The electroconductive support 5*a* may comprise a metal or an alloy, such as aluminum, iron, copper or stainless steel, or an electroconductive resin containing carbon or metal particles dispersed therein, and may have a shape of a cylinder, a cylinder with a central shaft or a cylinder with an internal reinforcement.

The elastic layer 5*b* may suitably comprise an elastomeric rubber, such as styrene-butadiene rubber, high-styrene rubber, butadiene rubber, isoprene rubber, ethylene-propylene copolymer, nitride-butadiene rubber (NBR), chloroprene rubber, butyl rubber, silicone rubber, fluorine rubber, nitrile rubber, urethane rubber, acryl rubber, epichlorohydrin rubber, or norbornene rubber, without being particularly restricted. It is also possible to use resin such as a polyolefin resin, silicone resin, fluorine-containing resin or polycarbonate, or a copolymer or a mixture of these.

It is possible to further dispose a surface layer containing a powdery lubricant showing high lubricity and water-repellency therein dispersed within an appropriate binder.

The lubricant is not particularly limited, but suitable examples thereof may include: fluorine-containing compounds, such as various fluorine-containing rubbers and elastomers, fluorinated carbons, such as fluorinated graphite, polytetrafluoroethylene (PTFE), polyvinylidene fluoride (PVDF), ethylene-tetrafluoroethylene copolymer (ETFE), and tetrafluoroethylene-perfluoroalkyl vinyl ether copolymer (PFA); silicone compounds, such as silicone resin and silicone rubber or elastomers; polyethylene (PE), polypropylene (PP), polystyrene (PS), acrylic resin, polyamide resin, phenolic resin and epoxy resin.

It is also possible to add an electroconductive agent as desired in the binder for the surface layer. Examples of the conductive agent may include: various conductive inorganic particles, carbon black, ionic conductive agents, conductive resins and resins containing conductive particles dispersed therein.

The superposed toner images on the intermediate transfer drum 5 are simultaneously secondarily transferred onto the recording material P by means of the second transfer device 8, which may be a non-contact electrostatic transfer means including a corona charger or a contact electrostatic transfer means including a transfer roller or a transfer belt.

As the fixing device, instead of the hot roller fixing device 3 including the heating roller 3*a* and the pressure roller 3*b*, it is also possible to use a film-heating fixing device wherein the superposed toner images are heated via a film to be heat-fixed onto the recording material P.

Instead of the intermediate transfer drum 5 shown in FIG. 8, it is also possible to use an intermediate transfer belt for temporarily carrying superposed toner images thereon and simultaneously transferring the superposed toner images onto a recording material.

Next, a second embodiment of the image forming apparatus of the present invention wherein plural toner images are sequentially transferred onto a recording material, will be described.

More specifically, according to the second embodiment, the image forming apparatus of the present invention comprises:

(I) a latent image-bearing member for bearing an electrostatic latent image thereon, (II) a charging device for primarily charging the image-bearing member, (III) an exposure means for exposing the primarily charged image-bearing member to form an electrostatic latent image thereon, (IV) a plurality of developing devices for sequentially developing the latent image with plural colors of the nonmagnetic toner described above of the present invention to successively form plural colors of toner images on the image-bearing member, and (V) a transfer device for successively transferring the plural colors of toner images onto a transfer-receiving material to form superposed toner images on the transfer-receiving material.

Figure 9:
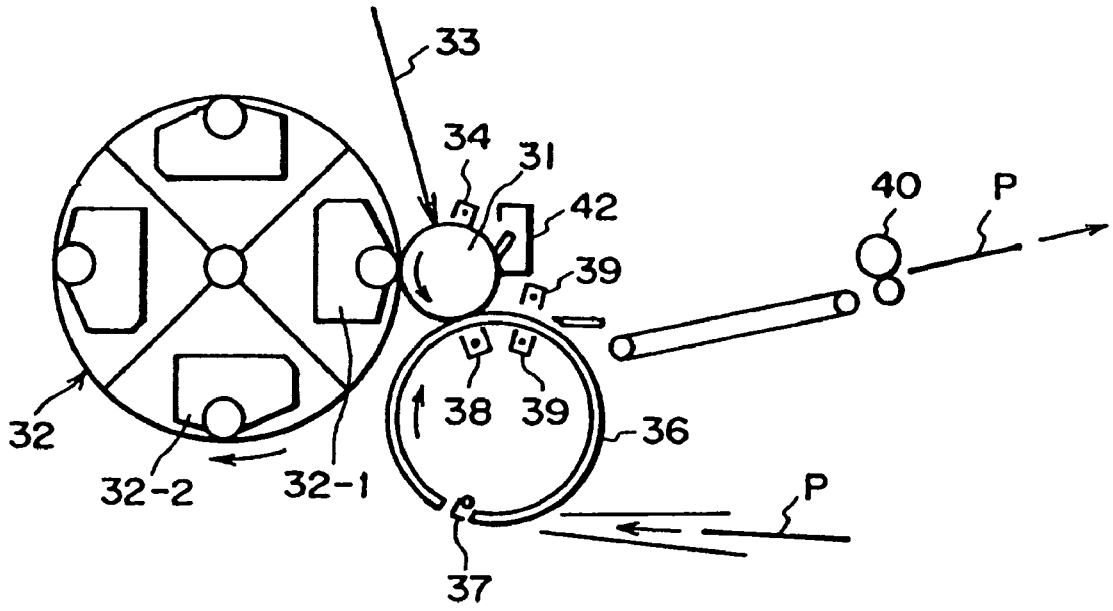

FIG. 9 illustrates an example of system organization according to the second embodiment of the image forming apparatus.

Referring to FIG. 9, an electrostatic latent image formed on a photosensitive drum 31 by exposure means 33 as a latent image forming means is developed with a nonmagnetic toner (mono-component developer) of a first color contained in a developing device 32-1 installed within a rotary developing unit 32 rotated in an indicated arrow direction to form a toner image of the first color on the photosensitive drum 31, which is then transferred onto a recording sheet P as a transfer-receiving material held on a transfer drum 36 by means of a glipper 37 by the operation of a transfer charger 38. Photosensitive drum 31 is charged by charger 34 and cleaned of residual toner by cleaning device 42.

The transfer charger 38 may comprise a corona charger as shown or a contact charger. The corona charger when used as the transfer charger 38 may be supplied with a voltage of −10 kV to +10 kV so as to supply a transfer current of −500 μA to +500 μA. The outer surface of the transfer drum 36 is covered with a holding member which may be a dielectric-film of, e.g., polyvinylidene fluoride or polyethylene terephthalate, having a thickness of, e.g., 100–200 μm and a volume resistivity of $10^{12-1014}$ ohm.cm.

Then, for development with a second color toner, the rotary developing unit 32 is partially rotated so that a second developing device 32-2 is disposed opposite to the photosensitive drum 31, whereby an electrostatic latent image for the second color formed on the photosensitive drum 31 is developed with a nonmagnetic toner (monocomponent developer) of the second color to form a second color toner image on the photosensitive drum 31, which is similarly transferred in superposition on the same recording material P carrying already the first color toner image held on the transfer drum 36.

Similar color toner image formation and transfer is repeated for third and fourth colors. In this manner, the transfer drum 36 is rotated for a prescribed number of rotations while retaining thereon an identical recording material to receive thereon a prescribed number of superposed color toner images. It is preferred that the transfer current for the electrostatic transfer of the first to fourth colors is sequentially increased, i.e., first color<second color<third color<fourth color, so as to reduce the amount of transfer residual toner remaining on the photosensitive drum 31. Too large a transfer current is not preferred because it is liable to disturb the transferred toner image.

The transfer(-receiving) material P having the superposed transferred toner images is separated from the transfer drum 36 by means of a separation charger 39 and moved to a hot-pressure roller fixing device 40 equipped with a cleaning web impregnated with silicone oil, where the superposed color toner images are fixed while causing color mixing to form a full-color image.

In the case of an apparatus requiring toner replenishment, a replenishing toner of each color is supplied from an associated replenishing hopper in a prescribed amount depending on a replenishing signal via a toner conveyer cable to a toner replenishing tube disposed at the center of the rotary developing unit, from which the toner is replenished to an associated color developing device.

According to a third embodiment, the image forming apparatus of the present invention comprises:

(I) a plurality of image forming units each comprising:

a latent image-bearing member for bearing an electrostatic latent image thereon, a charging device for primarily charging the image-bearing member, an exposure means for exposing the primarily charged image-bearing member to form an electrostatic latent image thereon, and a developing device for developing the latent image with the nonmagnetic toner described above of the present invention of a color to form a toner image of one of plural colors, and (II) a transfer device for sequentially transferring the toner images of plural colors formed by the plurality of image forming units onto a transfer-receiving material to form superposed toner images of plural colors on the transfer-receiving material.

Figure 10:
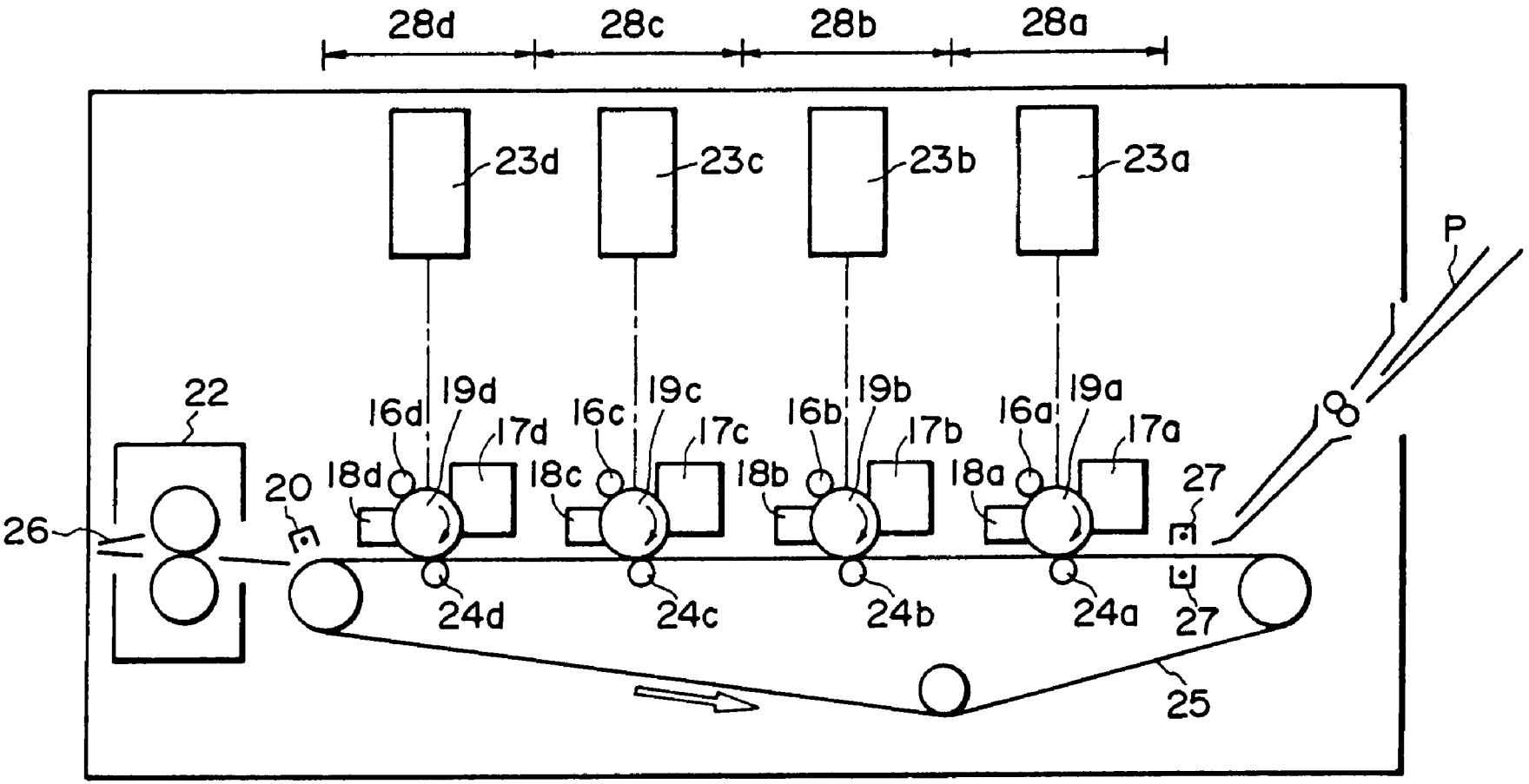

FIG. 10 illustrates an example of system organization according to the third embodiment of the image forming apparatus.

Referring to FIG. 10, the image forming apparatus includes first to fourth image forming units 28*a*, 28*b*, 28*c* and 28*d* juxtaposed with each other, each unit including its own latent image-bearing member, i.e., a photosensitive drum 19*a*, 19*b*, 19*c* or 19*d*.

Each photosensitive drum 19*a* (19*b*, 19*c* or 19*d*) is provided with a charging roller 16*a* (16*b*, 16*c* or 16*d*) an exposure means 23*a* (23*b*, 23*c* or 23*d*) as a latent image forming means, a developing device 17*a* (17*b*, 17*c*, or 17*d*), a transfer charger 24*a* (24*b*, 24*c* or 24*d*) and a cleaning device 18*a* (18*b*, 18*c* or 18*d*) disposed so as to surround it.

In the apparatus having such an organization, an electrostatic latent image of, e.g., a yellow component color of an original image is first formed on the photosensitive drum 19*a* in the first image forming unit 28*a*, and then developed with a nonmagnetic yellow toner in the developing device 17*a* to form a yellow toner image thereon, which is thereafter transferred onto a receiving material P (transfer-receiving material) supplied thereto by means of the transfer device 24*a*.

During the transfer of the yellow toner image on the recording material P, an electrostatic latent image for a magenta component color is formed on the photosensitive drum 19*b* and then developed with a nonmagnetic magenta toner in the developing device 17*b* to form a magenta toner image on the photosensitive drum 19*b*, in the second image forming unit. The thus-formed magenta toner image on the photosensitive drum 19*b* is then transferred onto the recording material P in superposition with the yellow toner image already transferred thereto when the recording material P after the transfer in the first image forming unit 28*a* is conveyed to the position of the transfer device 24*b*.

In similar manners as above, cyan and black tone images are sequentially formed and transferred onto the recording material P in the third and fourth image forming units 28*c* and 28*d*. After completion of the above-mentioned image forming steps, the recording material P carrying superposed color toner images transferred thereto is conveyed to a fixing unit 22, where the superposed toner images are fixed while causing color mixing to provide a multi-color or full-color image on the recording material P. The respective photosensitive drums 19*a*–19*d* after the respective transfer steps are subjected to removal of residual toner by the cleaning devices 18*a*–18*d*, respectively, and then subjected to latent image formation in a subsequent cycle in the respective image forming units.

In the image forming apparatus shown in FIG. 10, a conveyer belt 25 is used for conveying a recording material P (as a transfer-receiving material) from the right to the left, and during the conveyance, the recording material P is sequentially passed through the transfer devices 24*a*, 24*b*, 24*c* and 24*d* in the image forming units 28*a*, 28*b*, 28*c* and 28*d*, respectively, where the recording material P receives respective color toner images transferred thereto to form the superposed color toner images. Corona chargers 27 charge conveyer belt 25 to attract recording material P.

In the image forming apparatus, the conveyer belt 25 as a conveyer means for conveying recording materials may suitably comprise a meshed cloth of polyester film or a thin sheet of dielectric materials, such as polyethylene terephthalate resin, polyimide resin and urethane resins in view of easiness of processability and durability.

After passing by the fourth image forming unit 28*a*, the recording material P is charge-removed by applying an AC voltage to a discharger 20 and separated from the belt 25 to reach the fixing device 22, where the recording material P is subjected to fixation and then discharged out of a discharge port 26.

In this embodiment of the image forming apparatus, it is preferred that the respective image forming units are juxtaposed as shown in FIG. 10, and they can be juxtaposed longitudinally or laterally.

In the third embodiment represented by FIG. 10, it is preferred that the transfer-receiving material is a recording material as shown in FIG. 10, the toner images are directly transferred from the latent image-bearing member and fixed onto the recording material. This is possible in the third embodiment of the image forming apparatus wherein a high image quality can be retained regardless of the states of the transfer-receiving material and the toner.

Further, in this embodiment of the image forming apparatus, the toner charge can be stabilized to prevent toner scattering and the mixing of toner into another image forming unit can be obviated to retain a high image quality, so that this embodiment is suited for multi-color image formation.

As described above, according to the toner and image forming method using the toner of the present invention, through the use of an improved external additive composition, it becomes possible to obviate difficulties such as toner melt-sticking onto the latent image-bearing member and roughening of halftone images in a low humidity environment, and toner blot-down in a high temperature environment.

The toner of the present invention is also effective for providing high-quality images free from fog and re-transfer and preventing image defects due to soiling of the charging member.

According to the toner production process of the present invention specifying not only the species and particle sizes of the fine particles but also the order of blending the fine particles, synergistically advantageous effects can be attained. More specifically, it is possible to obviate fog even in the case of forming an image with a low color image percentage on a large number of sheets in a low humidity environment, an also possible to obviate toner melt-sticking onto the latent image-bearing member even in the case of forming an image with a high color image percentage on a large number of sheets in a low humidity environment.

Further, according to the image forming apparatus of the present invention, it is possible to provide high-quality multi-color or full-color images free from fog and re-transfer.

Hereinbelow, the present invention will be described more specifically based on Examples and Comparative Examples.

EXAMPLE 1

Into 700 wt. parts of deionized water, 450 wt. parts of 0.1M-$Na_3PO_4$ aqueous solution was added, and the mixture was warmed to 50° C. and stirred at 10,000 rpm by a TK-Homomixer (mfd. by Tokushu Kika Kogyo K.K.). To the system under stirring, 70 wt. parts of 1.0M-$CaCl_2$ aqueous solution was added to obtain an aqueous dispersion medium containing calcium phosphate.

| <Polymerizable monomer composition> | |
|---|---|
| (monomer) | |
| Styrene | 170 wt. part(s) |
| n-Butyl acrylate | 30 wt. part(s) |
| (colorant) | |
| C.I. Pigment Blue 15:3 | 14 wt. part(s) |
| (charge control agent) | |
| Salicylic acid Al compound | 2 wt. part(s) |
| (polar resin) | |
| Saturated polyester (Av (acid value) - 10 mgKOH/g, Mp (peak-molecular weight) = 15000) | 20 wt. part(s) |
| (release agent) | |
| Behenyl behenate (Wax A) (Tmp (melting point) = 73° C.) | 30 wt. part(s) |
| (crosslinking agent) | |
| Divinylbenzene | 0.5 wt. part(s) |

and stirred for uniform dissolution and dispersion at 9000 rpm by a TK-Homomixer (mfd. by Tokushu Kika Kogyo K.K.). To the mixture, 5 wt. parts of 2,2'-azobis(0,2,4-dimethylvaleronitrile) was added to prepare a polymerizable monomer composition.

The polymerizable monomer composition was added to the above-prepared aqueous dispersion medium, and at 60° C. in an $N_2$ atmosphere, the system was stirred at 8000 rpm by a TK-Homomixer to form particles (droplets) of the polymerizable monomer composition in the aqueous dispersion medium.

Then, the system was stirred by a paddle stirring blade and heated to 70° C. in 2 hours. After 4 hours at 70° C., the system was further heated to 80° C. at a rate of 40° C./hr, followed by 5 hours of reaction at that temperature. After the polymerization, the residual monomer was distilled off under a reduced pressure, and the system was cooled, followed by addition of hydrochloric acid for dissolving the calcium phosphate, filtration, washing with water, drying and classification to recover Cyan toner particles (1).

To 100 wt. parts of Cyan toner particles (1), 1 wt. part of silica fine particles surface-treated with hexamethyldisilazane and having an average primary particle size (Dp.av) of 8 nm (hereinafter referred to as "Silica-A"), 0.15 wt. part of rutile-form titanium oxide fine particles surface-treated with isobutylsilane (Dp.av=45 nm) (classified as second inorganic fine particles and hereinafter called "Particles 2-A") and 0.8 wt. part of untreated rutile-form titanium oxide fine particles (Dp.av=200 nm, triboelectric chargeability (T)=−2.1 mC/kg) (classified as first inorganic fine particles and hereinafter called "Particles 1-A") were added, and the mixture was blended by a HENSCHEL MIXER to obtain Toner. No. 1 according to the present invention.

Toner No. 1 exhibited a weight-average particle size (D4) of 7.3 μm and contained 8.3% by number of particles of at most 4 μm (N (≦4 μm)=8.3%). Toner No. 1 provided a DSC heat-absorption peak exhibiting a peaktop temperature (Tmp) of 73° C. and a half-value width ($W_{1/2}$) of 3.2° C. Toner No. 1 further exhibited a GPC peak molecular weight (Mp) of 22000, an acid value (Av) of 4.1 mgKOH/g, a triboelectric charge (T) of −58 mC/kg, SF-1=112 and SF-2=104.

Further, as a result of examination on SEM photographs, Silica-A exhibited a particle size distribution showing a single peak and giving Dp.av=8 nm, and the titanium oxide fine particles (=Particles 1-A+Particles 2-A) exhibited a particle size distribution showing two peaks giving Dp.av=200 nm and 45 nm, respectively.

Toner No. 1 was evaluated by incorporating it in a commercially available full-color printer ("LBP-2160", mfd. by Canon K.K.) including an intermediate transfer member similarly as the apparatus illustrated in FIG. 8, with respect to the following items. (Incidentally, the full-color printer ("BLP-216") includes rotary unit in which a yellow developing device, a magenta developing device and a cyan developing device are installed, and a separate black developing device at a position downstream of the rotary unit around the photosensitive drum. The other organization thereof is similar to the one illustrated in FIG. 8.)

Toner melt-sticking onto the latent image-bearing member (Sticking), Roughening of halftone images (Halftone), Fog (Fog) and Image defects due to soiling on the charging member (Charger soil) were evaluated after continuous image formation (printing) of 4% (areal) line images on 5000 sheets in a low temperature/low humidity environment of 15° C./5% RH.

Toner melt-sticking onto the latent image-bearing member (Sticking) was evaluated in terms of number of white spotty dropouts in an A3-size solid image attributable to toner melt-sticking.

Roughening of halftone images (Halftone) was evaluated based on a halftone image (1/4 dot density at a resolution of 600 dots/inch) of A3-size showing a reflection density of 0.6 at four levels of A, AB, B and C according to the following standard:

A: No roughening on the halftone image.

AB: Slight roughening in side regions (ca. 5 cm-wide regions where roughening of halftone image is liable to occur) in the A3-size halftone image.

B: Roughening in side regions of the A3-size halftone image.

C: Roughening over the entire area of the A3-size halftone image.

Fog (Fog) was evaluated by taking a trace of toner at a part on the image-bearing member for forming a solid white image by a cellophane adhesive tape, applying the adhesive tape on white paper and measuring the reflectance to determine a difference from a reflectance of a blank adhesive tape also applied on the white paper by using a reflectometer (mfd. by Tokyo Denshoku K.K.).

Image defects due to soiling on the charging member (Charge soil) was evaluated by a number of streaks extending in a longitudinal direction appearing in a halftone image.

Retransfer (Retransfer) was evaluated after continuous image formation (printing) of 4%-areal line images on 2000 sheets in high temperature/high humidity environment of 32.5° C./95% RH. More specifically, a cyan toner cartridge was installed within a first developing device in the rotary unit, and a cyan color image formation of a halftone image was repeated by a four-color mode (including 4 transfer steps) and by a single color mode (including one transfer step), whereby the degree of retransfer was evaluated as a difference in reflection density between the resultant halftone image according to the two modes.

Toner blot-down (Blot-down).was evaluated by storing a sample toner in an environment of 50° C. for one week and then using the toner for printing out of the halftone image in an environment of 15° C./5% RH, whereby the degree of Blot down was evaluated by a number of toner spots appearing in the A3-size image.

The results of the above evaluation are inclusively shown in Table 4 hereinafter together with those of the following Comparative Examples and Examples.

COMPARATIVE EXAMPLE 1

Comparative toner No. 1 was prepared in the same manner as in Example 1 except for omitting Particles 1-A.

COMPARATIVE EXAMPLE 2

Comparative toner No. 2 was prepared in the same manner as in Example 1 except for omitting Particles 2-A.

COMPARATIVE EXAMPLE 3

Comparative toner No. 3 was prepared in the same manner as in Example 1 except for omitting Silica-A and changing the amount of Particles 2-A to 1.0 wt. part.

EXAMPLES 2–7 AND COMPARATIVE EXAMPLES 4–8

Toners Nos. 2–7 and Comparative toners Nos. 4–8 were prepared in the same manner as in Example 1 except for replacing Particles 1-A with inorganic fine particles shown in Table 1 which may be classified as or comparable to First inorganic fine particles.

EXAMPLES 8–13 AND COMPARATIVE EXAMPLES 9–10

Toners Nos. 8–13 and Comparative toners Nos. 9–10 were prepared in the same manner as in Example 1 except for replacing Particles 2-A with inorganic fine particles shown in Table 2 which may be classified as or comparable to Second inorganic fine particles.

The results of evaluation are shown in Table 5.

EXAMPLES 14–15 AND COMPARATIVE EXAMPLE 11

Toners Nos. 14–15 and Comparative toner No. 11 were prepared in the same manner as in Example 1 except for replacing Silica A with inorganic fine particles shown in Table 3 which may be classified as or comparable to Silica fine particles.

The results of evaluation are shown in Table 5.

TABLE 1

(First) inorganic fine particles

| Particles | Composition | Dp. av. (nm) | T (mC/kg) |
|---|---|---|---|
| 1-A | titanium oxide (rutile) | 200 | −2.1 |
| 1-B | titanium oxide (anatase) | 130 | −2.6 |
| 1-C | aluminum oxide | 280 | +3.6 |
| 1-D | zinc oxide | 350 | +2.2 |
| 1-E | zirconium oxide | 320 | −3.2 |
| 1-F | titanium oxide (rutile)*1 | 250 | +4.1 |
| 1-G | aluminum oxide | 1200 | −3.5 |
| 1-H | magnesium oxide | 200 | +20 |
| 1-I | α-iron oxide | 250 | −5.3 |
| 1-J | titanium oxide (anatase) | 75 | −8.2 |
| 1-K | strontium titanate | 700 | −4.7 |
| 1-L | titanium oxide (rutile)*2 | 350 | −7.6 |

*1: with surface-attached aluminum oxide
*2: surface-treated with isobutylsilane

TABLE 2

(Second) inorganic fine particles

| Particles | Composition: Base | Composition: Surface agent | Dp. av (nm) |
|---|---|---|---|
| 2-A | titanium oxide (rutile) | isobutylsilane | 45 |
| 2-B | titanium oxide (rutile) | dimethyl silicone oil | 50 |
| 2-C | aluminum oxide | — | 25 |
| 2-D | aluminum oxide | isobutylsilane | 55 |
| 2-E | titanium oxide (anatase) | — | 75 |
| 2-F | titanium oxide (rutile) | isobutylsilane | 30 |
| 2-G | magnesium oxide | — | 60 |
| 2-H | silica | hexamethyl-disilazane | 40 |
| 2-I | titanium oxide (anatase) | — | 90 |
| 2-J | aluminum oxide | isobutylsilane | 25 |

TABLE 3

| Particles | Silica fine particles: Composition: Base | Surface agent | Dp. av (nm) |
|---|---|---|---|
| A | silica | hexamethyldisilazane | 8 |
| B | silica | hexamethyldisilazane | 12 |
| C | silica | **1 | 16 |
| D | silica | hexamethyldisilazane | 40 |

**1: dimethylsilicone oil and hexamethyldisilazane except for using Toner particles (2)–(5). The properties and evaluation results of the toners ate shown in Tables 9 and 10, respectively, together with those of the toners prepared in the following Examples and Comparative Examples.

EXAMPLES 20–23

Toner particles (6)–(9) having properties shown in Table 6 were prepared in the same manner as in Example 1 except for using Waxes B-E shown in Table 8 instead of Wax A, and Toner Nos. 20–23 were prepared and evaluated in the same manner as Toner No. 1 in Example 1 except for using Toner particles (6)–(9).

TABLE 4

| Example | Toner | Toner particles | Particles | wt. parts | Particles | wt. parts | Silica | wt. parts | Sticking (–) | Half-tone | Fog | Re-transfer | Blot-down (–) | Charger soil (–) |
|---|---|---|---|---|---|---|---|---|---|---|---|---|---|---|
| 1 | No. 1 | (1) | 1-A | 0.8 | 2-A | 0.15 | A | 1.0 | 0 | A | 0.2 | 0.01 | 0 | 0 |
| 2 | No. 2 | (1) | 1-B | 0.8 | 2-A | 0.15 | A | 1.0 | 0 | A | 0.1 | 0.01 | 0 | 0 |
| 3 | No. 3 | (1) | 1-C | 0.8 | 2-A | 0.15 | A | 1.0 | 0 | A | 0.2 | 0.01 | 0 | 0 |
| 4 | No. 4 | (1) | 1-D | 0.8 | 2-A | 0.15 | A | 1.0 | 2 | A | 0.4 | 0.03 | 0 | 2 |
| 5 | No. 5 | (1) | 1-E | 0.8 | 2-A | 0.15 | A | 1.0 | 2 | A | 0.5 | 0.03 | 0 | 2 |
| 6 | No. 6 | (1) | 1-F | 0.8 | 2-A | 0.15 | A | 1.0 | 0 | A | 0.2 | 0.01 | 0 | 0 |
| 7 | No. 7 | (1) | 1-L | 0.8 | 2-A | 0.15 | A | 1.0 | 0 | AB | 0.2 | 0.03 | 0 | 2 |
| Comp. 1 | Comp. No. 1 | (1) | — | 0.8 | 2-A | 0.15 | A | 1.0 | 19 | B | 2.0 | 0.12 | 12 | 3 |
| 2 | Comp. No. 2 | (1) | 1-A | 0.8 | — | 0.15 | A | 1.0 | 12 | B | 1.5 | 0.10 | 8 | 7 |
| 3 | Comp. No. 3 | (1) | 1-A | 0.8 | 2-A | 1.0 | — | — | 13 | A | 3.0 | 0.25 | 10 | 2 |
| 4 | Comp. No. 4 | (1) | 1-G | 0.8 | 2-A | 0.15 | A | 1.0 | 22 | B | 2.5 | 0.13 | 20 | 14 |
| 5 | Comp. No. 5 | (1) | 1-H | 0.8 | 2-A | 0.15 | A | 1.0 | 17 | B | 1.7 | 0.10 | 12 | 15 |
| 6 | Comp. No. 6 | (1) | 1-I | 0.8 | 2-A | 0.15 | A | 1.0 | 12 | B | 1.2 | 0.20 | 10 | 12 |
| 7 | Comp. No. 7 | (1) | 1-L | 0.8 | 2-A | 0.15 | A | 1.0 | 14 | B | 1.7 | 0.14 | 10 | 10 |
| 8 | Comp. No. 8 | (1) | 1-K | 0.8 | 2-A | 0.15 | A | 1.0 | 13 | B | 1.5 | 0.16 | 13 | 17 |

TABLE 5

| Example | Toner | Toner particles | Particles | wt. parts | Particles | wt. parts | Silica | wt. parts | Sticking (–) | Half-tone | Fog | Re-transfer | Blot-down (–) | Charger soil (–) |
|---|---|---|---|---|---|---|---|---|---|---|---|---|---|---|
| 8 | No. 8 | (1) | 1-A | 0.8 | 2-B | 0.15 | A | 1.0 | 0 | A | 0.2 | 0.01 | 0 | 0 |
| 9 | No. 9 | (1) | 1-A | 0.8 | 2-C | 0.15 | A | 1.0 | 0 | A | 0.1 | 0.02 | 0 | 0 |
| 10 | No. 10 | (1) | 1-A | 0.8 | 2-D | 0.15 | A | 1.0 | 0 | A | 0.2 | 0.01 | 0 | 0 |
| 11 | No. 11 | (1) | 1-A | 0.8 | 2-E | 0.15 | A | 1.0 | 3 | AB | 0.5 | 0.04 | 2 | 2 |
| 12 | No. 12 | (1) | 1-A | 0.8 | 2-F | 0.15 | A | 1.0 | 0 | A | 0.2 | 0.01 | 0 | 0 |
| 13 | No. 13 | (1) | 1-A | 0.8 | 2-G | 0.15 | A | 1.0 | 2 | AB | 0.6 | 0.05 | 2 | 5 |
| 14 | No. 14 | (1) | 1-A | 0.8 | 2-A | 0.15 | B | 1.0 | 0 | A | 0.1 | 0.01 | 0 | 0 |
| 15 | No. 15 | (1) | 1-A | 0.8 | 2-A | 0.15 | C | 1.0 | 0 | A | 0.3 | 0.01 | 0 | 0 |
| Comp. 9 | Comp. No. 9 | (1) | 1-A | 0.8 | 2-H | 0.15 | A | 1.0 | 18 | B | 1.4 | 0.12 | 14 | 10 |
| Comp. 10 | Comp. No. 10 | (1) | 1-A | 0.8 | 2-I | 0.15 | A | 1.0 | 11 | B | 1.1 | 0.10 | 8 | 11 |
| Comp. 11 | Comp. No. 11 | (1) | 1-A | 0.8 | 2-A | 0.15 | D | 1.0 | 13 | B | 2.7 | 0.10 | 10 | 2 |

EXAMPLES 16–19

Toner particles (2)–(5) having properties shown in Table 6 were prepared in the same manner as Toner particles (1) in Example 1 except for changing the final classification conditions, and Toner Nos. 16–19 were prepared and evaluated in the same manner as in Toner No. 1 in Example 1

EXAMPLES 24–27

Toner particles (10)–(13) having properties shown in Table 6 were prepared in the same manner as in Example 1 except for changing the amounts of polymerization initiator and the reaction temperatures for adjusting the peak molecular weights (Mp) as measured according to GPC, and Toner Nos. 24–27 were prepared and evaluated in the same manner as Toner No. 1 in Example 1 except for using Toner particles (10)–(13).

EXAMPLES 28–30

Toner particles (14)–(16) having properties shown in Table 6 were prepared in the same manner as in Example 1 except for additionally using different amounts of monobutyl maleate in the polymerizable monomer composition and Toner Nos. 28–30 were prepared and evaluated in the same manner as Toner No. 1 in Example 1 except for using Toner particles (14)–(16). The physical properties and evaluation results of the toners are shown in Tables 11 and 12, respectively together with those of the toner prepared in the following Examples.

EXAMPLE 31

Toner particles (17) having properties shown in Table 7 were prepared in the same manner as in Example 1 except for omitting the salicylic acid aluminum compound (as a charge control agent) and Toner No. 31 was prepared and evaluated in the same manner as Toner No. 1 in Example 1 except for using Toner particles (17).

EXAMPLE 32

Toner particles (18) having properties shown in Table 7 were prepared in the same manner as in Example 1 except for changing the amount of the salicylic acid aluminum compound (charge control agent) to 4 wt. parts of changing the final classification condition and Toner No. 32 was prepared and evaluated in the same manner as Toner No. 1 in Example 1 except for using Toner particles (18).

EXAMPLES 33–35

| | |
|---|---|
| Styrene-butyl acrylate copolymer | 100 wt. parts |
| C.I. Pigment Blue 15:3 | 7 wt. parts |

-continued

| | |
|---|---|
| Behenyl behenate (Wax A) (Mp = 73° C.) | 10 wt. parts |
| Salicylic acid aluminum compound | 2 wt. parts |

The above ingredients were preliminarily blended and then melt-kneaded through a twin-screw extruder set at 130° C. After being cooled, the melt-kneaded product was coarsely crushed and finely pulverized by a pulverizer using jet air stream, followed by classification by a pneumatic classifier. The classified particles were surface-treated by applying different degrees of mechanical treatments by means of Hybridization System Model 1 (mfd. by Nara Kikai Seisakusho K.K.) to obtain Toner particles (19)–(21) having different levels of shape factors and other properties shown in Table 7. Then, Toner Nos. 33–35 were prepared and evaluated in the same manner as in Toner No. 1 in Example 1 except for using Toner particles (19)–(21).

EXAMPLE 36

Toner particles (22) having properties shown in Table 7 were prepared in the same manner as in Example 33 except for using a polyester resin (polycondensation product between propoxidized bisphenol and fumaric acid), and Toner No. 36 was prepared and evaluated in the same manner as Toner No. 1 in Example 1 except for using Toner particles (22).

EXAMPLE 37

Toner No. 37 was prepared and evaluated in the same manner as in Example 1 except for using 0.4 wt. part of Particles 1-A and 0.4 wt. part of Particles 1-C instead of 0.8 wt. part of Particles 1-A.

EXAMPLE 38

Toner No. 38 was prepared and evaluated in the same manner as in Example 1 except for using 0.1 wt. part of Particles 2-A and 0.1 wt. part of Particles 2-C instead of 0.15 wt. part of Particles 2-A.

TABLE 6

| | Toner particles | | | | | | | | |
|---|---|---|---|---|---|---|---|---|---|
| | Size distribution | | DSC peak | | | | | Shape factors | |
| | D4 | N | Tmp | $W_{1/2}$ | | Av | T | | |
| Name | (μm) | (≦4 μm) % | (° C.) | (° C.) | Mp | (mgKOH/g) | (mC/kg) | SF-1 | SF-2 |
| (1) | 7.3 | 8.3 | 73 | 3.2 | 22000 | 4.1 | −58 | 112 | 104 |
| (2) | 7.8 | 3.7 | 73 | 3.2 | 23000 | 4.0 | −54 | 111 | 104 |
| (3) | 8.5 | 2.6 | 73 | 3.2 | 22000 | 4.2 | −45 | 113 | 106 |
| (4) | 3.9 | 69 | 73 | 3.2 | 21000 | 4.3 | −78 | 110 | 105 |
| (5) | 6.8 | 23.2 | 73 | 3.2 | 22000 | 4.0 | −72 | 112 | 105 |
| (6) | 7.2 | 7.8 | 65 | 2.8 | 21000 | 4.3 | −65 | 110 | 104 |
| (7) | 7.4 | 8.3 | 87 | 4.0 | 24000 | 4.4 | −55 | 109 | 103 |
| (8) | 7.2 | 8.1 | 95 | 4.7 | 20000 | 4.2 | −50 | 114 | 107 |
| (9) | 7.3 | 8.5 | 75 | 14 | 22000 | 4.0 | −51 | 110 | 106 |
| (10) | 7.2 | 7.5 | 73 | 3.2 | 12000 | 4.2 | −60 | 112 | 106 |
| (11) | 7.0 | 8.8 | 73 | 3.2 | 17000 | 4.1 | −61 | 110 | 104 |
| (12) | 7.5 | 7.8 | 73 | 3.2 | 27000 | 3.9 | −57 | 113 | 105 |
| (13) | 7.2 | 8.5 | 73 | 3.2 | 32000 | 4.2 | −63 | 111 | 105 |
| (14) | 7.1 | 8.0 | 73 | 3.2 | 21000 | 8.3 | −60 | 111 | 104 |

TABLE 6-continued

| Toner particles | | | | | | | | | |
|---|---|---|---|---|---|---|---|---|---|
| | Size distribution | | DSC peak | | | | | Shape factors | |
| Name | D4 (μm) | N (≦4 μm) % | Tmp (° C.) | $W_{1/2}$ (° C.) | Mp | Av (mgKOH/g) | T (mC/kg) | SF-1 | SF-2 |
| (15) | 7.3 | 7.0 | 73 | 3.2 | 23000 | 11.5 | −63 | 109 | 103 |
| (16) | 7.3 | 7.3 | 73 | 3.2 | 23000 | 18.0 | −67 | 112 | 106 |

TABLE 7

| Toner particles | | | | | | | | | |
|---|---|---|---|---|---|---|---|---|---|
| | Size distribution | | DSC peak | | | | | Shape factors | |
| Name | D4 (μm) | N (≦4 μm) % | Tmp (° C.) | $W_{1/2}$ (° C.) | Mp | Av (mgKOH/g) | T (mC/kg) | SF-1 | SF-2 |
| (17) | 7.8 | 3.3 | 73 | 3.2 | 20000 | 4.3 | −38 | 113 | 105 |
| (18) | 4.1 | 63 | 73 | 3.2 | 25000 | 4.5 | −84 | 111 | 104 |
| (19) | 7.3 | 7.8 | 73 | 3.2 | 21000 | 1.5 | −56 | 118 | 113 |
| (20) | 7.1 | 8.0 | 73 | 3.2 | 23000 | 1.7 | −57 | 160 | 136 |
| (21) | 7.0 | 7.7 | 73 | 3.2 | 22000 | 1.6 | −54 | 173 | 144 |
| (22) | 7.0 | 8.3 | 73 | 3.2 | 22000 | 14.0 | −48 | 119 | 113 |

TABLE 8

| Waxes | | | |
|---|---|---|---|
| Wax | Composition | Tmp (° C.) | $W_{1/2}$ (° C.) |
| A | behenyl behenate | 73 | 3.2 |
| B | paraffin wax | 65 | 2.8 |
| C | paraffin wax | 87 | 4.0 |
| D | polyethylene wax | 95 | 4.7 |
| E | polyethylene wax | 75 | 14.2 |

TABLE 10

| Evaluation results | | | | | | | |
|---|---|---|---|---|---|---|---|
| Example | Toner | Sticking (−) | Half-tone | Fog | Re-transfer | Blot-down (−) | Charger soil (−) |
| 16 | NO. 16 | 0 | A | 0.2 | 0.02 | 0 | 0 |
| 17 | NO. 17 | 0 | A | 0.4 | 0.05 | 0 | 2 |
| 18 | NO. 18 | 6 | AB | 0.6 | 0.05 | 2 | 3 |
| 19 | NO. 19 | 3 | AB | 0.4 | 0.04 | 0 | 2 |

TABLE 9

| Toners | | | | | | | | | | | | | | | | | |
|---|---|---|---|---|---|---|---|---|---|---|---|---|---|---|---|---|---|
| | | Toner | Particles | | Particles | | Silica | | Size distribution | | DSC peak | | | | | Shape factors | |
| Example | Toner | particles | | wt. parts | | wt. parts | | wt. parts | D4 (μm) | N (≦4 μm) % | Tmp (° C.) | $W_{1/2}$ (° C.) | Mp | Av (mgKOH/g) | T (mC/kg) | SF-1 | SF-2 |
| 16 | No. 16 | (2) | 1-A | 0.8 | 2-A | 0.15 | A | 1.0 | 7.8 | 3.7 | 73 | 3.2 | 23000 | 4.0 | −56 | 111 | 104 |
| 17 | No. 17 | (3) | 1-A | 0.8 | 2-A | 0.15 | A | 1.0 | 8.5 | 2.6 | 73 | 3.2 | 22000 | 4.2 | −50 | 113 | 106 |
| 18 | No. 18 | (4) | 1-A | 0.8 | 2-A | 0.15 | A | 1.0 | 3.9 | 69 | 73 | 3.2 | 21000 | 4.3 | −76 | 110 | 105 |
| 19 | No. 19 | (5) | 1-A | 0.8 | 2-A | 0.15 | A | 1.0 | 6.8 | 23.2 | 73 | 3.2 | 22000 | 4.0 | −72 | 112 | 105 |
| 20 | No. 20 | (6) | 1-A | 0.8 | 2-A | 0.15 | A | 1.0 | 7.2 | 7.8 | 65 | 2.8 | 21000 | 4.3 | −66 | 110 | 104 |
| 21 | No. 21 | (7) | 1-A | 0.8 | 2-A | 0.15 | A | 1.0 | 7.4 | 8.3 | 87 | 4.0 | 24000 | 4.4 | −57 | 109 | 103 |
| 22 | No. 22 | (8) | 1-A | 0.8 | 2-A | 0.15 | A | 1.0 | 7.2 | 8.1 | 95 | 4.7 | 20000 | 4.2 | −52 | 114 | 107 |
| 23 | No. 23 | (9) | 1-A | 0.8 | 2-A | 0.15 | A | 1.0 | 7.3 | 8.5 | 75 | 14 | 22000 | 4.0 | −52 | 110 | 106 |
| 24 | No. 24 | (10) | 1-A | 0.8 | 2-A | 0.15 | A | 1.0 | 7.2 | 7.5 | 73 | 3.2 | 12000 | 4.2 | −61 | 112 | 106 |
| 25 | No. 25 | (11) | 1-A | 0.8 | 2-A | 0.15 | A | 1.0 | 7.0 | 8.8 | 73 | 3.2 | 17000 | 4.1 | −60 | 110 | 104 |
| 26 | No. 26 | (12) | 1-A | 0.8 | 2-A | 0.15 | A | 1.0 | 7.5 | 7.8 | 73 | 3.2 | 27000 | 3.7 | −58 | 113 | 105 |
| 27 | No. 27 | (13) | 1-A | 0.8 | 2-A | 0.15 | A | 1.0 | 7.2 | 8.5 | 73 | 3.2 | 32000 | 4.2 | −64 | 111 | 105 |

TABLE 10-continued

| Example | Toner | Evaluation results: Sticking (–) | Half-tone | Fog | Re-transfer | Blot-down (–) | Charger soil (–) |
|---|---|---|---|---|---|---|---|
| 20 | NO. 20 | 0 | A | 0.1 | 0.01 | 0 | 0 |
| 21 | NO. 21 | 0 | A | 0.2 | 0.01 | 0 | 0 |
| 22 | NO. 22 | 4 | AB | 0.6 | 0.05 | 0 | 3 |
| 23 | NO. 23 | 5 | A | 0.5 | 0.03 | 2 | 2 |
| 24 | NO. 24 | 3 | AB | 0.5 | 0.04 | 3 | 3 |
| 25 | NO. 25 | 0 | A | 0.1 | 0.01 | 0 | 0 |
| 26 | NO. 26 | 0 | A | 0.1 | 0.02 | 0 | 0 |
| 27 | NO. 27 | 0 | A | 0.2 | 0.02 | 0 | 0 |

TABLE 11

| Example | Toner | Toner particles | Particles | wt. parts | Particles | wt. parts | Silica | wt. parts | Size distribution: D4 (μm) | N (≦4 μm) % | DSC peak: Tmp (° C.) | $W_{1/2}$ (° C.) | Mp | Av (mgKOH/g) | T (mC/kg) | Shape factors: SF-1 | SF-2 |
|---|---|---|---|---|---|---|---|---|---|---|---|---|---|---|---|---|---|
| 28 | No. 28 | 14 | 1-A | 0.8 | 2-A | 0.15 | A | 1.0 | 7.1 | 8.0 | 73 | 3.2 | 21000 | 8.3 | −62 | 111 | 104 |
| 29 | No. 29 | 15 | 1-A | 0.8 | 2-A | 0.15 | A | 1.0 | 7.3 | 7.0 | 73 | 3.2 | 23000 | 11.5 | −63 | 109 | 103 |
| 30 | No. 30 | 16 | 1-A | 0.8 | 2-A | 0.15 | A | 1.0 | 7.3 | 7.3 | 73 | 3.2 | 23000 | 18.0 | −66 | 112 | 106 |
| 31 | No. 31 | 17 | 1-A | 0.8 | 2-A | 0.15 | A | 1.0 | 7.8 | 3.3 | 73 | 3.2 | 20000 | 4.3 | −38 | 113. | 105 |
| 32 | No. 32 | 18 | 1-A | 0.8 | 2-A | 0.15 | A | 1.0 | 4.1 | 63 | 73 | 3.2 | 25000 | 4.5 | −85 | 111 | 104 |
| 33 | No. 33 | 19 | 1-A | 0.8 | 2-A | 0.15 | A | 1.0 | 7.3 | 7.8 | 73 | 3.2 | 21000 | 1.5 | −58 | 118 | 113 |
| 34 | No. 34 | 20 | 1-A | 0.9 | 2-A | 0.15 | A | 1.0 | 7.1 | 8.0 | 73 | 3.2 | 23000 | 1.7 | −56 | 160 | 136 |
| 35 | No. 35 | 21 | 1-A | 0.8 | 2-A | 0.15 | A | 1.0 | 7.0 | 7.7 | 73 | 3.2 | 22000 | 1.6 | −55 | 173 | 144 |
| 36 | No. 36 | 22 | 1-A | 0.8 | 2-A | 0.15 | A | 1.0 | 7.0 | 8.3 | 73 | 3.2 | 22000 | 14.0 | −49 | 119 | 113 |
| 37 | No. 37 | 1 | 1-A<br>1-C | 0.4<br>0.4 | 2-A | 0.8 | A | 1.0 | 7.3 | 8.3 | 73 | 3.2 | 22000 | 4.1 | −55 | 112 | 104 |
| 38 | No. 38 | 1 | 1-A | 0.8 | 2-A<br>2-C | 0.1<br>0.1 | A | 1.0 | 7.3 | 8.3 | 73 | 3.2 | 22000 | 4.1 | −61 | 112 | 104 |

TABLE 12

| Example | Toner | Evaluation results: Sticking (–) | Half-tone | Fog | Re-transfer | Blot-down (–) | Charger soil (–) |
|---|---|---|---|---|---|---|---|
| 28 | No. 28 | 0 | A | 0.1 | 0.02 | 0 | 0 |
| 29 | No. 29 | 2 | AB | 0.4 | 0.04 | 0 | 2 |
| 30 | No. 30 | 4 | AB | 0.7 | 0.05 | 0 | 3 |
| 31 | No. 31 | 0 | A | 0.5 | 0.05 | 0 | 2 |
| 32 | No. 32 | 6 | AB | 0.6 | 0.02 | 3 | 0 |
| 33 | No. 33 | 2 | A | 0.3 | 0.03 | 0 | 2 |
| 34 | No. 34 | 4 | A | 0.5 | 0.04 | 0 | 2 |
| 35 | No. 35 | 7 | AB | 0.7 | 0.07 | 3 | 4 |
| 36 | No. 36 | 4 | A | 0.6 | 0.06 | 2 | 3 |
| 37 | No. 37 | 0 | A | 0.1 | 0.02 | 0 | 0 |
| 38 | No. 38 | 0 | A | 0.1 | 0.02 | 0 | 0 |

<Preparation of Toner Particles (23)>

Into a 2 liter-four necked flask containing 700 wt. parts of deionized water, 450 wt. parts of 0.1M-$Na_3PO_4$ aqueous solution was added, and the mixture was warmed to 50° C. and stirred at 10,000 rpm by a TK-Homomixer (mfd. by Tokushu Kika Kogyo K.K.). To the system under stirring, 70 wt. parts of 1.0M-$CaCl_2$ aqueous solution was added to obtain an aqueous dispersion medium containing calcium phosphate.

| <Polymerizable monomer composition> | |
|---|---|
| (monomer) | |
| Styrene | 170 wt. part(s) |
| n-Butyl acrylate | 30 wt. part(s) |
| (colorant) | |
| C.I. Pigment Blue 15:3 | 14 wt. part(s) |
| (charge control agent) | |
| Salicylic acid Al compound | 2 wt. part(s) |
| (release agent) | |
| Behenyl behenate (Wax A) (Tmp = 73° C.) | 30 wt. part(s) |

-continued

| <Polymerizable monomer composition> | |
|---|---|
| (polar resin) | |
| Saturated polyester (Av = 10 mgKOH/g, Mp = 15000) | 20 wt. part(s) |
| (cross linking agent) | |
| Divinylbenzene | 0.5 wt. part(s) |

The above ingredients were warmed at 50° C. and stirred for uniform dissolution and dispersion at 9000 rpm by a TK-Homomixer (mfd. by Tokushu Kika Kogyo. K.K.). To the mixture, 5 wt. parts of 2,2'-azobis(2,4-dimethylvaleronitrile) was added to prepare a polymerizable monomer composition.

The polymerizable monomer composition was added to the above-prepared aqueous dispersion medium, and at 60° C. in an $N_2$ atmosphere, the system was stirred at 8000 rpm by a TK-Homomixer to form particles (droplets) of the polymerizable monomer composition in the aqueous dispersion medium.

Then, the system was stirred by a paddle stirring blade and heated to 70° C. in 2 hours. After 4 hours at 70° C., the system was further heated to 80° C. at a rate of 40° C./hr, followed by 5 hours of reaction at that temperature. After the polymerization, the residual monomer was distilled off under a reduced pressure, and the system was cooled, followed by addition of hydrochloric acid for dissolving the calcium phosphate, filtration, washing with water, drying and classification to recover Cyan toner particles (23).

EXAMPLE 39

To 100 wt. parts of Cyan toner particles (23), 0.5 wt. part of rutile-form titanium oxide fine particles (Dp.av.=200 nm, T=−2.1 nC/kg) (Particles 1-A) was added and blended for dispersion for 3 min. at 4000 rpm in a HENSCHEL MIXER ("Model 10B", mfd. by Mitsui Miike Kakoki K.K.) to obtain a toner precursor. Then, into the HENSCHEL MIXER, 1 wt part of silica fine particles surface-treated with hexamethyldisilazane (Dp.av.)=8 nm) (Silica-A) and 0.15 wt. part of titanium oxide fine particles surface-treated with isobutylsilane (Dp.av=45 nm) (Particles 2-A) were added and blended for dispersion for 5 min. at 3000 rpm to obtain Toner No. 39.

Toner No. 39 exhibited D4=7.0 μm, N (≦4 μm)=8.3%, Tmp=73° C. and $W_{1/2}$ =3.2° C. according to DSC, Mp=21000 by GPC, Av=4.2 mgKOH/g, T=−60 mC/kg, SF-1=107 and SF-2=104.

The properties of Toner No. 39 are inclusively shown in Table 15 together with those of the following Examples and Comparative Examples.

EXAMPLES 40–45 AND COMPARATIVE EXAMPLES 12–16

Toners Nos. 40–45 and Comparative toners No. 12–16 were prepared in the same manner as in Example 39 except for replacing Particles 1-A with inorganic fine particles shown in Table 1 (which may be classified as or comparable to First inorganic fine particles) as shown in Table 15.

COMPARATIVE EXAMPLE 17

Comparative toner No. 17 was prepared in the same manner as in Example 39 except for omitting Particles 1-A.

COMPARATIVE EXAMPLE 8

Comparative toner No. 18 was prepared in the same manner as in Example 39 except for omitting Particles 2-A.

COMPARATIVE EXAMPLE 19

Comparative toner No. 19 was prepared in the same manner as in Example 39 except for omitting Silica-A and changing the amount of Particles 2-A to 1.0 wt. part.

EXAMPLES 46–51 AND COMPARATIVE EXAMPLES 20–21

Toners Nos. 46–51 and Comparative toners Nos. 20–21 were prepared in the same manner as in Example 39 except for replacing Particles 2-A with inorganic fine particles shown in Table 2 (which may be classified as or comparable to Second inorganic fine particles) as shown in Table 16.

EXAMPLES 52–53 AND COMPARATIVE EXAMPLE 22

Toners Nos. 52–53 and Comparative toner No. 22 were prepared in the same manner as in Example 39 except for replacing Silica A with inorganic fine particles shown in Table 3 (which may be classified as or comparable to Silica fine particles) as shown in Table 16.

EXAMPLES 54–57

Toner particles (24)–(27) having properties shown in Table 13 were prepared in the same manner as Toner particles (23) except for changing the final classification conditions, and Toner Nos. 54–57 were prepared in the same manner as in Example 39 except for using Toner particles (24)–(27). The properties of the toners are shown in Table 17, together with those of the toners prepared in the following Examples and Comparative Examples.

EXAMPLES 58–61

Toner particles (28)–(31) having properties shown in Table 13 were prepared in the same manner as Toner particles (23) except for using Waxes B-E shown in Table 8 instead of Wax A, and Toner Nos. 58–61 were prepared in the same manner as Toner No. 39 in Example 39 except for using Toner particles (28)–(31).

EXAMPLES 62–65

Toner particles (32)–(35) having properties shown in Table 13 were prepared in the same manner as Toner particles (23) except for changing the amounts of polymerization initiator and the reaction temperatures for adjusting the peak molecular weights (Mp) as measured according to GPC, and Toner Nos. 62–65 were prepared and evaluated in the same manner as Toner No. 39 in Example 39 except for using Toner particles (32)–(35).

EXAMPLES 66–68

Toner particles (36)–(38) having properties shown in Table 13 were prepared in the same manner as Toner particles (23) except for additionally using different amounts of monobutyl maleate in the polymerizable monomer composition and Toners Nos. 66-68 were prepared and evaluated in the same manner as Toner No. 39 in Example 39 except for using Toner particles (36)–(38). The physical properties and evaluation results of the toners are shown in Table 18, respectively together with those of the toners prepared in the following Examples.

EXAMPLES 69–71

| | |
|---|---|
| Styrene-butyl acrylate copolymer | 100 wt. parts |
| C.I. Pigment Blue 15:3 | 7 wt. parts |
| Behenyl behenate (Wax A) (Mp = 73° C.) | 10 wt. parts |
| Salicylic acid aluminum compound | 2 wt. parts |

The above ingredients were preliminarily blended and then melt-kneaded through a twin-screw extruder set at 130° C. After being cooled, the melt-kneaded product was coarsely crushed and finely pulverized by a pulverizer using jet air stream, followed by classification by a pneumatic classifier. The classified particles were surface-treated by applying different degrees of mechanical treatments by means of Hybridization System Model 1 (mfd. by Nara Kikai Seisakusho K.K.) to obtain Toner particles (39)–(41) having different levels of shape factors and other properties shown in Table 18. Then, Toners Nos. 69–71 were prepared in the same manner as Toner No. 39 in Example 39 except for using Toner particles (39)–(41).

EXAMPLE 72

Toner particles (42) having properties shown in Table 18 were prepared in the same manner as in Example 69 except for using a polyester resin (polycondensation product between propoxidized bisphenol and fumaric acid), and Toner No. 72 was prepared and evaluated in the same manner as Toner No. 39 in Example 39 except for using Toner particles (42).

EXAMPLE 73

Toner No. 73 was prepared in the same manner as in Example 39 except for using 0.3 wt. part of Particles 1-A and 0.3 wt. part of Particles 1-C instead of 0.5 wt. part of Particles 1-A.

EXAMPLE 74

Toner No. 74 was prepared in the same manner as in Example 39 except for using 0.1 wt. part of Particles 2-A and 0.1 wt. part of Particles 2-C instead of 0.15 wt. part of Particles 2-A.

EXAMPLE 75

Toner No. 75 was prepared in the same manner as Toner No. 39 in Example 39 except that Toner particles (23) were simultaneously blended with Particles 1-A, Particles 2-A and Silica-A in the HENSCHEL MIXER at 3000 rpm for 5 min. The prescriptions and properties of Toner No. 75 are shown in Tables 19 and 20, respectively, together with those of the toners prepared in the following Examples.

EXAMPLE 76

Toner No. 76 was prepared in the same manner as in Example 39 except that 0.25 wt. part of amorphous dialkylsalicylic acid aluminum complex compound 4A was blended for dispersion with Toner particles (23) simultaneously with particles 1-A. The amorphous dialkylsalicylic acid aluminum (Al) complex compound was confirmed to show an X-ray diffraction pattern free from any peak exhibiting a measurement intensity of at least $10^4$ cps and a half-value half-width of at most 0.3 deg. in a measurement angle 2θ range of 6–40 deg.

EXAMPLES 77–84

Toners Nos. 77–84 were prepared in the same manner as in Example 76 except for using aromatic compounds shown in Table 14, i.e., dialkylsalicylic acid Zr complex compound 4B, dialkylsalicylic acid Cr complex compound 4C, monoazo Fe complex compound 4D and monoazo Fe complex compound 4E, respectively, instead of the amorphous dialkylsalicylic acid Al compound. Each of the Zr complex compound 4B, Cr complex compound 4C and Fe complex compound 4D exhibited amorphousness as confirmed by exhibiting an X-ray diffraction pattern free from any peak exhibiting a measurement intensity of at least $10^4$ cps and a half-value half-width of at most 0.3 deg. in a measurement angle 2θ range of 6–40 deg., while the Fe complex compound 4E exhibited crystallinity as confirmed by an X-ray diffraction pattern showing a maximum peak showing a measurement intensity of $1.5\times10^4$ cps at 2θ=15.6 deg. and a half-value half-width of 0.13 deg.

TABLE 13

| | Toner particles | | | | | | | | |
|---|---|---|---|---|---|---|---|---|---|
| | Size distribution | | DSC peak | | | | | Shape factors | |
| | D4 | N | Tmp | $W_{1/2}$ | | Av | T | | |
| Name | (μm) | (≦4 μm) % | (° C.) | (° C.) | Mp | (mgKOH/g) | (mC/kg) | SF-1 | SF-2 |
| (23) | 7.0 (μm) | 8.3 | 73 | 3.2 | 21000 | 4.2 | −58 | 109 | 104 |
| (24) | 7.6 | 3.1 | 73 | 3.2 | 22000 | 4 | −49 | 110 | 104 |
| (25) | 8.3 | 2.8 | 73 | 3.2 | 23000 | 4.2 | −46 | 112 | 105 |
| (26) | 3.9 | 67.0 | 73 | 3.2 | 22000 | 4.3 | −78 | 109 | 105 |
| (27) | 6.6 | 22.0 | 73 | 3.2 | 21000 | 4.1 | −77 | 110 | 105 |
| (28) | 7.1 | 8.2 | 65 | 2.8 | 21000 | 4.3 | −54 | 110 | 104 |
| (29) | 7.2 | 8.1 | 87 | 4.0 | 23000 | 4.4 | −59 | 109 | 103 |
| (30) | 7.2 | 8.2 | 95 | 4.7 | 20000 | 4.3 | −51 | 113 | 106 |
| (31) | 7.2 | 8.2 | 75 | 14 | 22000 | 4.2 | −51 | 110 | 106 |
| (32) | 7.3 | 7.4 | 73 | 3.2 | 12000 | 4.2 | −53 | 111 | 106 |
| (33) | 7.0 | 8.7 | 73 | 3.2 | 17000 | 4.1 | −53 | 110 | 104 |
| (34) | 7.4 | 8.0 | 73 | 3.2 | 27000 | 4.1 | −50 | 112 | 105 |
| (35) | 7.3 | 8.2 | 73 | 3.2 | 32000 | 4.2 | −60 | 111 | 105 |
| (36) | 7.3 | 7.5 | 73 | 3.2 | 21000 | 8.3 | −56 | 110 | 104 |
| (37) | 7.3 | 7.2 | 73 | 3.2 | 23000 | 11.5 | −57 | 109 | 103 |
| (38) | 7.2 | 7.3 | 73 | 3.2 | 23000 | 18 | −52 | 111 | 106 |
| (39) | 7.2 | 8.0 | 73 | 3.2 | 21000 | 1.5 | −59 | 119 | 115 |
| (40) | 7.1 | 8.2 | 73 | 3.2 | 23000 | 1.7 | −61 | 162 | 138 |
| (41) | 7.0 | 8.0 | 73 | 3.2 | 22000 | 1.6 | −69 | 171 | 146 |
| (42) | 7.1 | 8.4 | 73 | 3.2 | 22000 | 14 | −62 | 119 | 112 |

TABLE 14

| Aromatic compounds | |
|---|---|
| Name | Composition |
| 4A | amorphous dialkyl salicylic acid Al complex compound |
| 4B | amorphous dialkylsalicylic acid Zr complex compound |
| 4C | amorphous dialkylsalicylic acid Cr complex compound |

TABLE 14-continued

| Aromatic compounds | |
|---|---|
| Name | Composition |
| 4D | amorphous monoazo Fe complex compound |
| 4E | crystalline monoazo Fe complex compound |

TABLE 15

| Toners | | | | | | | | | | | | | | | | | |
|---|---|---|---|---|---|---|---|---|---|---|---|---|---|---|---|---|---|
| | | Toner | Particles | | Particles | | Silica | | Size distribution | | DSC peak | | | | | Shape | |
| Example | Toner | particles | | wt. parts | | wt. parts | | wt. parts | D4 (μm) | N (≦4 μm) % | Tmp (° C.) | $W_{1/2}$ (° C.) | Mp | Av (mgKOH/g) | T (mC/kg) | factors SF-1 | SF-2 |
| 39 | No. 39 | 23 | 1-A | 0.5 | 2-A | 0.15 | A | 1.0 | 7.0 | 8.3 | 73 | 3.2 | 21000 | 4.2 | −60 | 107 | 104 |
| 40 | No. 40 | 23 | 1-B | 0.5 | 2-A | 0.15 | A | 1.0 | ↓ | ↓ | ↓ | ↓ | ↓ | ↓ | −57 | ↓ | ↓ |
| 41 | No. 41 | 23 | 1-C | 0.5 | 2-A | 0.15 | A | 1.0 | ↓ | ↓ | ↓ | ↓ | ↓ | ↓ | −56 | ↓ | ↓ |
| 42 | No. 42 | 23 | 1-D | 0.5 | 2-A | 0.15 | A | 1.0 | ↓ | ↓ | ↓ | ↓ | ↓ | ↓ | −51 | ↓ | ↓ |
| 43 | No. 43 | 23 | 1-E | 0.5 | 2-A | 0.15 | A | 1.0 | ↓ | ↓ | ↓ | ↓ | ↓ | ↓ | −59 | ↓ | ↓ |
| 44 | No. 44 | 23 | 1-F | 0.5 | 2-A | 0.15 | A | 1.0 | ↓ | ↓ | ↓ | ↓ | ↓ | ↓ | −50 | ↓ | ↓ |
| 45 | No. 45 | 23 | 1-L | 0.5 | 2-A | 0.15 | A | 1.0 | ↓ | ↓ | ↓ | ↓ | ↓ | ↓ | −62 | ↓ | ↓ |
| Comp.. 12 | Comp. No. 12 | 23 | 1-G | 0.5 | 2-A | 0.15 | A | 1.0 | ↓ | ↓ | ↓ | ↓ | ↓ | ↓ | −60 | ↓ | ↓ |
| Comp. 13 | Comp. No. 13 | 23 | 1-H | 0.5 | 2-A | 0.15 | A | 1.0 | ↓ | ↓ | ↓ | ↓ | ↓ | ↓ | −56 | ↓ | ↓ |
| Comp. 14 | Comp. No. 14 | 23 | 1-I | 0.5 | 2-A | 0.15 | A | 1.0 | ↓ | ↓ | ↓ | ↓ | ↓ | ↓ | −55 | ↓ | ↓ |
| Comp. 15 | Comp. No. 15 | 23 | 1-J | 0.5 | 2-A | 0.15 | A | 1.0 | ↓ | ↓ | ↓ | ↓ | ↓ | ↓ | −60 | ↓ | ↓ |
| Comp. 16 | Comp. No. 16 | 23 | 1-K | 0.5 | 2-A | 0.15 | A | 1.0 | ↓ | ↓ | ↓ | ↓ | ↓ | ↓ | −58 | ↓ | ↓ |
| Comp. 17 | Comp. No. 17 | 23 | — | — | 2-A | 0.15 | A | 1.0 | ↓ | ↓ | ↓ | ↓ | ↓ | ↓ | −57 | ↓ | ↓ |
| Comp. 18 | Comp. No. 18 | 23 | 1-A | 0.5 | — | — | A | 1.0 | ↓ | ↓ | ↓ | ↓ | ↓ | ↓ | −59 | ↓ | ↓ |
| Comp. 19 | Comp. No. 19 | 23 | 1-A | 0.5 | 2-A | 1.0 | — | — | ↓ | ↓ | ↓ | ↓ | ↓ | ↓ | −50 | ↓ | ↓ |

TABLE 16

| Toners | | | | | | | | | | | | | | | | | |
|---|---|---|---|---|---|---|---|---|---|---|---|---|---|---|---|---|---|
| | | Toner | Particles | | Particles | | Silica | | Size distribution | | DSC peak | | | | | Shape | |
| Example | Toner | particles | | wt. parts | | wt. parts | | wt. parts | D4 (μm) | N (≦4 μm) % | Tmp (° C.) | $W_{1/2}$ (° C.) | Mp | Av (mgKOH/g) | T (mC/kg) | factors SF-1 | SF-2 |
| 46 | No. 46 | 23 | 1-A | 0.5 | 2-B | 0.15 | A | 1.0 | 7.0 | 8.3 | 73 | 3.2 | 21000 | 4.2 | −62 | 109 | 104 |
| 47 | No. 47 | 23 | 1-A | 0.5 | 2-C | 0.15 | A | 1.0 | ↓ | ↓ | ↓ | ↓ | ↓ | ↓ | −59 | ↓ | ↓ |
| 48 | No. 48 | 23 | 1-A | 0.5 | 2-D | 0.15 | A | 1.0 | ↓ | ↓ | ↓ | ↓ | ↓ | ↓ | −60 | ↓ | ↓ |
| 49 | No. 49 | 23 | 1-A | 0.5 | 2-E | 0.15 | A | 1.0 | ↓ | ↓ | ↓ | ↓ | ↓ | ↓ | −59 | ↓ | ↓ |
| 50 | No. 50 | 23 | 1-A | 0.5 | 2-F | 0.15 | A | 1.0 | ↓ | ↓ | ↓ | ↓ | ↓ | ↓ | −61 | ↓ | ↓ |
| 51 | No. 51 | 23 | 1-A | 0.5 | 2-G | 0.15 | A | 1.0 | ↓ | ↓ | ↓ | ↓ | ↓ | ↓ | −56 | ↓ | ↓ |
| Comp.. 20 | Comp. No. 20 | 23 | 1-A | 0.5 | 2-H | 0.15 | A | 1.0 | ↓ | ↓ | ↓ | ↓ | ↓ | ↓ | −66 | ↓ | ↓ |
| Comp.. 21 | Comp. No. 21 | 23 | 1-A | 0.5 | 2-I | 0.15 | A | 1.0 | ↓ | ↓ | ↓ | ↓ | ↓ | ↓ | −60 | ↓ | ↓ |
| 52 | No. 52 | 23 | 1-A | 0.5 | 2-A | 0.15 | B | 1.0 | ↓ | ↓ | ↓ | ↓ | ↓ | ↓ | −63 | ↓ | ↓ |
| 53 | No. 53 | 23 | 1-A | 0.5 | 2-A | 0.15 | C | 1.0 | ↓ | ↓ | ↓ | ↓ | ↓ | ↓ | −65 | ↓ | ↓ |
| Comp. 22 | Comp. No. 22 | 23 | 1-A | 0.5 | 2-A | 0.15 | D | 1.0 | ↓ | ↓ | ↓ | ↓ | ↓ | ↓ | −66 | ↓ | ↓ |

TABLE 17

| Toners | | | | | | | | | | | | | | | | | |
|---|---|---|---|---|---|---|---|---|---|---|---|---|---|---|---|---|---|
| | | Toner | Particles | | Particles | | Silica | | Size distribution | | DSC peak | | | | | Shape | |
| Example | Toner | particles | | wt. parts | | wt. parts | | wt. parts | D4 (μm) | N (≦4 μm) % | Tmp (° C.) | $W_{1/2}$ (° C.) | Mp | Av (mgKOH/g) | T (mC/kg) | factors SF-1 | factors SF-2 |
| 54 | No. 54 | 24 | 1-A | 0.5 | 2-A | 0.15 | A | 1.0 | 7.6 | 3.1 | 73 | 3.2 | 22000 | 4 | −51 | 110 | 104 |
| 55 | No. 55 | 25 | 1-A | 0.5 | 2-A | 0.15 | A | 1.0 | 8.3 | 2.8 | 73 | 3.2 | 23000 | 4.2 | −49 | 112 | 105 |
| 56 | No. 56 | 26 | 1-A | 0.5 | 2-A | 0.15 | A | 1.0 | 3.9 | 67.0 | 73 | 3.2 | 22000 | 4.3 | −79 | 109 | 105 |
| 57 | No. 57 | 27 | 1-A | 0.5 | 2-A | 0.15 | A | 1.0 | 6.6 | 22.0 | 73 | 3.2 | 21000 | 4.1 | −78 | 110 | 105 |
| 58 | No. 58 | 28 | 1-A | 0.5 | 2-A | 0.15 | A | 1.0 | 7.1 | 8.2 | 65 | 2.8 | 21000 | 4.3 | −56 | 110 | 104 |
| 59 | No. 59 | 29 | 1-A | 0.5 | 2-A | 0.15 | A | 1.0 | 7.2 | 8.1 | 87 | 4.0 | 23000 | 4.4 | −61 | 109 | 103 |
| 60 | No. 60 | 30 | 1-A | 0.5 | 2-A | 0.15 | A | 1.0 | 7.2 | 8.2 | 75 | 4.7 | 20000 | 4.3 | −54 | 113 | 106 |
| 61 | No. 61 | 31 | 1-A | 0.5 | 2-A | 0.15 | A | 1.0 | 7.2 | 8.2 | 75 | 14 | 22000 | 4.2 | −55 | 110 | 106 |
| 62 | No. 62 | 32 | 1-A | 0.5 | 2-A | 0.15 | A | 1.0 | 7.3 | 7.4 | 73 | 3.2 | 12000 | 4.2 | −56 | 111 | 106 |
| 63 | No. 63 | 33 | 1-A | 0.5 | 2-A | 0.15 | A | 1.0 | 7.0 | 8.7 | 73 | 3.2 | 17000 | 4.1 | −57 | 110 | 104 |
| 64 | No. 64 | 34 | 1-A | 0.5 | 2-A | 0.15 | A | 1.0 | 7.4 | 8.0 | 73 | 3.2 | 27000 | 4.1 | −53 | 112 | 105 |
| 65 | No. 65 | 35 | 1-A | 0.5 | 2-A | 0.15 | A | 1.0 | 7.3 | 8.2 | 73 | 3.2 | 32000 | 4.2 | −61 | 111 | 105 |

TABLE 18

| Toners | | | | | | | | | | | | | | | | | |
|---|---|---|---|---|---|---|---|---|---|---|---|---|---|---|---|---|---|
| | | Toner | Particles | | Particles | | Silica | | Size distribution | | DSC peak | | | | | Shape | |
| Example | Toner | particles | | wt. parts | | wt. parts | | wt. parts | D4 (μm) | N (≦4 μm) % | Tmp (° C.) | $W_{1/2}$ (° C.) | Mp | Av (mgKOH/g) | T (mC/kg) | factors SF-1 | factors SF-2 |
| 66 | No. 66 | 36 | 1-A | 0.5 | 2-A | 0.15 | A | 1.0 | 7.3 | 7.5 | 73 | 3.2 | 21000 | 8.3 | −59 | 110 | 104 |
| 67 | No. 67 | 37 | 1-A | 0.5 | 2-A | 0.15 | A | 1.0 | 7.3 | 7.2 | 73 | 3.2 | 23000 | 11.5 | −59 | 109 | 103 |
| 68 | No. 68 | 38 | 1-A | 0.5 | 2-A | 0.15 | A | 1.0 | 7.2 | 7.3 | 73 | 3.2 | 23000 | 18 | −54 | 111 | 106 |
| 69 | No. 69 | 39 | 1-A | 0.5 | 2-A | 0.15 | A | 1.0 | 7.2 | 8.0 | 73 | 3.2 | 21000 | 1.5 | −61 | 119 | 115 |
| 70 | No. 70 | 40 | 1-A | 0.5 | 2-A | 0.15 | A | 1.0 | 7.1 | 8.2 | 73 | 3.2 | 23000 | 1.7 | −61 | 162 | 138 |
| 71 | No. 71 | 41 | 1-A | 0.5 | 2-A | 0.15 | A | 1.0 | 7.0 | 8.0 | 73 | 3.2 | 22000 | 1.6 | −70 | 172 | 146 |
| 72 | No. 72 | 22 | 1-A | 0.5 | 2-A | 0.15 | A | 1.0 | 7.1 | 8.4 | 73 | 3.2 | 22000 | 14 | −64 | 119 | 112 |
| 73 | No. 73 | 23 | 1-A/ 1-C | 0.3/ 0.3 | 2-A | 0.15 | A | 1.0 | 7.0 | 8.3 | 73 | 3.2 | 21000 | 4.2 | −60 | 109 | 104 |
| 74 | No. 74 | 23 | 1-A | 0.5 | 2-A/ 2-C | 0.1/ 0.1 | A | 1.0 | 7.0 | 8.3 | 73 | 3.2 | 21000 | 4.2 | −62 | 109 | 104 |

TABLE 19

| Toner prescriptions | | | | | | | | | | |
|---|---|---|---|---|---|---|---|---|---|---|
| | | Toner | Particles | | Particles | | Silica | | Aromatic Compound | |
| Example | Toner | particles | | wt. parts | | wt. parts | | wt. parts | Name | amount (wt. parts) |
| 75 | No. 75 | 23 | 1-A | 0.5 | 2-A | 0.15 | A | 1.0 | — | — |
| 76 | No. 76 | 23 | 1-A | 0.5 | 2-A | 0.15 | A | 1.0 | 4-A | 0.25 |
| 77 | No. 77 | 23 | 1-A | 0.5 | 2-A | 0.15 | A | 1.0 | 4-B | 0.25 |
| 78 | No. 78 | 23 | 1-A | 0.5 | 2-A | 0.15 | A | 1.0 | 4-A | 0.002 |
| 79 | No. 79 | 23 | 1-A | 0.5 | 2-A | 0.15 | A | 1.0 | 4-A | 0.005 |
| 80 | No. 80 | 23 | 1-A | 0.5 | 2-A | 0.15 | A | 1.0 | 4-A | 1.0 |
| 81 | No. 81 | 23 | 1-A | 0.5 | 2-A | 0.15 | A | 1.0 | 4-A | 1.5 |
| 82 | No. 82 | 23 | 1-A | 0.5 | 2-A | 0.15 | A | 1.0 | 4-C | 0.25 |
| 83 | No. 83 | 23 | 1-A | 0.5 | 2-A | 0.15 | A | 1.0 | 4-D | 0.3 |
| 84 | No. 84 | 23 | 1-A | 0.5 | 2-A | 0.15 | A | 1.0 | 4-E | 0.3 |

TABLE 20

| Example | Toner properties: Size distribution D4 (μm) | N (≦4 μm) % | DSC peak Tmp (° C.) | $W_{1/2}$ (° C.) | Mp | Av (mgKOH/g) | T (mC/kg) | Shape factors SF-1 | SF-2 |
|---|---|---|---|---|---|---|---|---|---|
| 75 | 7.0 | 8.3 | 73 | 3.2 | 21000 | 4.2 | −62 | 109 | 104 |
| 76 | ↓ | ↓ | ↓ | ↓ | ↓ | ↓ | −65 | ↓ | ↓ |
| 77 | ↓ | ↓ | ↓ | ↓ | ↓ | ↓ | −65 | ↓ | ↓ |
| 78 | ↓ | ↓ | ↓ | ↓ | ↓ | ↓ | −63 | ↓ | ↓ |
| 79 | ↓ | ↓ | ↓ | ↓ | ↓ | ↓ | −63 | ↓ | ↓ |
| 80 | ↓ | ↓ | ↓ | ↓ | ↓ | ↓ | −67 | ↓ | ↓ |
| 81 | ↓ | ↓ | ↓ | ↓ | ↓ | ↓ | −68 | ↓ | ↓ |
| 82 | ↓ | ↓ | ↓ | ↓ | ↓ | ↓ | −64 | ↓ | ↓ |
| 83 | ↓ | ↓ | ↓ | ↓ | ↓ | ↓ | −65 | ↓ | ↓ |
| 84 | ↓ | ↓ | ↓ | ↓ | ↓ | ↓ | −64 | ↓ | ↓ |

(Evaluation)

Each of the above-prepared Toners Nos. 39–84 (Examples 39–84) and Comparative Toners Nos. 12–22 (Comparative Examples 12–22) was evaluated by incorporating it in a commercially available full-color printer ("LBP-2160", mfd. by Canon K.K.) having an organization similar to the one illustrated in FIG. 8, with respect to the following items.

Toner melt-sticking onto the latent image-bearing member (Sticking) in a low humidity environment was evaluated after continuous image formation (printing) of 25% (areal) solid images on 5000 sheets in a low temperature/low humidity environment of 15° C./5% RH in terms of number of white spotty dropouts in a solid image attributable to toner melt-sticking. Incidentally, regarding the melt-sticking dropout defects, 0–2 defects may be judged as excellent; 3–6, good; 7–9, fair; and 10 or more, poor.

Fog (Fog) in a low humidity environment was evaluated after continuous image formation (printing) of 1% (areal) solid images on 5000 sheets in a low temperature/low humidity environment of 15° C./10% RH, by taking a trace of toner at a part on the image-bearing member for forming a solid white image by a cellophane adhesive tape, applying the adhesive tape on white paper and measuring the reflectance to determine a difference from a reflectance of a blank adhesive tape also applied on the white paper by using a reflectometer (mfd. by Tokyo Denshoku K.K.). Incidentally, regarding the fog evaluation, below 10% may be judged excellent; 10% to below 18%, fair; and 18% or higher, poor.

The evaluation results are shown in Tables 21–25 below.

TABLE 21

| Example | Toner No. | Sticking (−) | Fog (%) |
|---|---|---|---|
| 39 | 39 | 0 | 4 |
| 40 | 40 | 0 | 4 |
| 41 | 41 | 0 | 4 |
| 42 | 42 | 2 | 6 |
| 43 | 43 | 2 | 6 |
| 44 | 44 | 0 | 4 |
| 45 | 45 | 0 | 4 |
| Comp. 12 | Comp. 12 | 25 | 26 |
| 13 | 13 | 22 | 23 |
| 14 | 14 | 20 | 20 |
| 15 | 15 | 21 | 24 |
| 16 | 16 | 15 | 23 |
| 17 | 17 | 21 | 21 |

TABLE 21-continued

| Example | Toner No. | Sticking (−) | Fog (%) |
|---|---|---|---|
| 18 | 18 | 18 | 20 |
| 19 | 19 | 18 | 23 |

TABLE 22

| Example | Toner No. | Sticking (−) | Fog (%) |
|---|---|---|---|
| 46 | 46 | 0 | 6 |
| 47 | 47 | 0 | 4 |
| 48 | 48 | 0 | 6 |
| 49 | 49 | 2 | 7 |
| 50 | 50 | 0 | 4 |
| 51 | 51 | 2 | 7 |
| Comp. 20 | Comp. 20 | 24 | 23 |
| Comp. 21 | Comp. 21 | 20 | 20 |
| 52 | 52 | 0 | 4 |
| 53 | 53 | 0 | 6 |
| Comp. 22 | Comp. 22 | 18 | 25 |

TABLE 23

| Example | Toner No. | Sticking (−) | Fog (%) |
|---|---|---|---|
| 54 | 54 | 0 | 6 |
| 55 | 55 | 0 | 6 |
| 56 | 56 | 4 | 8 |
| 57 | 57 | 2 | 7 |
| 58 | 58 | 0 | 6 |
| 59 | 59 | 0 | 6 |
| 60 | 60 | 3 | 8 |
| 61 | 61 | 3 | 9 |
| 62 | 62 | 2 | 7 |
| 63 | 63 | 0 | 6 |
| 64 | 64 | 0 | 6 |
| 65 | 65 | 0 | 7 |

TABLE 24

| Example | Toner No. | Sticking (−) | Fog (%) |
|---|---|---|---|
| 66 | 66 | 0 | 6 |
| 67 | 67 | 2 | 6 |
| 68 | 68 | 2 | 7 |

TABLE 24-continued

| Example | Toner No. | Sticking (–) | Fog (%) |
|---|---|---|---|
| 69 | 69 | 2 | 6 |
| 70 | 70 | 3 | 7 |
| 71 | 71 | 5 | 9 |
| 72 | 72 | 3 | 8 |
| 73 | 73 | 0 | 4 |
| 74 | 74 | 0 | 4 |

TABLE 25

| Example | Toner No. | Sticking (–) | Fog (%) |
|---|---|---|---|
| 75 | 75 | 9 | 10 |
| 76 | 76 | 0 | 2 |
| 77 | 77 | 0 | 2 |
| 78 | 78 | 0 | 4 |
| 79 | 79 | 0 | 3 |
| 80 | 80 | 0 | 3 |
| 81 | 81 | 0 | 4 |
| 82 | 82 | 0 | 3 |
| 83 | 83 | 0 | 3 |
| 84 | 84 | 0 | 4 |

EXAMPLES 85–122 AND COMPARATIVE EXAMPLES 23–33

Each of the above-prepared Toners Nos. 1–38 and Comparative Toners Nos. 1–11 was evaluated by incorporating it into an image forming apparatus having an organization similar to the one illustrated in FIG. 8 obtained by remodeling a commercially available full-color printer ("LBP-2160", mfd. by Canon K.K.) so as to provide a rotation peripheral speed of the developing sleeve of 400 mm/sec and include an elastic blade having a polyamide-containing rubber layer with a Shore D hardness of 50 deg. as a toner application blade. The developing conditions included: an AC bias voltage of Vpp=1700 volts and f=3400 Hz and a DC bias voltage of $|V_{DC}|$=300–450 volts so as to provide |Vback|=220±20 volts, a gap between the developing sleeve and the photosensitive drum of 270 μm, and a toner layer thickness on the developing sleeve of 20±10 μm.

Toner melt-sticking onto the latent image-bearing member (Sticking), Roughening of halftone images (Halftone) and Fog (Fog) were evaluated after continuous image formation (printing) of 4% (areal) line images on 5000 sheets in a low temperature/low humidity environment of 15° C./5% RH.

Toner melt-sticking onto the latent image-bearing member (Sticking) was evaluated in terms of number of white spotty dropouts in a solid image attributable to toner melt-sticking.

Roughening of halftone images (Halftone) was evaluated based on a halftone image of 600 dpi showing a reflection density of 0.6 at four levels of A, AB, B and C.

Fog (Fog, LT/LH) was evaluated by taking a trace of toner at a part on the image-bearing member for forming a solid white image by a cellophane adhesive tape, applying the adhesive tape on white paper and measuring the reflectance to determine a difference from a reflectance of a blank adhesive tape also applied on the white paper by using a reflectometer (mfd. by Tokyo Denshoku K.K.).

Toner blot-down (Blot-down, NT/NH) during a large number of continuous image formation was evaluated after continuous formation of 1% (areal) line images on 20,000 sheets by counting a number of toner spots appearing in the halftone images in an environment of 23° C./50% RH.

Fog (Fog, NT/NH) was also evaluated in an environment of 23° C./150% RH after continuous formation of 1% (areal) line images on 10,000 sheets by taking a trace of toner on the image-bearing member in the same manner as Fog (LT/LH).

Retransfer (Retransfer) was evaluated after continuous image formation (printing) of 4% areal line images in high temperature/high humidity environment of 32.5° C./95% RH. More specifically, a cyan toner cartridge was installed within a first developing device (at the position of 4Bk in FIG. 8), and a cyan color image formation of a halftone image was repeated by a four-color mode (including 4 transfer steps) and by a single color mode (including one transfer step, whereby the degree of retransfer was evaluated as a difference in reflection density between the resultant halftone image according to the two modes.

Toner blot-down (Blot-down after 50° C.) was evaluated by storing a sample toner in an environment of 50° C. for one week and then using the toner for printing out of the halftone image in an environment of 15° C./5% RH, whereby the degree of Blot-down was evaluated by a number of toner spots appearing in the image.

The results of the above evaluation are inclusively shown in Tables 26–29.

TABLE 26

| | | Evaluation results | | | | | | |
|---|---|---|---|---|---|---|---|---|
| | | NT/NH | | | | | | |
| Example | Toner | Sticking (–) | Blot-down (–) | Fog (%) | Half-tone | LT/LH Fog (%) | Re-transfer | Blot-down (–) after 50° C. |
| 85 | No. 1 | 0 | 0 | 2 | A | 0.4 | 0.04 | 0 |
| 86 | No. 2 | 0 | 0 | 2 | A | 0.3 | 0.04 | 0 |
| 87 | No. 3 | 0 | 0 | 2 | A | 0.4 | 0.03 | 0 |
| 88 | No. 4 | 3 | 0 | 3 | A | 0.5 | 0.06 | 0 |
| 89 | No. 5 | 3 | 0 | 3 | A | 0.6 | 0.06 | 0 |
| 90 | No. 6 | 0 | 0 | 2 | A | 0.4 | 0.04 | 0 |
| 91 | No. 7 | 1 | 0 | 2 | AB | 0.4 | 0.04 | 0 |
| Comp. 23 | Comp. No. 1 | 23 | 15 | 28 | B | 2.4 | 0.16 | 15 |

TABLE 26-continued

| | | Evaluation results | | | | | | |
|---|---|---|---|---|---|---|---|---|
| | | | NT/NH | | | | | |
| Example | Toner | Sticking (–) | Blot-down (–) | Fog (%) | Half-tone | LT/LH Fog (%) | Re-transfer | Blot-down (–) after 50° C. |
| Comp. 24 | Comp. No. 2 | 16 | 11 | 25 | B | 2.1 | 0.14 | 11 |
| Comp. 25 | Comp. No. 3 | 18 | 13 | 31 | A | 3.2 | 0.28 | 14 |
| Comp. 26 | Comp. No. 4 | 26 | 26 | 35 | B | 2.8 | 0.17 | 23 |
| Comp. 27 | Comp. No. 5 | 21 | 18 | 31 | B | 2.0 | 0.14 | 14 |
| Comp. 28 | Comp. No. 6 | 16 | 15 | 27 | B | 1.5 | 0.16 | 14 |
| Comp. 29 | Comp. No. 7 | 18 | 17 | 32 | B | 2.0 | 0.18 | 16 |
| Comp. 30 | Comp. No. 8 | 17 | 18 | 31 | B | 1.9 | 0.20 | 18 |

TABLE 27

| | | Evaluation results | | | | | | |
|---|---|---|---|---|---|---|---|---|
| | | | NT/NH | | | | | |
| Example | Toner | Sticking (–) | Blot-down (–) | Fog (%) | Half-tone | LT/LH Fog (%) | Re-transfer | Blot-down (–) after 50° C. |
| 92 | No. 8 | 0 | 0 | 4 | A | 0.4 | 0.04 | 0 |
| 93 | No. 9 | 0 | 0 | 3 | A | 0.3 | 0.05 | 0 |
| 94 | No. 10 | 0 | 0 | 4 | A | 0.4 | 0.04 | 0 |
| 95 | No. 11 | 4 | 2 | 8 | AB | 0.8 | 0.07 | 3 |
| 96 | No. 12 | 0 | 0 | 4 | A | 0.4 | 0.04 | 0 |
| 97 | No. 13 | 4 | 2 | 9 | AB | 0.9 | 0.09 | 4 |
| 98 | No. 14 | 0 | 0 | 4 | A | 0.4 | 0.04 | 0 |
| 99 | No. 15 | 0 | 0 | 5 | A | 0.5 | 0.04 | 0 |
| Comp. 31 | Comp. No. 9 | 27 | 19 | 31 | B | 1.8 | 0.16 | 18 |
| Comp. 32 | Comp. No. 10 | 17 | 13 | 28 | B | 1.6 | 0.14 | 12 |
| Comp. 33 | Comp. No. 11 | 21 | 19 | 37 | B | 3.1 | 0.16 | 15 |

TABLE 28

| | | Evaluation results | | | | | | |
|---|---|---|---|---|---|---|---|---|
| | | | NT/NH | | | | | |
| Example | Toner | Sticking (–) | Blot-down (–) | Fog (%) | Half-tone | LT/LH Fog (%) | Re-transfer | Blot-down (–) after 50° C. |
| 100 | No. 16 | 0 | 0 | 4 | A | 0.4 | 0.04 | 0 |
| 101 | No. 17 | 0 | 0 | 4 | A | 0.6 | 0.08 | 0 |
| 102 | No. 18 | 8 | 2 | 9 | AB | 0.9 | 0.09 | 3 |
| 103 | No. 19 | 4 | 0 | 6 | AB | 0.6 | 0.06 | 0 |
| 104 | No. 20 | 0 | 0 | 4 | A | 0.3 | 0.04 | 0 |
| 105 | No. 21 | 0 | 0 | 4 | A | 0.4 | 0.04 | 0 |
| 106 | No. 22 | 5 | 2 | 7 | AB | 0.9 | 0.09 | 0 |
| 107 | No. 23 | 7 | 3 | 13 | A | 0.7 | 0.06 | 3 |
| 108 | No. 24 | 4 | 2 | 11 | AB | 0.8 | 0.08 | 5 |
| 109 | No. 25 | 0 | 0 | 4 | A | 0.3 | 0.05 | 0 |
| 110 | No. 26 | 0 | 0 | 4 | A | 0.3 | 0.04 | 0 |
| 111 | No. 27 | 0 | 0 | 5 | A | 0.4 | 0.04 | 0 |

TABLE 29

| Example | Toner | Evaluation results: Sticking (–) | NT/NH: Blot-down (–) | Fog (%) | Half-tone | LT/LH Fog (%) | Re-transfer | Blot-down (–) after 50° C. |
|---|---|---|---|---|---|---|---|---|
| 112 | No. 28 | 0 | 0 | 3 | A | 0.4 | 0.05 | 0 |
| 113 | No. 29 | 3 | 0 | 5 | AB | 0.7 | 0.07 | 0 |
| 114 | No. 30 | 5 | 0 | 6 | AB | 1.0 | 0.08 | 0 |
| 115 | No. 31 | 0 | 0 | 4 | A | 0.8 | 0.08 | 0 |
| 116 | No. 32 | 7 | 2 | 8 | AB | 0.9 | 0.05 | 3 |
| 117 | No. 33 | 3 | 0 | 4 | A | 0.6 | 0.06 | 0 |
| 118 | No. 34 | 5 | 0 | 5 | A | 0.8 | 0.07 | 0 |
| 119 | No. 35 | 8 | 3 | 10 | AB | 1.0 | 0.10 | 3 |
| 120 | No. 36 | 5 | 2 | 9 | A | 0.9 | 0.09 | 2 |
| 121 | No. 37 | 0 | 0 | 3 | A | 0.3 | 0.05 | 0 |
| 122 | No. 38 | 0 | 0 | 3 | A | 0.3 | 0.05 | 0 |

EXAMPLES 123–128

Toner No. 1 was evaluated in image forming apparatus each having an organization similar to the one illustrated in FIG. 8 and obtained by remodeling a commercially available full-color printer ("LBP-2160", mfd. by Canon K.K.) so as to provide a rotation peripheral speed of the developing sleeve and include a toner application blade as shown in Table 30 below, otherwise in the same manner as in Examples 85–122.

The evaluation results are shown in Table 31.

TABLE 30

| Example | Toner No. | Developing sleeve speed (mm/sec) | Toner application blade: Material | Shore D hardness |
|---|---|---|---|---|
| 123 | 1 | 100 | polyamide elastomer | 25 deg. |
| 124 | 1 | 200 | polyamide elastomer | 40 deg. |
| 125 | 1 | 500 | polyamide elastomer | 50 deg. |
| 126 | 1 | 700 | polyamide elastomer | 65 deg. |
| 127 | 1 | 800 | polyamide elastomer | 70 deg. |

TABLE 31

| Example | Toner | Evaluation results: Sticking (–) | NT/NH: Blot-down (–) | Fog (%) | Half-tone | LT/LH Fog (%) | Re-transfer | Blot-down (–) after 50° C. |
|---|---|---|---|---|---|---|---|---|
| 123 | No. 1 | 0 | 0 | 4 | A | 0.5 | 0.04 | 2 |
| 124 | No. 1 | 0 | 0 | 2 | A | 0.4 | 0.04 | 0 |
| 125 | No. 1 | 0 | 0 | 1 | A | 0.2 | 0.03 | 0 |
| 126 | No. 1 | 0 | 0 | 2 | A | 0.4 | 0.04 | 0 |
| 127 | No. 1 | 0 | 0 | 6 | A | 0.5 | 0.04 | 2 |

EXAMPLES 128–165 AND COMPARATIVE EXAMPLES 34–44

Each of Toners Nos. 1–38 and Comparative toners Nos. 1–11 was evaluated by image formation on A4-size recording paper having a basis weight of 80 g/cm$^2$ by using an image forming apparatus having an organization as illustrated in FIG. 10 obtained by remodeling a commercially available full-color machine ("CLC-1000", mfd. by Canon K.K.) so as to include a developing device as shown in FIG. 5 adapted to a mono-component development scheme under developing conditions as in Example 85. The evaluation was performed with respect to the following items.

Toner melt-sticking onto the latent image-bearing member (Sticking), Roughening of halftone images (Halftone) and Fog (Fog) were evaluated after continuous image formation (printing) of 4% (areal) line images on 5000 sheets in a low temperature/low humidity environment of 15° C./5% RH.

Toner melt-sticking onto the latent image-bearing member (Sticking) was evaluated in terms of number of white spotty dropouts in a solid image attributable to toner melt-sticking.

Roughening of halftone images (Halftone) was evaluated based on a halftone image of 600 dpi showing a reflection density of 0.6 at four levels of A, AB, B and C.

Fog (Fog) was evaluated by taking a trace of toner at a part on the image-bearing member for forming a solid white image by a cellophane adhesive tape, applying the adhesive type on white paper and measuring the reflectance to determine a difference from a reflectance of a blank adhesive tape also applied on the white paper by using a reflectometer (mfd. by Tokyo Denshoku K.K.).

Retransfer (Retransfer) was evaluated after continuous image formation (printing) of 4%-areal line images in high temperature/high humidity environment of 32.5° C./95% RH. More specifically, a cyan toner cartridge was installed within a first developing device, and a cyan color image formation of a halftone image was repeated by a four-color mode (including 4 transfer steps) and by a single color mode (including one transfer step, whereby the degree of retransfer was evaluated as a difference in reflection density between the resultant halftone image according to the two modes.

Toner blot-down (Blot-down) was evaluated by storing a sample toner in an environment of 50° C. for one week and then using the toner for printing out of the halftone image in an environment of 15° C./5% RH, whereby the degree of Blot down was evaluated by a number of toner spots appearing in the image.

The results of the above evaluation are inclusively shown in Tables 32–35.

TABLE 32

| Example | Toner No. | Evaluation results: Sticking (–) | Half-tone | Fog | Re-transfer | Blot-down (–) |
|---|---|---|---|---|---|---|
| 128 | 1 | 0 | A | 0.2 | 0.01 | 0 |
| 129 | 2 | 0 | A | 0.2 | 0.01 | 0 |
| 130 | 3 | 0 | A | 0.2 | 0.01 | 0 |
| 131 | 4 | 1 | A | 0.4 | 0.02 | 0 |
| 132 | 5 | 2 | A | 0.5 | 0.03 | 0 |
| 133 | 6 | 0 | A | 0.3 | 0.01 | 0 |
| 134 | 7 | 1 | AB | 0.2 | 0.01 | 0 |
| Comp. 34 | Comp. 1 | 17 | B | 2.2 | 0.11 | 12 |
| Comp. 35 | Comp. 2 | 13 | B | 1.6 | 0.10 | 9 |
| Comp. 36 | Comp. 3 | 13 | A | 3.1 | 0.24 | 10 |
| Comp. 37 | Comp. 4 | 22 | B | 2.6 | 0.12 | 20 |
| Comp. 38 | Comp. 5 | 18 | B | 1.7 | 0.10 | 12 |
| Comp. 39 | Comp. 6 | 13 | B | 1.4 | 0.12 | 10 |
| Comp. 40 | Comp. 7 | 15 | B | 1.7 | 0.13 | 11 |
| Comp. 41 | Comp. 8 | 13 | B | 1.6 | 0.15 | 13 |

TABLE 33

| Example | Toner No. | Sticking (–) | Half-tone | Fog | Re-transfer | Blot-down (–) |
|---|---|---|---|---|---|---|
| 135 | 8 | 0 | A | 0.2 | 0.01 | 0 |
| 136 | 9 | 0 | A | 0.2 | 0.01 | 0 |
| 137 | 10 | 0 | A | 0.2 | 0.01 | 0 |
| 138 | 11 | 2 | AB | 0.5 | 0.03 | 2 |
| 139 | 12 | 0 | A | 0.3 | 0.01 | 0 |
| 140 | 13 | 2 | AB | 0.6 | 0.04 | 1 |
| 141 | 14 | 0 | A | 0.2 | 0.01 | 0 |
| 142 | 15 | 0 | A | 0.3 | 0.01 | 0 |
| Comp. 42 | Comp. 9 | 18 | B | 1.4 | 0.11 | 14 |
| Comp. 43 | Comp. 10 | 12 | B | 1.2 | 0.10 | 9 |
| Comp. 44 | Comp. 11 | 14 | B | 2.9 | 0.10 | 11 |

TABLE 34

| Example | Toner No. | Sticking (–) | Half-tone | Fog | Re-transfer | Blot-down (–) |
|---|---|---|---|---|---|---|
| 143 | 16 | 0 | A | 0.2 | 0.01 | 0 |
| 144 | 17 | 0 | A | 0.2 | 0.04 | 0 |
| 145 | 18 | 5 | AB | 0.6 | 0.05 | 1 |
| 146 | 19 | 3 | AB | 0.5 | 0.04 | 0 |
| 147 | 20 | 0 | A | 0.1 | 0.01 | 0 |
| 148 | 21 | 2 | A | 0.2 | 0.01 | 0 |
| 149 | 22 | 4 | AB | 0.6 | 0.05 | 0 |

TABLE 34-continued

| Example | Toner No. | Sticking (–) | Half-tone | Fog | Re-transfer | Blot-down (–) |
|---|---|---|---|---|---|---|
| 150 | 23 | 5 | A | 0.6 | 0.03 | 2 |
| 151 | 24 | 3 | AB | 0.5 | 0.03 | 2 |
| 152 | 25 | 0 | A | 0.1 | 0.01 | 0 |
| 153 | 26 | 0 | A | 0.2 | 0.02 | 0 |
| 154 | 27 | 0 | A | 0.2 | 0.01 | 0 |

TABLE 35

| Example | Toner No. | Sticking (–) | Half-tone | Fog | Re-transfer | Blot-down (–) |
|---|---|---|---|---|---|---|
| 155 | 28 | 0 | A | 0.2 | 0.01 | 0 |
| 156 | 29 | 2 | AB | 0.4 | 0.04 | 0 |
| 157 | 30 | 4 | AB | 0.7 | 0.04 | 0 |
| 158 | 31 | 0 | A | 0.5 | 0.04 | 0 |
| 159 | 32 | 6 | AB | 0.6 | 0.02 | 2 |
| 160 | 33 | 1 | A | 0.4 | 0.03 | 0 |
| 161 | 34 | 4 | A | 0.5 | 0.04 | 0 |
| 162 | 35 | 7 | AB | 0.7 | 0.06 | 3 |
| 163 | 36 | 3 | A | 0.6 | 0.05 | 2 |
| 164 | 37 | 0 | A | 0.2 | 0.02 | 0 |
| 165 | 38 | 0 | A | 0.2 | 0.02 | 0 |

EXAMPLE 166

Toner No. 1 was evaluated in the same manner as in Example 128 except for using recording paper having a basis weight of 64 g/m$^2$ instead of 80 g/m$^2$ The evaluation results are shown in Table 36 together with those of Example 128 and the following Examples and Comparative Examples.

EXAMPLE 167

Toner No. 1 was evaluated in an image forming apparatus having an organization as shown in FIG. 6 obtained by remodeling a commercially available full-color machine ("CLC700", mfd. by Canon K.K.) so as to include a developing device as shown in FIG. 5 adapted to a mono-color developing scheme under developing conditions as in Example 85.

EXAMPLE 168

Toner No. 1 was evaluated in the same manner as in Example 167 except for using recording paper having a basis weight of 64 g/m$^2$ instead of 80 g/m$^2$.

COMPARATIVE EXAMPLE 45

Comparative toner No. 1 instead of Toner No. 1 was evaluated otherwise in the same manner as in Example 167.

COMPARATIVE EXAMPLE 46

Comparative toner No. 1 instead of Toner No. 1 was evaluated otherwise in the same manner as in Example 168.

TABLE 36

| Example | Toner | Test apparatus (Base machine) | Paper ($g/m^2$) | Sticking (–) | Half-tone | Fog | Re-transfer | Blot-down (–) |
|---|---|---|---|---|---|---|---|---|
| 128 | No. 1 | FIG. 10 (CLC1000) | 80 | 0 | A | 0.2 | 0.01 | 0 |
| 166 | No. 1 | FIG. 10 (CLC1000) | 64 | 0 | A | 0.2 | 0.02 | 0 |
| 167 | No. 1 | FIG. 6 (CLC700) | 80 | 0 | A | 0.2 | 0.02 | 1 |
| 168 | No. 1 | FIG. 6 (CLC700) | 64 | 1 | A | 0.4 | 0.06 | 0 |
| Comp. 45 | Comp. No. 1 | FIG. 10 (CLC1000) | 64 | 16 | B | 2.3 | 0.17 | 13 |
| Comp. 46 | Comp. No. 1 | FIG. 6 (CLC700) | 64 | 17 | B | 2.2 | 0.18 | 12 |

To 100 wt. parts of Cyan toner particles (1) prepared in Example 1, 1 wt. part of silica fine particles surface-treated with hexamethyldisilazane (Dp.av=8 nm, "Silica-A"), 0.15 wt part of untreated alumina oxide fine particles (Dp.av=25 nm, "Particles 2-C") and 0.8 wt. part of untreated rutileform titanium oxide fine particles (Dp.av=200 nm, T=–2.1 mC/kg, "Particles 1-A") were added, and the mixture was blended by a HENSCHEL MIXER to obtain Toner No. 85 according to the present invention.

Toner No. 85 exhibited D4=7.3 μm, N (≦4 μm)=8.3%, Tmp=73° C. and $W_{1/2}$=3.2° C. according to DSC, Mp=22000 by GPC, Av=4.1 mgKOH/g, T=–56 mC/kg, SF-1=112 and SF-2=104.

Toner No. 85 was evaluated in the same manner as in Example 1 by using a full-color copying machine ("LBP-2160", mfd. by Canon K.K.) having an organization similar to the one illustrated in FIG. 8. The evaluation results are shown in Table 37 together with those of the following Example.

EXAMPLE 170

Toner No. 86 was prepared in the same manner as Toner No. 85 in Example 169 above except for replacing Particles 2-C with 0.15 wt. part of aluminum oxide fine particles surface-treated with isobutylsilane (Dp.av=25 nm, particles 2-J).

Toner No. 86 exhibited D4=7.3 μm, N (≦4 μm)=8.3%, Tmp=73° C. and $W_{1/2}$=3.2° C. according to DSC, Mp=22000 by GPC, Av=4.1 mgKOH/g, T=–63 mC/kg, SF-1=0.112 and SF-2=104.

Toner No. 86 was evaluated in the same manner as in Example 169.

TABLE 37

| | | | Evaluation results | | | | | | | | | | | |
|---|---|---|---|---|---|---|---|---|---|---|---|---|---|---|
| | | | Particles | | Particles | | Silica | | | | | | | |
| Example | Toner | Toner particles | | wt. parts | | wt. parts | | wt. parts | Sticking (–) | Half-tone | Fog | Re-transfer | Blot-down (–) | Charger soil (–) |
| 169 | No. 35 | (1) | 1-A | 0.4 | 2-C | 0.3 | A | 1.2 | 0 | A | 0.2 | 0.01 | 0 | 0 |
| 170 | No. 36 | (1) | 1-A | 0.4 | 2-J | 0.3 | A | 1.2 | 2 | AB | 0.2 | 0.01 | 0 | 2 |

What is claimed is:

1. An image forming method, comprising:

(I) a step of supplying a nonmagnetic toner onto a toner-carrying member from a supply roller and pressing and triboelectrically charging the nonmagnetic toner on the toner-carrying member with a toner application blade to form a charged layer of the nonmagnetic toner on the toner-carrying member, (II) a step of developing an electrostatic latent image formed on a latent image-bearing member with the nonmagnetic toner on the toner-carrying member to form a developed toner image on the image-bearing member, (III) a step of transferring the toner image onto a transfer material, and (IV) a step of fixing the transferred toner image, wherein the non-magnetic toner comprises: toner particles, and external additives blended with the toner particles and including (1) first inorganic fine particles having an average primary particle size of 80–800 nm of oxide of a metal selected from the group consisting of titanium, aluminum, zinc and zirconium, (2) second inorganic fine particles other than silica having an average primary particle size of below 80 nm and (3) silica fine particles having an average primary particle size of below 30 nm, and wherein the first inorganic fine particles comprise untreated inorganic fine particles, and the second inorganic fine particles comprise hydrophobized inorganic fine particles and untreated inorganic fine particles.

2. The image forming method according to claim 1, wherein the toner-carrying member is rotated at a peripheral speed of 100 –800 mm/sec.

3. The image forming method according to claim 1, wherein the toner-carrying member is rotated at a peripheral speed of 200–700 mm/sec.

4. The image forming method according to claim 1, wherein the toner application blade has a surface layer contacting the toner-carrying member and comprising a polyamide-containing rubber layer.

5. The image forming method according to claim 4, wherein the polyamide-containing rubber layer has a shore D hardness of 25–65 deg.

6. The image forming method according to claim 1, wherein the latent image-bearing member has a photosensitive layer comprising an organic photo conductor, amorphous silicon, selenium or zinc oxide.

7. The image forming method according to claim 1, wherein in the developing step, the toner-carrying member is supplied with a developing bias voltage.

8. The image forming method according to claim 7, wherein the developing bias voltage comprises an AC bias voltage or a pulse bias voltage.

9. The image forming method according to claim 1, wherein the first inorganic fine particles have an average primary particle size of 100–500 nm.

10. The image forming method according to claim 1, wherein the first inorganic fine particles have a chargeability of at most 10 mC/kg in terms of an absolute value.

11. The image forming method according to claim 1, wherein the first inorganic fine particles comprise fine particles of at least one inorganic oxide selected from the group consisting of titanium oxide and aluminum oxide.

12. The image forming method according to claim 1, wherein the second inorganic fine particles have an average primary particle size of at most 70 nm.

13. The image forming method according to claim 1, wherein the second inorganic fine particles have an average primary particle size of 25–70 nm.

14. The image forming method according to claim 1, wherein the second inorganic fine particles comprise fine particles of at least one inorganic oxide selected from the group consisting of titanium oxide and aluminum oxide.

15. The image forming method according to claim 1, wherein the first inorganic fine particles comprise untreated titanium oxide fine particles, and the second inorganic fine particles comprise hydrophobized titanium oxide fine particles and untreated aluminum oxide fine particles.

16. The image forming method according to claim 1, wherein the first inorganic fine particles have an average primary particle size of 100–500 nm, and the second inorganic fine particles have an average primary particle size of at most 70 nm.

17. The image forming method according to claim 1, wherein the first inorganic fine particles have an average primary particle size of 100–500 nm, and the second inorganic fine particles have an average primary particle size of 25–70 nm.

18. The image forming method according to claim 1, wherein the toner contains the first inorganic fine particles in 0.05–5 wt. %, the second inorganic fine particles in 0.01–1.0 wt. %, and the silica fine particles in 0.2–5.0 wt. %, respectively based on the toner particles.

19. The image forming method according to claim 1, wherein the first inorganic fine particles, the second inorganic fine particles and the silica fine particles are contained in wt. ratios of 1:0.01–1:0.1–6.

20. The image forming method according to claim 17, wherein the first inorganic fine particles, the second inorganic fine particles and the silica fine particles are contained in wt. ratios of 1:0.01–1:0.1–6.

21. The image forming method according to claim 1, wherein the silica fine particles have been treated with a silane coupling agent and/or a silicone oil.

22. The image forming method according to claim 1, wherein the toner has a weight-average particle size of 4–8 μm, and contains 3–20% by number of toner particles of 4 μm or smaller.

23. The image forming method according to claim 1, wherein the toner provides a heat-absorption peak in a temperature region of 60–90° C. on a heat-absorption curve on temperature increase according to differential scanning calorimetry.

24. The image forming method according to claim 23, wherein the heat-absorption peak shows a half-value width of at most 10° C.

25. The image forming method according to claim 23, wherein the heat-absorption peak shows a half-value width of at most 6° C.

26. The image forming method according to claim 1, wherein the toner contains a wax providing a heat-absorption peak in a temperature region of 60–90° C. on a heat-absorption curve on temperature increase according to differential scanning calorimetry.

27. The image forming method according to claim 26, wherein the toner contains 0.3–30 wt. % of the wax.

28. The image forming method according to claim 1, wherein the toner contains a homopolymer or copolymer of styrene as a binder resin.

29. The image forming method according to claim 1, wherein the toner contains a THF (tetrahydrofuran) soluble component having a molecular weight distribution giving a peak molecular weight in a region of 15,000–30,000 according to gel permeation chromatography.

30. The image forming method according to claim 1, wherein the toner has an acid value of at most 10 mgKOH/g.

31. The image forming method according to claim 1, wherein the toner has a chargeability of 40–80 mC/kg in terms of an absolute value.

32. The image forming method according to claim 1, wherein the toner has shape factors SF-1 of 100–170 and SF-2 of 100–140.

33. The image forming method according to claim 1, wherein the toner has shape factors SF-1 of 100–120 and SF-2 of 100–115.

34. The image forming method according to claim 1, wherein the toner particles have been produced through steps of dispersing into particles and polymerizing a polymerizable monomer composition comprising at least a polymerizable monomer, a polymerization initiator and a colorant.

35. The image forming method according to claim 1, wherein the toner is a nonmagnetic toner comprising nonmagnetic toner particles containing a dye and/or a pigment as its colorant.

* * * * *

UNITED STATES PATENT AND TRADEMARK OFFICE

CERTIFICATE OF CORRECTION

PATENT NO. : 7,097,952 B2
APPLICATION NO. : 11/125373
DATED : August 29, 2006
INVENTOR(S) : Keita Nozawa et al.

It is certified that error appears in the above-identified patent and that said Letters Patent is hereby corrected as shown below:

ON TITLE PAGE AT (30) FOREIGN APPLICATION PRIORITY DATA

"1999/218643" should read --11-218643--;
"1999/218644" should read --11-218644--;
"1999/218659" should read --11-218659--; and
"2000/052719" should read --2000-052719--.

COLUMN 7

Line 26, "fog-" should read --fog--.

COLUMN 14

Line 43, "Pre-" should read --pre- --.

COLUMN 28

Line 48, "$10^{12-1014}$ ohm.cm." should read --$10^{12}$-$10^{14}$ ohm.cm.--.

COLUMN 31

Line 57, "and stirred" should read --¶ The above ingredients were warmed at 50 °C and stirred--; and
Line 59, "2,2'-azobis(0,2,4-" should read --2,2'-azobis(2,4- --.

COLUMN 42

Line 48, "(cross linking" should read --(crosslinking--.

COLUMN 60

Line 34, "80 g/$m^2$ The" should read --80 g/$m^2$. The--.

UNITED STATES PATENT AND TRADEMARK OFFICE

CERTIFICATE OF CORRECTION

PATENT NO. : 7,097,952 B2
APPLICATION NO. : 11/125373
DATED : August 29, 2006
INVENTOR(S) : Keita Nozawa et al.

It is certified that error appears in the above-identified patent and that said Letters Patent is hereby corrected as shown below:

COLUMN 61

Line 22, “rutileform” should read --rutile-form--; and
Line 48, “SF-1=0.112” should read --SF-1=112--.

Signed and Sealed this

Twentieth Day of February, 2007

JON W. DUDAS
*Director of the United States Patent and Trademark Office*